US006282497B1

(12) United States Patent
Bharathan et al.

(10) Patent No.: US 6,282,497 B1
(45) Date of Patent: Aug. 28, 2001

(54) METHOD FOR ANALYZING THE CHEMICAL COMPOSITION OF LIQUID EFFLUENT FROM A DIRECT CONTACT CONDENSER

(75) Inventors: Desikan Bharathan, Lakewood; Yves Parent; A. Vahab Hassani, both of Golden, all of CO (US)

(73) Assignee: Midwest Research Institute, Kansas City, MO (US)

( * ) Notice: Subject to any disclaimer, the term of this patent is extended or adjusted under 35 U.S.C. 154(b) by 0 days.

(21) Appl. No.: 09/292,535

(22) Filed: Apr. 15, 1999

Related U.S. Application Data

(62) Division of application No. 08/824,236, filed on Mar. 25, 1997, now Pat. No. 5,925,291.

(51) Int. Cl.[7] ..... G01N 31/00
(52) U.S. Cl. ..... 702/23; 702/30; 700/266
(58) Field of Search ..... 702/23, 30, 50; 700/266, 267, 270, 271; 703/5

(56) References Cited

U.S. PATENT DOCUMENTS

| | | | | |
|---|---|---|---|---|
| 3,934,471 | * | 1/1976 | White et al. | 702/47 |
| 5,313,800 | * | 5/1994 | Howard et al. | 702/23 |
| 5,339,254 | * | 8/1994 | Matlock et al. | 702/19 |
| 5,464,504 | * | 11/1995 | Beauford | 702/23 |
| 5,661,670 | * | 8/1997 | Bharathan et al. | 703/5 |

OTHER PUBLICATIONS

D. Bharathan/B.K. Parsons, and J.A. Althof; "Direct–Contact Condensers for Open–Cycle OTEC Applications; Model Validation with Fresh Water Experiments for Structured Packings"; SERI/TP–252–3108; pp. 39–77, Oct. 1998.*

* cited by examiner

*Primary Examiner*—Patrick Assouad
*Assistant Examiner*—Bryan Bui
(74) *Attorney, Agent, or Firm*—Paul J. White

(57) ABSTRACT

A computational modeling method for predicting the chemical, physical, and thermodynamic performance of a condenser using calculations based on equations of physics for heat, momentum and mass transfer and equations of equilibrium thermodynamics to determine steady state profiles of parameters throughout the condenser. The method includes providing a set of input values relating to a condenser including liquid loading, vapor loading, and geometric characteristics of the contact medium in the condenser. The geometric and packing characteristics of the contact medium include the dimensions and orientation of a channel in the contact medium. The method further includes simulating performance of the condenser using the set of input values to determine a related set of output values such as outlet liquid temperature, outlet flow rates, pressures, and the concentration(s) of one or more dissolved noncondensable gas species in the outlet liquid. The method may also include iteratively performing the above computation steps using a plurality of sets of input values and then determining whether each of the resulting output values and performance profiles satisfies acceptance criteria.

22 Claims, 33 Drawing Sheets

METHOD FOR ANALYZING THE CHEMICAL COMPOSITION OF LIQUID EFFLUENT FROM A DIRECT CONTACT CONDENSER

CROSS-REFERENCE TO RELATED APPLICATION

The present application is a division of U.S. patent application Ser. No. 08/824,236 for a "METHOD AND APPARATUS FOR HIGH-EFFICIENCY DIRECT CONTACT CONDENSATION" filed Mar. 25, 1997 now U.S. Pat. No. 5,925,291.

CONTRACTUAL ORIGIN OF THE INVENTION

The United States Government has rights in this invention under Contract No. DE-AC36-98GO-10337 between the U.S. Department of Energy and the National Renewable Energy Laboratory, a Division of Midwest Research Institute.

BACKGROUND OF THE INVENTION

1. Field of the Invention

The present invention relates to direct contact condensation and, more particularly, to an improved direct contact condenser apparatus for use in a geothermal power plant, and a method of condensing geothermal vapor utilizing same. The present invention also relates to a method for predicting the performance of an improved direct contact condenser.

2. Description of the Prior Art

Geothermal energy resources have generated considerable interest in recent years as an alternative to conventional hydrocarbon fuel resources. Fluids obtained from subterranean geothermal reservoirs can be processed in surface facilities to provide useful energy of various forms. Of particular interest is the generation of electricity by passing geothermal vapor through a steam turbine/generator.

The construction and operation of geothermal power plants would be simplified if the low-pressure effluent from the steam turbine were exhausted directly into the atmosphere. However, geothermal fluids typically comprise a variety of potential pollutants, including noncondensable gases such as ammonia, hydrogen sulfide, and methane. Because of these contaminants, particularly hydrogen sulfide, discharging a geothermal vapor exhaust into the atmosphere is usually prohibited for environmental reasons. Thus, the conventional approach is to exhaust the turbine effluent into a steam condenser to reduce the turbine back pressure and concentrate the noncondensable gases for further downstream treatment.

Many geothermal power plants utilize direct contact condensers, wherein the cooling liquid and vapor intermingle in a condensation chamber, to cool and condense the vapor exhausted from the turbine. Direct contact condensers are generally preferred over surface condensers, in which the vapor and cooling liquid are separated by the surface of the conduit through which the cooling liquid flows, because of the former's relative simplicity and low cost. However, to realize optimal heat transfer efficiency using direct contact condensers, the cooling liquid must be introduced into the condensation chamber at a high enough velocity to disperse the liquid into fine droplets, i.e., to form a rain, which increases the surface area for condensation. Unfortunately, this high velocity discharge reduces the contact time between the cooling liquid and the vapor, which in turn reduces the heat exchange efficiency. Consequently, conventional direct contact condensers require relatively large condensing chambers to compensate for this low heat transfer efficiency and to provide sufficient contact between the liquid and vapor to effect condensation.

One way to increase the condensation efficiency, and thus minimize the size of the direct contact condenser, is to inject the cooling liquid through a plurality of individual nozzles, which disperses the cooling liquid in the form of a film. Because a film provides greater surface area for condensation than normal liquid injection, the cooling liquid can be introduced into the chamber at perhaps a lower rate and a lower injection pressure, i.e., without generating a rain of fine droplets. Although these spray-chamber condensers offer somewhat improved condensation efficiency and more compact designs than previous generation condensers, they require substantial quantities of cooling liquid to obtain sufficient condensation. Therefore, because of the additional energy requirements and losses associated with pumping the excess cooling liquid to the condensation chamber, the practical efficiency of these condensers remains low.

Subsequent developments have focused on improving the efficiency of contact between the vapor and cooling liquid by modifying the liquid injection and/or dispersion mechanisms. U.S. Pat. No. 3,814,398 to Bow, for example, discloses a direct contact condenser having a plurality of spaced-apart deflector plates angularly disposed relative to the cooling liquid inlet. The deflector plates are positioned to break up the cooling liquid into liquid fragments, thus generating a film of coolant. The condenser includes multiple spray chambers, wherein each chamber has deflector plates and a liquid conduit. Obvious disadvantages of this design are its complexity and high cost due to the large numbers of partitions, deflector plates, and liquid conduits required to generate the film.

In addition to spray chambers, heat transfer between the cooling liquid and the vapor in direct contact condensers has been accomplished using baffle tray columns, cross-flow tray columns, and pipeline contractors (J. R. Fair, *Chemical Engineering,* 2:91–100 (1972); J. R. Fair, *Chem. Eng'g Prog. Symp.,* 68(118):1–11(1972); and J. R. Fair, *Petroleum and Chemical Engineer,* 2:203–210 (1961)). Unfortunately, all of these designs yield generally low (60–70%) condensation efficiencies due to back-mixing. Moreover, many such condensers, particularly cross-flow tray condensers, involve a long, tortuous path for the vapor flow from the vapor inlet to the noncondensable gas outlet. To provide this long, tortuous vapor path, such devices require a large housing and a complex internal network. In addition to being difficult and costly to produce, these conventional designs generally suffer from high condenser back pressures as a result of the tortuous vapor path. Finally, most of these conventional designs, and baffle-column designs in particular, suffer from large gas-side pressure losses due to the generally high concentrations of uncondensed vapor in the exhausted noncondensable gas stream. Considerable gas-side pressure losses thus result from the additional energy requirements associated with pumping this residual vapor from the condensing chamber and reduce the useful power that can be extracted from the turbine.

Direct contact condensers have also been designed using packed columns as the liquid-vapor contact medium to improve the efficiency of contact between the vapor and cooling liquid. However, such packed columns are typically randomly distributed and thus create a complex vapor flow pattern. Because of this complex flow pattern, packed-column condensers suffer from some of the same drawbacks as the cross-flow tray condensers, namely, high condenser back pressures and large gas-side pressure losses.

Another significant concern regarding geothermal vapor processing relates to the presence of certain noncondensable gases, as discussed above. When this contaminated vapor is mixed with the cooling liquid in the condensation chamber, a portion of the noncondensable gases dissolves in the liquid. These noncondensable gases tend to diffuse between the condensate-cooling liquid mixture and the gas stream. The relative concentrations of contaminants in the liquid and gas streams depend upon the geometry of the condenser and fluid property (e.g., temperature and pressure) conditions within the condenser. In practice, these contaminants typically cause both the liquid and gas effluents from the condenser to be corrosive and/or toxic. Although various processes have been developed for pollution abatement at geothermal power plants, most such processes involve expensive chemical treatments and often do not provide acceptable abatement of emissions at a reasonable cost. Moreover, from both environmental and economic perspectives, it would be advantageous to segregate the more highly contaminated condensate mixture from the spent cooling liquid. It would be desirable to separate these two liquids so that the contaminated portion can be effectively treated, while the less contaminated cooling liquid is returned to the cooling tower and safely recycled. Unfortunately, none of the existing direct contact condensers provide a mechanism for effectively concentrating the contaminants in one fraction and separating this contaminated fraction from the relatively innocuous cooling liquid stream.

In addition to environmental concerns, the noncondensable gases present in geothermal vapor can accumulate in the condensation chamber, thus adversely affecting the efficiency of the turbine and/or condenser, and impairing overall plant performance. Unless removed, these gases will collect in the condenser, blanketing the condensing surfaces and reducing the surface area for condensation. These accumulated contaminants also increase the pressure within the condensation chamber, thus affecting the turbine back pressure. Moreover, hydrogen sulfide readily dissolves in the cooling liquid, where it oxidizes to form sulfurous acid and sulfuric acid, both of which are strongly corrosive to many metals. Thus, to maintain a suitable operating pressure within the condenser and to minimize corrosion and fouling of equipment, additional pumping or compression power must be expended to remove these gases.

Another problem commonly associated with existing condensers is the difficulty in achieving uniform distribution of cooling liquid across the condenser housing. To achieve optimum efficiency, it is important that the coolant be dispersed uniformly throughout the condensing chamber to facilitate mixing with the vapor and to maximize the available area for condensation. Moreover, it is well known that, in devices having cooling liquid injection in the upflow stage, vapor may condense mostly near the bottom, which is desirable, or may condense mostly on top, because of upsets. This switching between the two modes of operation is typically termed bang-bang instability. Thus, it is desirable to include an automatic and intermittent cooling liquid discharge operation in the upward flow stage, wherein additional cooling liquid is supplied during periods of operational instability and/or high vapor flow through the upflow stage. Finally, direct contact condensers suitable for use in a geothermal power plant must also be inexpensive, compact, and simple in design. Appropriate engineering methods to develop such designs must also be available.

A need therefore exists for an improved, high efficiency direct contact condenser for use in a geothermal power plant. This improved condenser should include a vapor-liquid contact medium to facilitate contact between the vapor and cooling liquid, a relatively short and straight vapor flow path to minimize the condenser back pressure and vapor pressure losses, and a separate hot well for effluents containing relatively high concentrations of noncondensable gases. This high efficiency condenser should also provide uniform distribution of cooling liquid, an automatic and intermittent liquid discharge system in the upflow stage, and be inexpensive, compact, easy to maintain, and simple in design. A need also exists for a method of condensing vapor from a geothermal power plant which eliminates or minimizes the efficiency and environmental concerns commonly associated with the direct contact condensation of geothermal vapor. Finally, a need exists for a method of predicting the performance of a direct contact vapor condenser. Until this invention, no such device or methods existed.

SUMMARY OF THE INVENTION

Accordingly, it is a general object of this invention to improve the efficiency of direct contact vapor condensation.

It is a more specific object of this invention to provide an efficient process and apparatus for direct contact condensation by improving the efficiency of heat exchange between the vapor and a cooling liquid.

It is another object of this invention to provide a process and apparatus for achieving direct contact condensation effectiveness as near to thermodynamic limits as possible, and to achieve such effectiveness with minimal vertical pumping height requirements, thus creating minimal pressure loss for the liquid.

Still another object of this invention is to provide a direct contact condenser apparatus that operates with a minimum of pressure loss on the vapor side by providing simple straightforward flow paths for the vapor.

It is yet another object of this invention to provide a direct contact condenser apparatus that operates with a minimum of back pressure on the turbine.

It is a further object of this invention to provide a direct contact condenser having a separate hot well for effluents containing a high concentration of dissolved noncondensable gases.

It is yet a further object of this invention to provide a method and apparatus for achieving a relatively uniform distribution of cooling liquid in the condensation chamber.

It is still another object of this invention to provide a direct contact condenser apparatus capable of automatic and intermittent cooling liquid discharge in the upward vapor flow stage to prevent undesirable counter current operation.

It is also an object of this invention to provide a process and apparatus requiring minimum volume of cooling liquid for the condensation process, low pressure losses associated with liquid injection, low pressure losses associated with vapor withdrawal, and high effectiveness.

It is a further object of this invention to provide a direct contact condenser suitable for use in a geothermal power plant which is inexpensive, compact, easy to maintain, and simple in design.

Finally, it is an object of this invention to provide a method for predicting and optimizing the chemical and physical performance of a direct contact vapor condenser.

To achieve the foregoing and other objects and in accordance with the purposes of the present invention, as embodied and broadly described herein, the articles of manufacture of this invention may comprise a chamber for receiving a vapor stream containing noncondensable gases, a conduit for supplying cooling liquid into the chamber, and a contact medium disposed in the chamber to facilitate contact and direct heat exchange between the vapor stream and cooling liquid. The contact medium defines a substantially straightforward vapor flow path, and is configured to affect both the efficiency of condensation and the absorption of noncondensable gases into the condensate-cooling liquid mixture.

To further achieve the foregoing and other objects and in accordance with the purposes of the present invention, as embodied and broadly described herein, the methods of this invention may comprise condensing a vapor stream containing noncondensable gases. In particular, the method comprises introducing the vapor stream into a condensing chamber and passing the vapor stream through a contact medium disposed in the condensing chamber. The contact medium is at least partially coated with a cooling liquid so that a condensate-cooling liquid mixture is formed. The contact medium is configured to affect the efficiency of condensation as well as the absorption of noncondensable gases into the condensate-cooling liquid mixture.

The present invention further includes a method for predicting the performance of a condenser. In particular, the method comprises providing a set of input values relating to a condenser, the input values including liquid loading, vapor loading, and geometric characteristics of the contact medium in the condenser, wherein the geometric characteristics of the contact medium include the dimensions and orientation of a channel in the contact medium. The process further includes simulating performance of the condenser using the set of input values to determine a related set of output values, wherein the output values may include outlet liquid temperature and flow rate from the condenser, and the concentration(s) of one or more dissolved noncondensable gas species in the outlet liquid. Finally, the process includes iteratively performing the above steps using a plurality of sets of input values, and determining whether each of the resulting output values is acceptable for further analysis.

BRIEF DESCRIPTION OF THE DRAWINGS

The accompanying drawings, which are incorporated in and form a part of the specifications, illustrate the preferred embodiments of the present invention, and together with the descriptions serve to explain the principles of the invention. In the Drawings

FIG. 21(*b*) is a continuation of FIG. 21(*a*);

FIG. 22(*b*) is a continuation of FIG. 22(*a*);

DETAILED DESCRIPTION OF THE PREFERRED EMBODIMENTS

Figure 1:
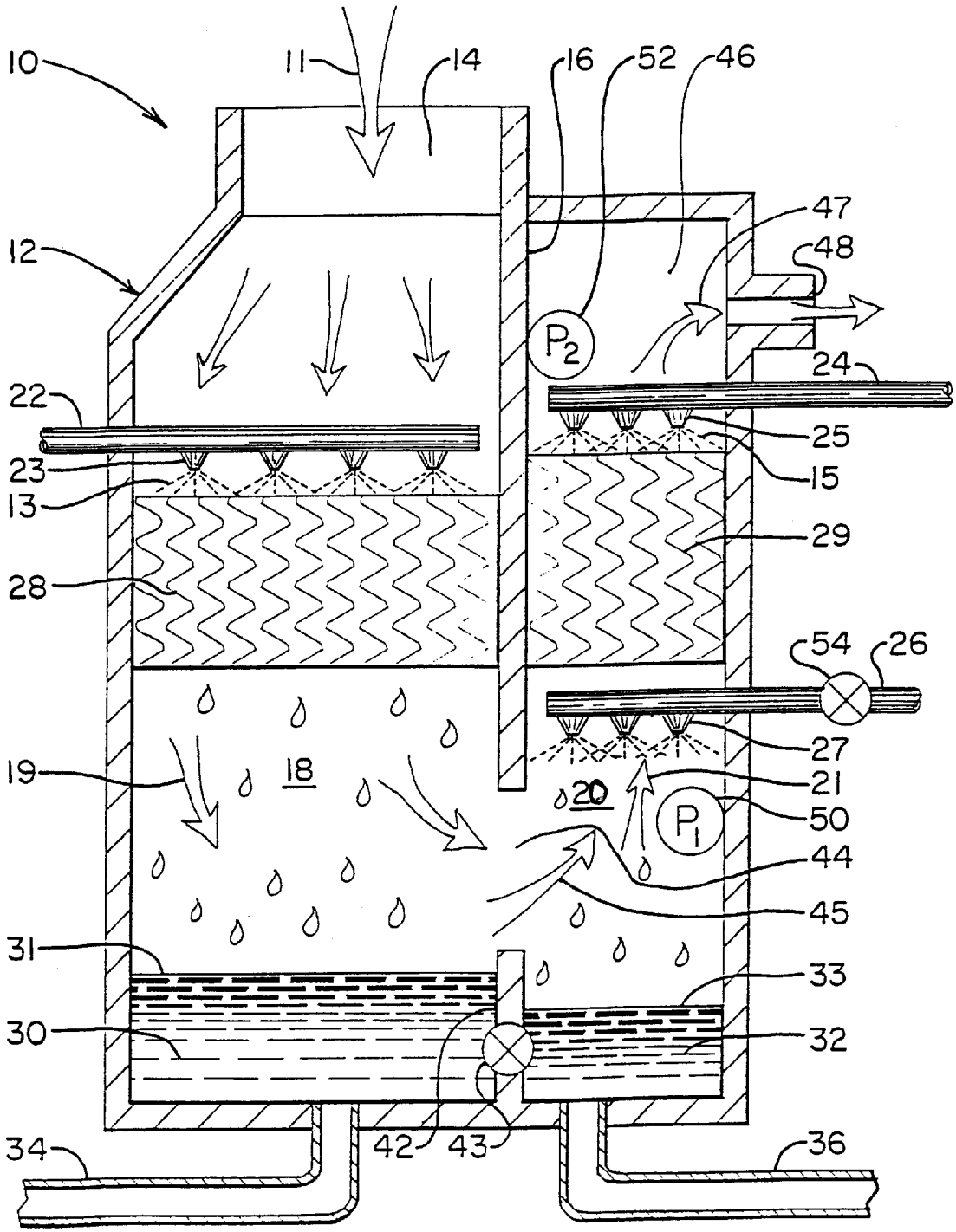
FIG. 1 is a cross-sectional view (not in actual scale or proportion) of a direct contact condenser of the present invention.
Figure 2:
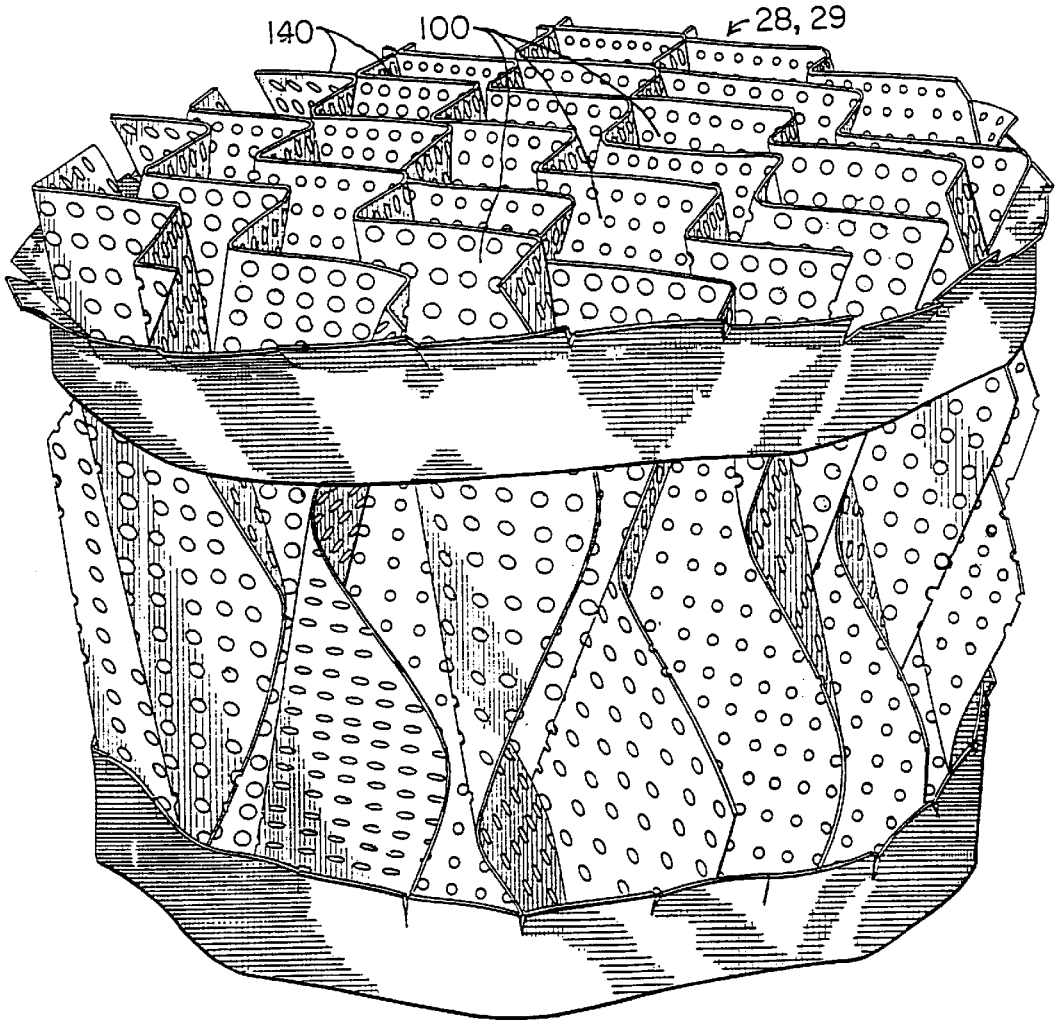
FIG. 2 is a perspective view of the vapor-liquid contact medium in a preferred embodiment of the present invention.
Figure 3:
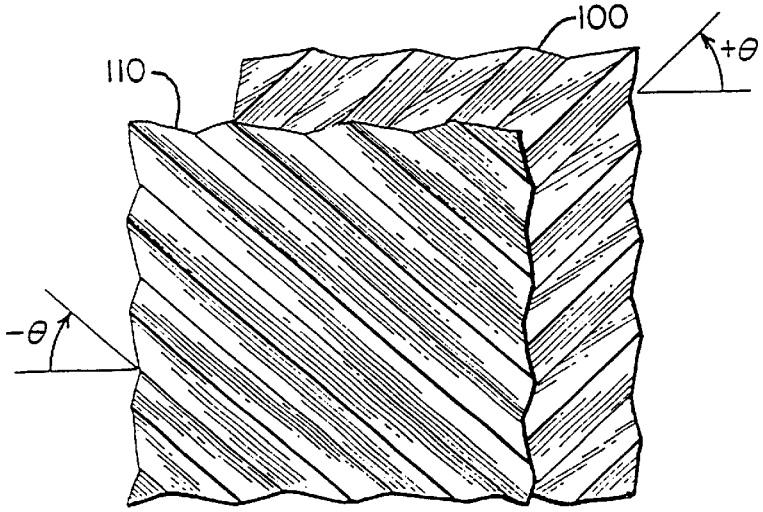
FIG. 3 provides a side view of the vapor-liquid contact medium of FIG. 2, showing the orientation of two adjacent layers of corrugated sheets.

The direct contact condenser 10 of the present invention, as shown in FIG. 1, enhances the efficiency of direct contact condensation by improving the efficiency of heat exchange between the vapor to be condensed and the cooling liquid. The condenser 10 is capable of achieving condensation effectiveness as near to thermodynamic limits as possible, while operating with minimal liquid and vapor pressure losses. To accomplish these results, the direct contact condenser 10 includes a vapor-liquid contact medium 28, as best seen in FIG. 1, comprising a layered composite of corrugated sheets 100, 110, as best seen in FIGS. 2 and 3. The corrugated sheets 100, 110, which provide a large surface area for condensation, are arranged relative to each other, as shown in FIG. 3, and oriented within the condensing chamber 18, as shown in FIGS. 1 and 2, to provide a plurality of relatively simple and straightforward vapor flow paths or channels 140, thus minimizing deleterious back pressure on the turbine (not shown) upstream from inlet 14. The contact medium 28 also retards the rate of fall of the cooling liquid 13, thereby increasing its dwell time within the condensing chamber 18 and improving condensation efficiency.

In addition to enhancing the efficiency of condensation, the contact medium 28 affects the heat and mass transfer dynamics between the vapor 11 and cooling liquid 13, including the rate of dissolution of noncondensable gases into the cooling liquid-condensate mixture. Both the efficiency of condensation and the concentrations of dissolved gases in the liquid effluent 31 can be predicted and manipulated based on the physical parameters of the contact medium 28, such as the distance B between adjacent corrugation ridges 112 (see FIG. 4), the height h of the corrugations (see FIG. 5), the corrugation angle θ (see FIG. 5), the thickness 154 of the sheets 100, 110, 150, the inclination angles of the sheets, and the overall height and width dimensions of the contact medium 28. In general, the smaller and denser the contact medium 28, and the larger the inclination angle θ of the corrugated sheets 100, 110 with respect to the horizontal, the greater the efficiency of condensation and the higher the concentrations of dissolved gases in the liquid effluent. However, the vapor-side pressure loss also increases under these conditions. Thus, by manipulating the size and geometry of the contact medium 28, the physical and chemical performance of the condenser 10 can be effectively optimized. The direct contact condenser 10 may include a plurality of condensing chambers 18, 20 for sequential condensing treatments. The first condensing chamber 18 is designed to minimize the absorption of noncondensable gases in the cooling liquid 13, while subsequent condensing chamber(s) 20 are designed to maximize condensation and scrub any residual steam from the vapor stream 45, thus minimizing vapor carry over. The less contaminated liquid 31 from the first chamber 18 may be efficiently recycled, while the more highly contaminated effluent 33 from subsequent chamber(s) 20 may be directed to an appropriate site for further treatment (not shown).

A typical direct contact condenser apparatus 10 might have a housing 12 with a first or primary condenser chamber 18 for condensing a substantial portion of the inlet steam 11, and a secondary or upward steam flow chamber 20 for scrubbing residual steam that is not condensed in the first condenser chamber, as depicted generally in FIG. 1. Direct contact condenser apparatus 10 may also include a steam inlet 14, a first well 30 for collecting condensed liquids 31 that contain only minimal dissolved noncondensable gases from the first condensation chamber 18, a second well 32 for collecting condensed liquids 33 that contain higher concentrations of dissolved gases, such as hydrogen sulfide, from the second condensation chamber 20, and an exhaust pipe 48 for removal of any noncondensable gases 47 that are not dissolved in the liquid condensates 31 and 33. A first drain 34 removes condensate 31 from the first well 30, and a second drain 36 removes condensate 33 from the second well 32. Condensation of the steam 11 to liquid is facilitated by cooling the steam 11 with cooling water 13 in the first chamber 18 and with cooling water 15 in the second chamber 20.

A significant feature of this invention, which will be described in more detail below, is the design and structure of two vapor-liquid contact media 28, 29, which are provided in the first chamber 18 and the second chamber 20, respectively, for the purpose of facilitating contact and direct heat exchange between the vapor and cooling liquid. The contact media 28, 29 preferably include multiple layers of thin corrugated sheets 100, 110 arranged to form vertical interleaved channels or passageways 140 for the steam 11 and cooling liquid streams 13, 15, which provide a large contact surface and uniform distribution of the cooling liquid 13, 15 throughout the respective condensing chambers 18, 20, while retarding the rate of fall of the cooling liquid 13, 15 from the respective supply pipes 22, 24 to the wells 30, 32. These media structures 28,29 increase dwell time of the cooling liquid 13, 15 in the respective condensing chambers 18, 20, thus improving condensation efficiency, while also providing relatively straightforward flow paths for the steam through the contact media 28, 29, which minimizes deleterious back pressure on turbines (not shown) that are upstream of the condenser 10 in typical power generation facilities. The downward steam flow chamber 18 and the second or upward steam flow chamber 20 each comprises a plurality of cooling liquid supply pipes 22, 24, respectively, dispersed horizontally over the tops of respective media 28, 29 for delivering cooling water 13, 15 to the respective vapor-liquid contact media 28, 29. The upward steam flow chamber 20 also includes a second set of cooling liquid supply pipes 26 disposed beneath the vapor-liquid contact medium 29, which operate intermittently in response to a pressure differential between the gas stream on opposite sides of contact medium 29.

Figure 9:
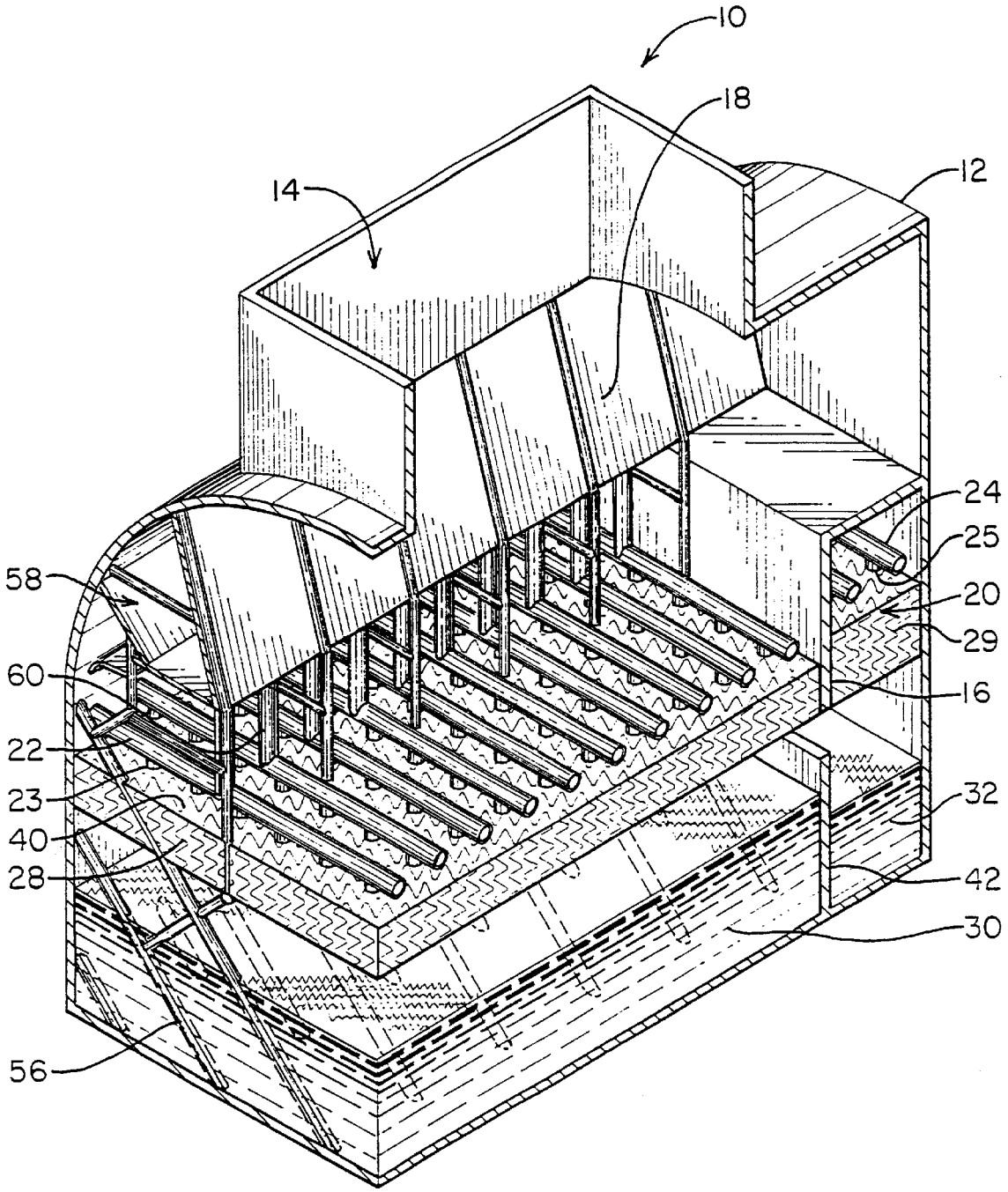
FIG. 9 is a partial perspective view of the direct contact condenser apparatus in a preferred embodiment of the present invention.

The illustrations of direct contact condenser 10 and its various chambers or components in FIGS. 1 and 9 are not intended to be drawn to scale or even in proportion. Therefore, these figures are for illustrative purposes only, as will be understood by persons skilled in this art. Also, for the purpose of providing a detailed description and an enabling embodiment, but not for the purpose of limitation, this description refers to steam (or vapor) and cooling water (or liquid) for the vapor and liquid components of the condensation process. Similarly, this description refers, for example as shown in FIG. 1, to a steam inlet 14, a downward steam flow chamber 18, and an upward steam flow chamber 20 for exemplary components of the condenser apparatus 10. However, the apparatus and methods of this invention can be practiced with many vapor and liquid combinations and variations, and the present invention should not be regarded as limited to the specific exemplary steam and cooling water compositions or apparatus configurations described or illustrated herein.

Before describing the contact media 28, 29 design criteria and structure according to this invention in detail, it is helpful to have an understanding of the functional and structural details of the condenser apparatus 10 as a whole. The direct contact condenser 10 includes a steam inlet 14 arranged to receive steam 11 from an external source, such as the exhaust of a steam turbine (not shown), above the condenser 10 and to direct the steam into the first or primary chamber 18, which is also sometimes referred to in this description as the downward steam flow chamber because it is the chamber in which the steam flows downwardly in the preferred embodiment shown in FIG. 1. As the steam flows through the first or primary chamber 18, it passes through the first or primary vapor-liquid contact medium 28, which will be described in more detail below. The first or primary cooling liquid supply pipe 22 is disposed immediately above the first vapor-liquid contact medium 28 and has a plurality of openings or nozzles 23 mounted thereon. The supply pipe 22 is connected to an external cooling liquid supply source, such as a supply tank or cooling tower (not shown), so that cooling water 13 is sprayed through the nozzles 23 downwardly over the first or primary vapor-liquid contact medium 28. The nozzles 23 are preferably, although not necessarily, spaced evenly from each other over the first or primary medium 28 so that the cooling water 13 is sprayed uniformly over the medium 28. The vapor-liquid contact medium 28 provides a large surface area, which facilitates contact and direct heat exchange between the steam and cooling liquid while providing a relatively straight forward flow path for the steam 11, as will be discussed more fully below. Due to the effective transfer of heat from the steam 11 to the cooling liquid in the medium 28, a substantial portion of the steam 11 will be condensed in the primary chamber 18, and the resulting mixture of cooling liquid and condensate falls into well 30 at the bottom of the housing 12 in the downward steam flow chamber 18.

A first partition wall member 16 extends vertically downward from the top of the housing 12 at one side of the steam inlet 14 to separate the primary or downward steam flow chamber 18 and the secondary or upward steam flow chamber 20. The first partition wall 16 is oriented in a position substantially perpendicular to the longitudinal axis of the housing 12, and has its opposing ends connected to the longitudinal sidewalls of the latter. The first partition wall member 16 is vertically spaced above a second partition wall member 42, discussed below, by a flow space 44 which permits the steam 19 passing through the medium 28 to flow from the primary chamber 18 to the secondary chamber 20, as indicated by flow arrows 45.

The steam 19 that is not condensed in the primary chamber 18 continues through the flow space 44 into the secondary chamber 20 where it flows upward, as indicated by flow arrows 21. As the steam flows upwardly through the secondary chamber 20, it passes through a second vapor-liquid contact medium 29, similar to the first vapor-liquid contact medium 28, both of which will be described in more detail below. A secondary supply pipe 24 is disposed immediately above the second vapor-liquid contact medium 29 and has a plurality of openings or nozzles 25 mounted thereon. The supply pipe 24 is connected to an external cooling liquid supply source (not shown) so that the cooling liquid 15 is sprayed through the nozzles 25 downwardly over the second vapor-liquid contact medium 29. The nozzles 25 are preferably, although not necessarily, evenly spaced from each other over the second medium 29 so that the cooling water 15 is sprayed uniformly over the medium 29. Like the first or primary vapor-liquid contact medium 28, the second vapor-liquid contact medium 29 provides a large surface area, which facilitates contact and direct heat exchange between the steam 21 and cooling liquid 15 while providing a relatively straight forward flow path for the steam 21, as will be described more fully below. Most, and preferably substantially all, of the steam 21 in secondary chamber 20 will be condensed in the secondary medium 29, and the resulting condensate, along with cooling liquid from supply pipe 24 and a substantial portion of the noncondensable gases dissolved in the liquid, flow or fall into the well 32, located at the bottom of the secondary chamber 20. The noncondensable gases stream exiting the second vapor-liquid contact medium 29 passes into gas chamber 46, as indicated by flow arrow 47, where it is removed through a gas exhaust pipe 48 and a vacuum pump (not shown) or its equivalent.

A second partition wall member 42 projects upwardly from the bottom of the housing 12 and preferably to align substantially with the first partition wall member 16, discussed above. Like the first partition wall member 16, second partition wall member 42 is oriented in a position perpendicular to the longitudinal axis of the housing 12, and has its opposing ends connected to the longitudinal sidewalls of the latter. Second partition wall member 42 thus separates wells 30 and 32, formed at the bottom of the downward steam flow chamber 18 and the upward steam flow chamber 20, respectively. Wells 30 and 32 collect condensate and cooling liquid from the respective primary and secondary chambers 18, 20, and communicate with separate condensate outlets or drains 34, 36, to facilitate transport to their respective destinations, as will be discussed more fully below. Second partition wall member 42 may include a valve 43 to permit fluid communication between wells 30 and 32. It may be desirable to allow fluid communication between wells 30 and 32 under certain conditions, for example when the concentrations of dissolved noncondensable gases in condensates 31 and 33 are both minimal. In this instance, condensates 31 and 33 may be allowed to mix, and the combined condensates may be efficiently recycled, as will be discussed in more detail with respect to condensate 31.

The vapor-liquid contact media 28, 29 is a rigid material having a patterned or structured configuration, commonly referred to as structured packing, in which a plurality of corrugated sheets are layered and positioned in structured relationship to each other. Because of its structure, the contact media 28, 29 creates a relatively simple and straightforward steam flow path, as discussed more fully below, as compared to conventional designs, such as cross-flow trays and packed columns, which create a generally tortuous flow pattern. The contact media 28, 29 may be formed of any suitable material which is inexpensive, durable, sturdy, stable under standard processing conditions, chemically compatible with the impurities and components in the steam and cooling liquid, and relatively resistant to corrosion and fouling. Suitable materials for use as contact media 28, 29 in the present invention include, for example, a variety of metals and plastic resins. Preferred contact media 28, 29 include a variety of commercially available metallic and plastic solid sheets and gauze (wire mesh) sheets, such as those sold by Munters and KOCH.

Figure 4:
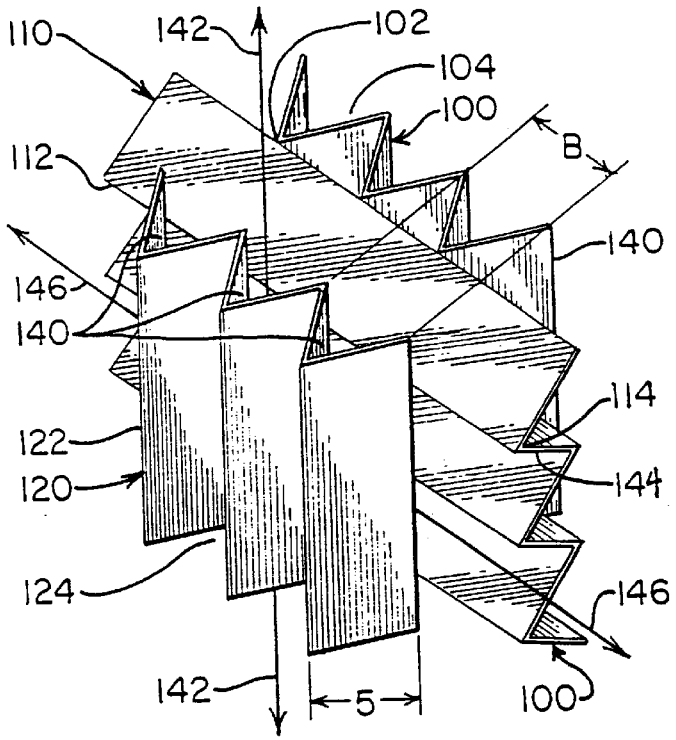
FIG. 4 provides a partial perspective view of three adjacent sheets of the vapor-liquid contact medium shown in FIG. 2.

Referring now to FIGS. 2–6, the contact media 28, 29 in a preferred embodiment of the present invention comprises a layered composite of corrugated sheets 100, 110, and 120. The preferred orientation of corrugated sheets 100, 110 in contact media 28, 29 is shown in FIGS. 3 and 4. The sheets 100, 110 are preferably arranged in alternating angles of corrugation. For example, if sheet 100 has a corrugation angle of $+\theta$ from the horizontal, an adjacent sheet 110 preferably has a corrugation angle of $-\theta$ from the horizontal, although other angles would also work.

As best seen in FIG. 4, the contact media 28, 29 in a preferred embodiment each comprises a plurality of corrugated sheets 100, 110, 120 positioned in juxtaposed relation to each other with the ridges 102, 122 and grooves 104, 124 in every other sheet 100, 120 oriented at one angle $+\theta$ and the ridges 112 and grooves 114 in each intervening sheet 110 oriented at another angle $-\theta$ with respect to the horizontal. The grooves 104, 124 form channels 140, which provide a plurality of steam and gas flow paths oriented in a first direction 142, and the grooves 114 form channels 144, which provide a plurality of steam and gas flow paths oriented in a second direction 146.

Figure 5:
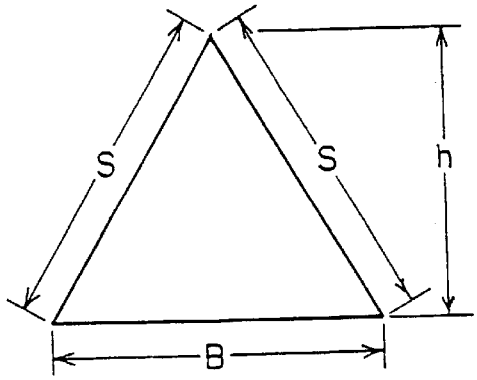
FIG. 5 is a first cross-sectional view of a channel within the vapor-liquid contact medium shown in FIG. 2, showing an intersection at the point of contact between adjacent sheets.
Figure 6:
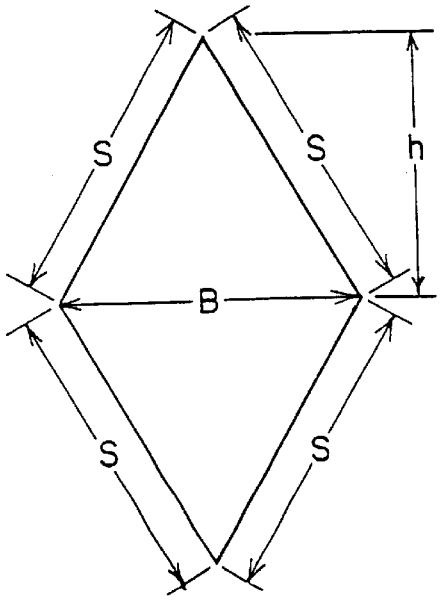
FIG. 6 is a second cross-sectional view of a channel within the contact medium shown in FIG. 2, showing an intersection between adjacent channels wherein fluids flowing in the adjacent channels communicate and intermingle.

FIGS. 5 and 6 illustrate alternate cross-sectional views within the channels 140. FIG. 5 shows a cross-sectional view at a contact point between adjacent corrugated sheets 100, 110. FIG. 6 shows a cross-sectional view at an intersection between adjacent channels 140, 144 wherein fluids flowing according to direction arrows 142 and 146 communicate and intermingle. Thus, contact media 28, 29 comprises a pattern of alternating and interconnecting channels 140, 144 which facilitates a periodic redistribution of the steam and cooling liquid. The geometry of the channels 140, 144 and in particular the geometry of their cross-sectional dimensions (as well as the inclination angle θ), at least partially define the heat and mass transfer dynamics between the steam and cooling liquid, as illustrated in Example 1 below. The cross-sectional dimensions shown in FIGS. 5–8 and applied in the predictive methods of the present invention include:

S=the width of the corrugation of sheets 100, 110, 120 (i.e., S is the "side" of channels 140, 144);

B=the distance between two consecutive corrugation ridges on sheets 100, 110, 120 (i.e., B is the "base" of channels 140, 144); and h=the height of the corrugations for sheets 100, 110, 120.

Figure 7:
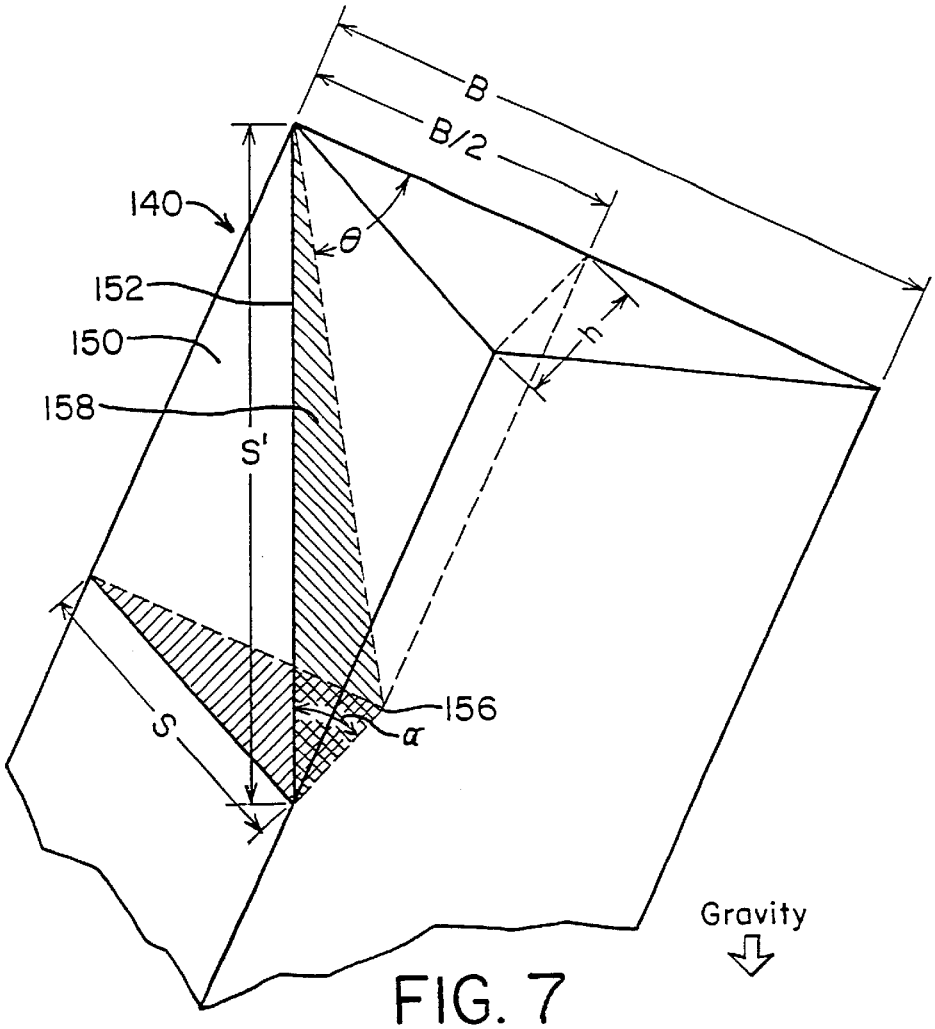
FIG. 7 shows various geometric parameters governing the heat and mass transfer within a channel.
Figure 8:
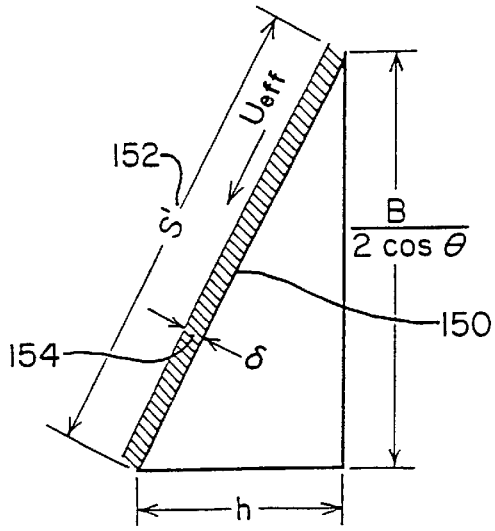
FIG. 8 is an additional view of the triangle 158 from FIG. 7, showing the cooling liquid film thickness 154 as the cooling liquid flows down surface 150.

FIGS. 7 and 8 illustrate other parameters relevant to the methods of the present invention, in addition to the sheet dimensions discussed above.

FIG. 8 is a partial view of a channel 140 of the contact media 28, 29, showing the flow of cooling liquid therein. More particularly, the cooling liquid flows by gravity as a film on an inclined surface of channel 140, i.e., surface 150 in FIG. 7. The methods of the present invention thus include the following additional parameters identified in FIGS. 7 and 8:

S'=liquid renewal length 152,

δ=liquid film thickness 154, and

α=modified inclination of the surface 150 from the horizontal 156.

To summarize, contact media 28, 29 facilitates continuous redistribution of the liquid flow while providing a relatively straight flow path for the vapor, thereby minimizing vapor pressure losses. Such materials also afford a relatively low ratio of pressure drop to heat- or mass-transfer coefficient per unit volume. Moreover, vapor-to-liquid contact occurs on opposing sides of the corrugated sheets 100, 110, 120 thus increasing the effective surface area for condensation. These materials also provide substantially uniform liquid distribution due to capillary action through the layers, even at low liquid loadings. Finally, although the contact media 28, 29 provides a relatively straight flow path for the vapor, it increases the dwell time of the liquid and thus significantly improves the efficiency of condensation.

As will be appreciated by those of skill in the art, the amount of the steam entering the upward steam flow chamber 20 will vary depending upon the condensation efficiency in the downward steam flow chamber 18, the concentration of noncondensable gases in the inlet gas stream 11, and variations in the inlet steam flow. Similarly, the amount of uncondensed steam entering the gas chamber 46 above the contacting medium 29 will vary depending upon the condensation efficiency in the upward steam flow chamber 20, together with variations in the flow rate and composition of the gas stream entering the chamber 20. Normally, during periods of high pressure loss in the upward steam flow chamber 20, the efficiency of condensation should decrease as relatively more cooling liquid becomes warmed through heat exchange with the vapor stream. Thus, during periods of high vapor pressure loss, relatively more steam will travel through the contact medium 29 without condensing and eventually collect in the gas chamber 46. Large gas-side pressure losses can therefore cause additional power requirements associated with pumping this residual steam from the condensing chamber. To accommodate these fluctuations in vapor pressure and to stabilize the steam flow through the contact medium 29, the present invention includes an automatic and intermittent cooling liquid discharge operation at the lower region of the upward steam flow chamber 20. This automatic cooling liquid discharge functions in response to the pressure differential of the gas stream on opposite sides of contact medium 29 by pressure sensors 50 and 52, shown in FIG. 1. Thus, pressure sensor 50 is physically located beneath contact medium 29 in the upward steam flow chamber 20, and pressure sensor 52 is physically located above contact medium 29 in the gas chamber 46.

The pressure readings attained by the pressure sensors 50 and 52 are compared by a conventional comparator (not shown for clarity) and the differential is utilized to control valve 54 on cooling liquid supply pipe 26 to provide additional cooling liquid to the upward flow chamber 20 as needed. Various off-the-shelf sensors and programmable controllers may be used for this application. If the data from sensors 50 and 52 indicate an excessive pressure difference, the controller can open control valve 54, providing additional cooling liquid in the upward flow chamber 20, below the contact medium 29. This automatic and intermittent cooling liquid discharge operation thus ensures that the direct contact condenser of the present invention operates in an efficient, low pressure loss mode. More specifically, this automatic discharge system minimizes parasitic losses on the vapor side by reducing the compression power required to remove the vapor in gas chamber 46 and, because of the intermittent nature, also minimizes parasitic losses on the liquid side by minimizing the pumping power requirements.

In using the direct contact condenser 10 in the condensation process of this invention, a portion of the steam 11 passing into the housing 12 through the inlet 14 is condensed as a result of heat exchange with the cooling liquid 13 in contact medium 28. The resulting condensate-cooling liquid mixture 31, including entrained air and dissolved impurities, falls into the well 30 and is eventually removed from the housing 12 via condensate outlet 34. Normally, any hydrogen sulfide present in the condensate-cooling liquid mixture is released into the environment when the cooling liquid is exposed to the atmosphere in the cooling tower. However, the amount of hydrogen sulfide released into the atmosphere must remain within stringent regulatory limits, which is currently defined as 200 grams per gross MWh.

A significant advantage associated with the process and apparatus of the present invention is the minimal amount of noncondensable gases, particularly hydrogen sulfide, present in the condensate-cooling liquid mixture 31 in the hot well 30. More specifically, the concentration of any particular noncondensable gas, such as hydrogen sulfide, in the condensate-liquid mixture 31 in well 30 can be effectively minimized by controlling the partial pressure of the gas in the downward steam flow chamber 18, i.e., by maintaining a high enough partial pressure of steam to minimize the tendency of the noncondensable gas to enter the liquid phase. In accordance with the present invention, and as described in detail in Examples 1 and 2 hereof, the partial pressure of a noncondensable gas in the chamber 18 is affected, at least in part, by the geometry of the vapor-liquid contact medium 28. Similarly, the partial pressure of the noncondensable gas in the upward steam flow chamber 20 is affected, at least in part, by the geometry of the vapor-liquid contact medium 29. The concentrations of dissolved gases in the condensate-liquid mixtures 31, 33 are also affected, although to a lesser extent, by the pH of the cooling liquids 13, 15, as discussed more fully below.

In one aspect of this invention, the performance of a direct contact condenser can be predicted and optimized based in part on certain geometric properties of the contact media 28, 29. Such geometric properties include the external dimensions of the contact medium (e.g., height and base), the dimensions of the channels 140, 144 within the contact medium, and the inclination angle of the channels. Other factors affecting the performance of the condenser relate to the condensation site (e.g., steam inlet temperature, cooling liquid inlet temperature, and inlet steam pressure) and the condenser operating conditions (e.g., condenser steam mass flow rate and cooling liquid mass flow rate, commonly referred to as "steam loading" and "liquid loading," respectively). These factors are combined to compute the performance of the condenser, as described in Examples 1 and 2. Specifically, integration steps are performed at various sites along the height of the contact media 28, 29, wherein each such integration applies fundamental physical properties of gas-liquid interactions in conjunction with the gas and liquid loadings and the geometry of the contact media 28, 29 to generate data regarding heat and mass transfer between the gas and liquid phases. The heat and mass transfer data from the integration steps are then combined to provide a prediction of the condenser performance, including a chemical profile of the condenser effluents 31, 33. This method thus provides a comprehensive thermodynamic and quantitative analysis of the condensation process.

In a further aspect of this invention, the above method is applied to optimize the direct contact condensation of geothermal steam. Specifically, the method is applied to a plurality of data sets for various condenser configurations, wherein each data set includes the above-identified parameters related to condensation site and conditions, to predict the performance of a specific contact media 28, 29. Thus, the predictive methods of the present invention may be iteratively applied to various configurations of input values to identify candidate condenser designs for further consideration.

As previously mentioned, the concentration of hydrogen sulfide in the liquid effluents 31, 33 also depends in part upon the pH of the cooling liquid. Adding caustic soda or its equivalent to raise the pH of the cooling liquid increases hydrogen sulfide solubility and improves the absorption process, whereas the presence of a strong acid such as sulfuric acid reduces absorption.

As a further safeguard against hydrogen sulfide emissions, various reactants can be added to the cooling liquid supply source to prevent hydrogen sulfide from being released to the atmosphere in the cooling tower. For example, iron is commonly supplied to the cooling liquid to oxidize at least a portion of the hydrogen sulfide constituent of the condensate-cooling liquid mixture. In this exemplified embodiment, the iron is typically stabilized in solution by the chelating agent hydroxy ethylethylene diamine triacetic acid (HEEDTA). The resulting Fe(III)(HEEDTA) complex catalyzes the oxidation of hydrogen sulfide to elemental sulfur by reduction to Fe(II)(HEEDTA). The catalytic activity of the Fe(III) chelate complex is regenerated by dissolved molecular oxygen, introduced into the cooling liquid through air injection during transport to the cooling tower and by normal air contact in the cooling tower. The sulfur thus produced reacts with the sulfites in solution to produce soluble thiosulfates. The overflow at the cooling tower or the blowdown containing these soluble thiosulfates and some iron chelate is reinjected into the ground. Due to losses from the tower blowdown, the concentration of iron complex and caustic soda must be continually monitored and adjusted. As will be understood by those of skill in the art, other types of reactants besides iron may also be utilized to achieve the same function.

In addition to minimizing the concentrations of dissolved noncondensable gases in the spent cooling liquid mixture, a related advantage associated with the condensation process and apparatus of the present invention is the physical separation of the condensate-cooling liquid mixture 31 in well 30 from the more highly contaminated condensate mixture 33 in well 32. This advantage is particularly significant since it allows the less contaminated cooling liquid 31 from well 30 to be efficiently recycled, as discussed above. The more highly contaminated condensate-cooling liquid mixture 33 from well 32 may be discharged through condensate outlet 36 without mixing with the cooling liquid mixture 31 in well 30. Condensate outlet 36 may be directed to an appropriate site for further treatment (not shown).

As can be appreciated from the above discussion, the process and apparatus of the present invention offers considerable advantages over existing direct contact condensation processes, particularly with respect to efficiency and environmental issues. The use of contact media 28, 29 in combination with the automatic and intermittent cooling liquid discharge operation enable the condensation effectiveness of this invention to very closely approach the maximum possible effectiveness within the limits of thermodynamic laws. It is even more significant that such efficiency results are obtained with minimal liquid-side pressure losses. Such efficiency is crucial in some applications, such as at power generation plants where the geothermal fields are of marginal quality or are located in water-starved areas. Even small increases in condensing efficiency would decrease significantly the quantity of cooling liquid and pumping power required, and would drastically affect the efficiency and economics of power generation in such a system. The use of contact media 28, 29 also provides a means for manipulating the partial pressures of noncondensable gases in the condensing chamber, particularly hydrogen sulfide, thereby minimizing the concentration of contaminants in parts of the cooling liquid effluent. Finally, the apparatus of the present invention is relatively inexpensive, compact, easy to maintain, and simple in design, as compared to existing condenser designs.

Referring now to FIG. 9, the direct contact condenser 10 of the present invention is shown in a quarter sectional view of a typical housing 12. The housing 12 includes a downward steam flow chamber 18 and an upward steam flow chamber 20. The downward steam flow chamber 18 comprises a plurality of cooling liquid supplying pipes 22, a vapor-liquid contact medium 28, and a well 30. The upward steam flow chamber 20 comprises a plurality of cooling liquid supplying pipes 24 and 26 (not shown), a vapor-liquid contact medium 29, and a well 32. The housing 12 further includes reinforcing beams 56, which provide sturdy reinforcements for the housing, and an optional conduit 58, which supplies the cooling liquid to cooling liquid supplying pipes 22, 24, 26 via vertical conduits 60.

Although the cooling liquid supplying pipes 22, 24 in FIG. 9 are positioned substantially perpendicular to the longitudinal axis of the housing 12, it will be understood that pipes 22, 24 can be arranged in any suitable orientation relative to housing 12, provided that the pipes 22, 24 distribute the cooling liquid substantially uniformly over the contact media 28, 29. Moreover, as will be further appreciated by those of skill in the art, other types of coolant injection mechanisms besides pipes 24 and nozzles 25 may also be utilized in the upward steam flow chamber 20 to achieve the same function. Such other injection mechanisms include, for example, perforated plates with risers.

Although the exemplified embodiment in FIG. 9 includes one downward flow chamber 18 and one upward flow chamber 20 within the housing 12, it should be understood that the upward flow chamber 20 may be located outside the housing 12, and that the condenser 10 may include a plurality of upward flow chambers 20, within or outside the housing 12. Moreover, another direct contact condenser 10 of the present invention may comprise a cross-current flow chamber (not shown), wherein the steam inlet 14 is located substantially adjacent the upward steam flow chamber 20, such that the inlet steam 11 enters the housing 12 in a horizontal flow path. In this embodiment, the vapor traverses the cross-current flow chamber, which preferably includes a plurality of cooling liquid supplying pipes, a vapor-liquid contact medium, and a separate well, similar to comparable components described above for the downward flow chamber 18 of the preferred embodiment 10, before entering the upward flow chamber 20. Finally, it should be understood that a plurality of direct contact condensers may be arranged, as appropriate, to provide sequential treatment for further condensing or cooling the noncondensable gas-steam mixture. Such additional condensers may include both flow chambers 18 and 20, a downflow or a cross-current flow chamber and an upward flow chamber 20, or a single upward flow chamber 20. In this latter embodiment, the steam inlet 14 may be located beneath the upward steam flow chamber 20 to introduce the noncondensable gas-steam mixture 11 directly into chamber 20, without first passing through a cross-current flow chamber or a downward steam flow chamber 18. It should be noted that in each of the above-described embodiments, the upward steam flow chamber 20 is always present.

The direct contact condenser 10 of the present invention can also be used for other conventional uses, such as condensing the exhaust vapors generated at fossil-fuel-fired power-generation facilities, and for systems which require condensing a vapor onto a liquid, such as vapor compression air-conditioning systems.

The invention is further described by a computational model used to predict the chemical, physical and thermodynamic performance of the condenser 10. The computational model performs calculations derived from the fundamental equations of physics and engineering for heat, momentum and mass transfer and fundamental equations of equilibrium thermodynamics to determine steady state profiles of various parameters throughout the condenser. These parameter profiles are used by the computational model to further calculate overall heat, momentum, mass and chemical component material balances around the condenser. Thus, the present invention yields as outputs various parameters related to the overall performance of the condenser 10 including, but not limited to, outlet flows, temperatures, pressures and chemical compositions of noncondensable gases, vapors, and condensate-cooling water mixtures from both condensing chambers 18, 20 assuming steady state operation of the condenser.

The computational model uses as inputs various parameters describing the precise geometry of the contact medium (also referred to as "packing" in FIGS. 12–28) used within the condenser. The computational model uses the precise geometry of the contact medium to set boundary conditions on the fundamental equations of physics, engineering and equilibrium thermodynamics mentioned above, as well as to define the geometric interface between liquid, vapor, and gas phases within the condenser. The exact geometric interface is required to quantify and calculate rates of heat, momentum, and mass transfer between the various phases (liquid and gas) in the condenser and is thus required to determine steady state profiles of parameters such as temperature, pressure and component concentration throughout the condenser.

Additionally, the computational model uses as inputs the flows, temperatures, pressures and chemical compositions of steam 11 and cooling water inlet streams 13, 15 to the condenser 10. Characterizing the inlet flows into the condenser provides initial values to the fundamental equations mentioned above. Overall mass, heat and component material balances are calculated around the condenser using the inputted inlet flows, temperatures, pressure and chemical compositions and outlet flows, temperatures, pressure and chemical compositions calculated by the computational model. From these overall material balances, more general performance parameters can be calculated such as overall thermal efficiency, power consumption, water consumption, and emissions of noncondensable gases.

The computational model may be advantageously employed to calculate the performance of a condenser assuming various contact medium 28, 29 configurations and inlet conditions. Thus, the computational model may be used iteratively with various hypothetical contact medium configurations and inlet conditions to arrive at a final condenser design which offers optimal performance.

Figure 10:
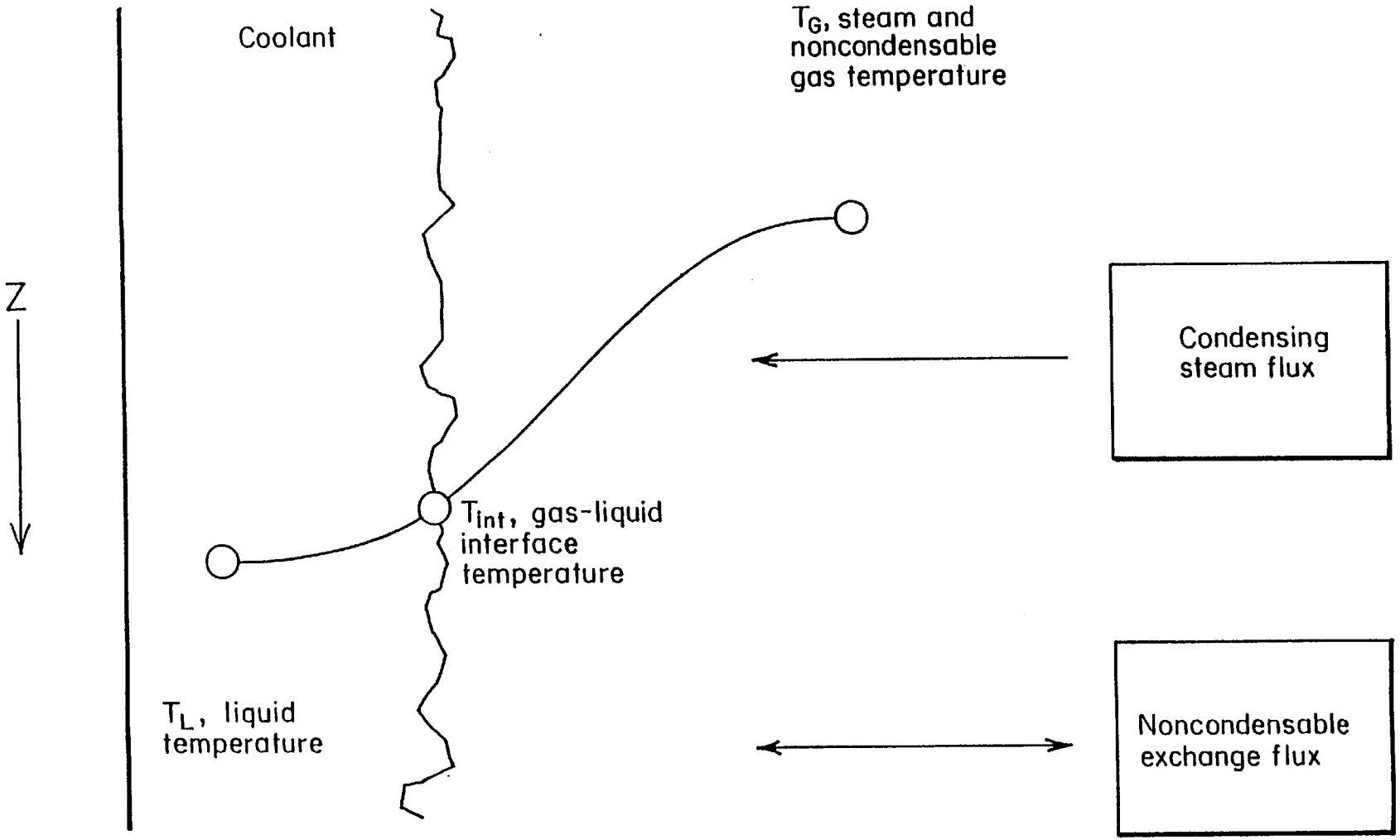
FIG. 10 illustrates the temperature distribution of the cooling liquid, gas stream, and gas-liquid interface, and the vapor and noncondensable gas mass fluxes during condensation.
Figure 11A:
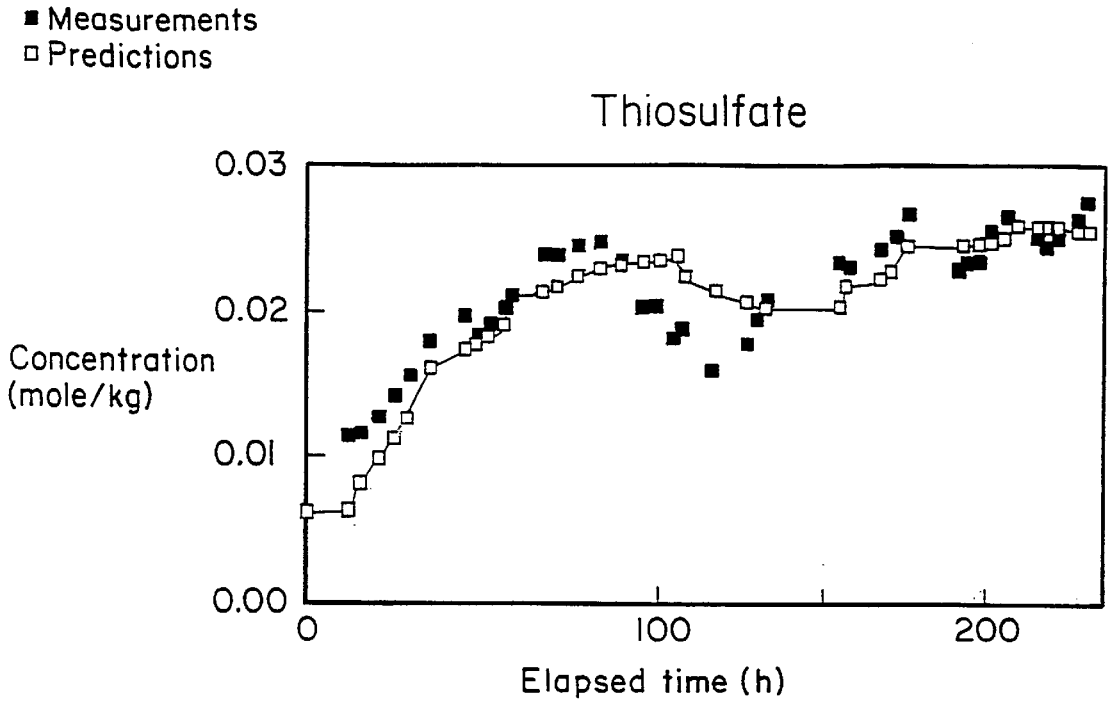
FIGS. 11 *a–d* provide a comparison of the actual and predicted concentrations of thiosulfate, sulfate, sulfite, and sulfur in the condenser circulating water.
Figure 11B:
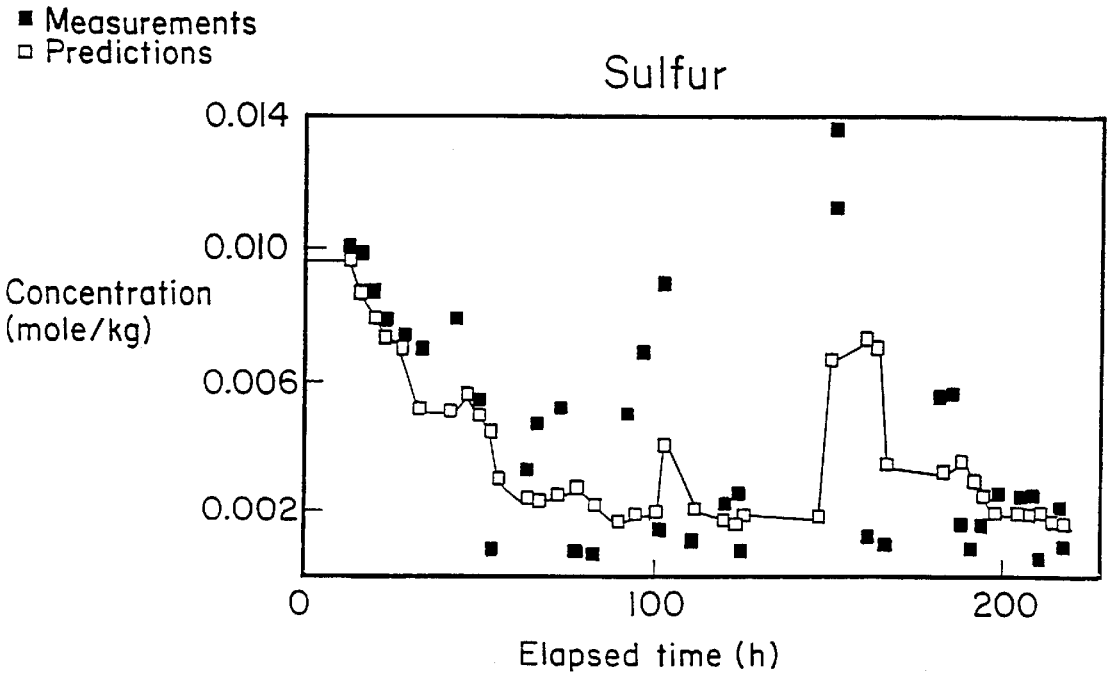
Figure 11C:
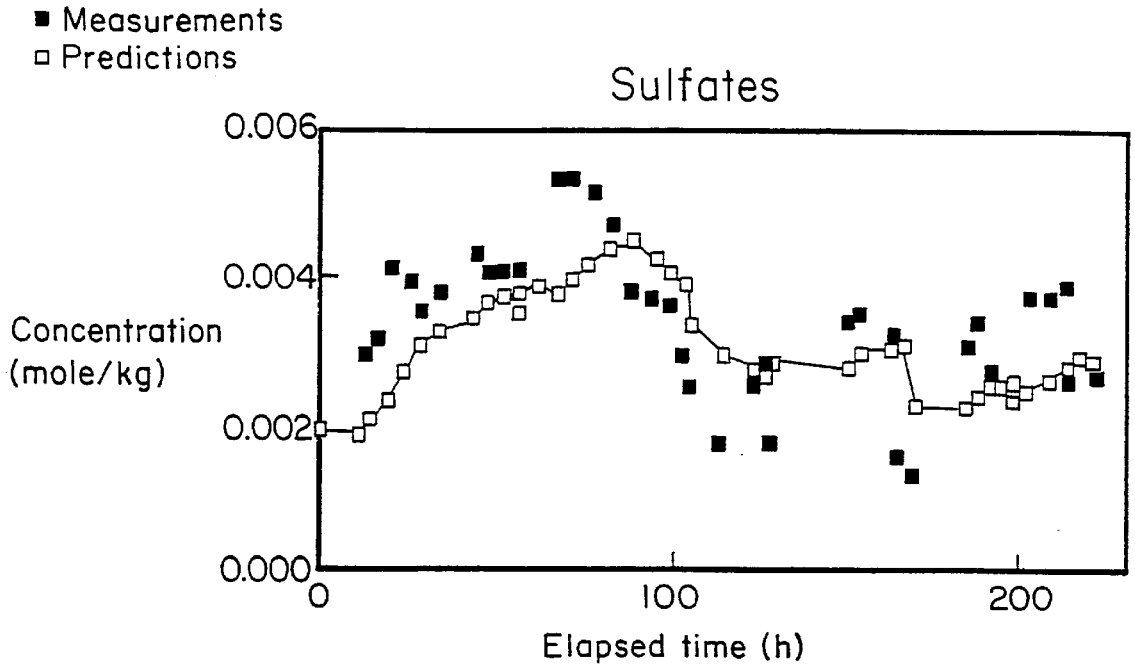
Figure 11D:
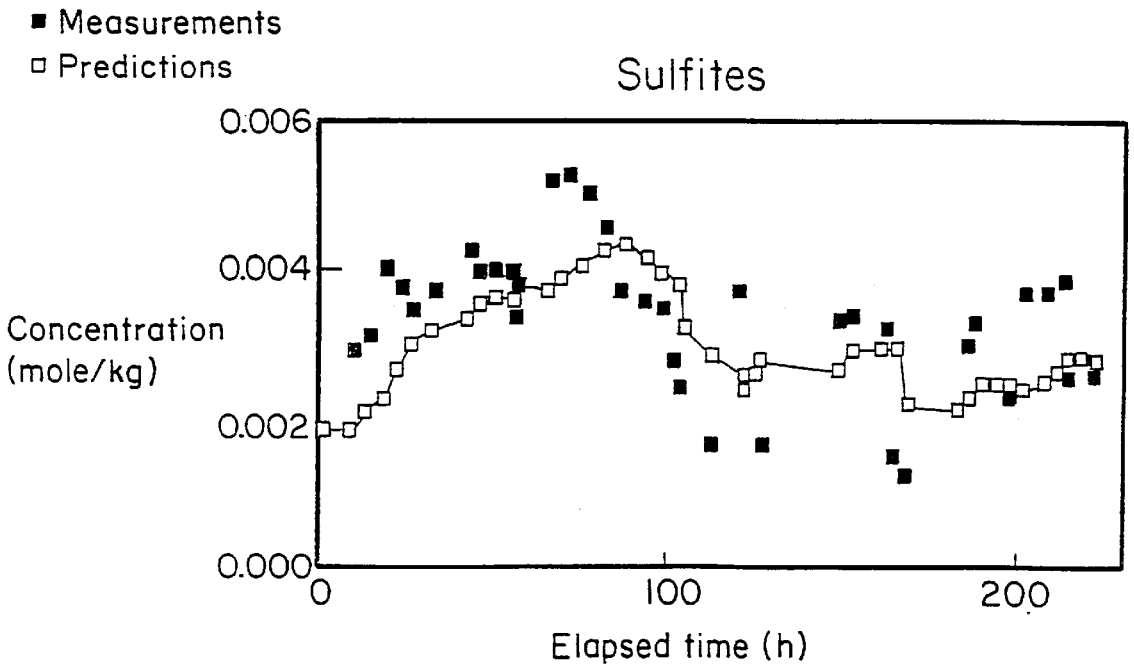

FIG. 10 illustrates the temperature distribution of the cooling liquid, gas stream, and gas-liquid interface, and the vapor and noncondensable gas mass fluxes during condensation. The mass and heat fluxes are calculated using, for example, the stagnant film theory and the Colburn-Hougen equation, as described in Example 1 herein. FIGS. 11*a–d* provide a comparison of the actual and predicted concentrations of sulfur compounds and elemental sulfur from an oxidation-simulation test using the computational model of the present invention.

Figure 12A:
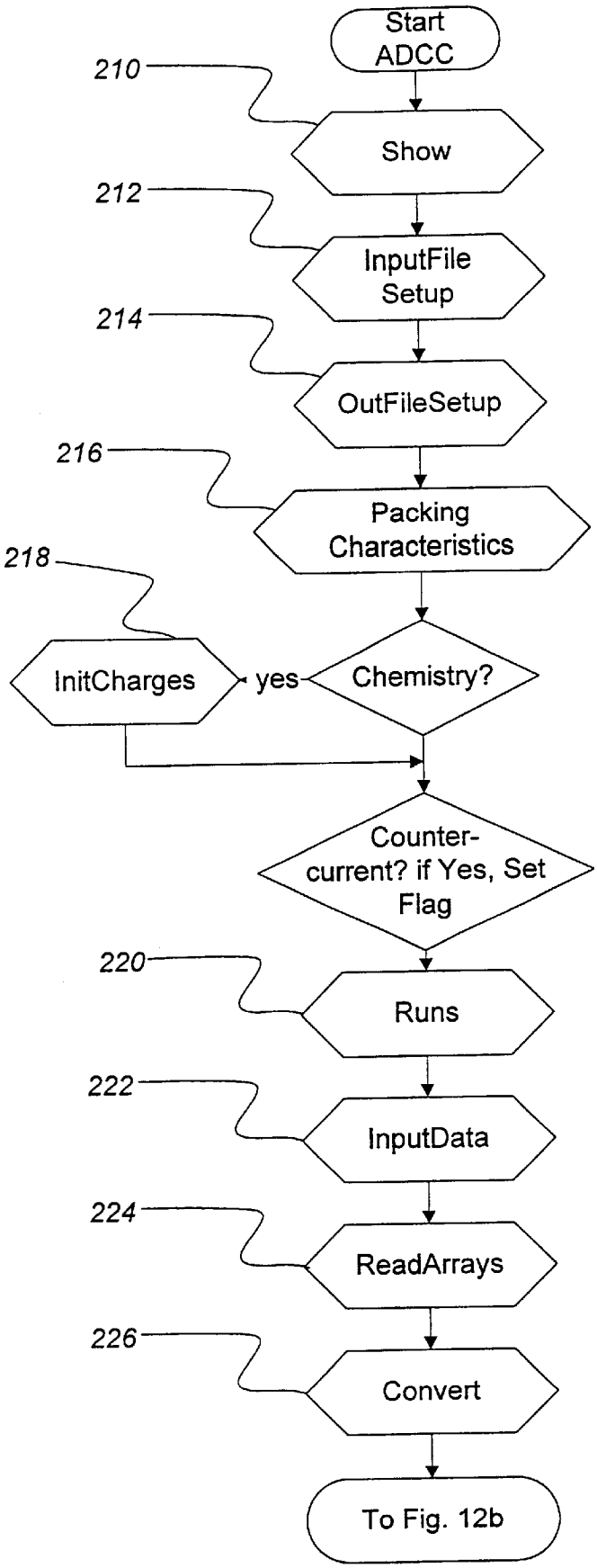
FIGS. 12*a–b* are a flow chart showing the steps executed by the main program of the simulator of the present invention.
Figure 12B:
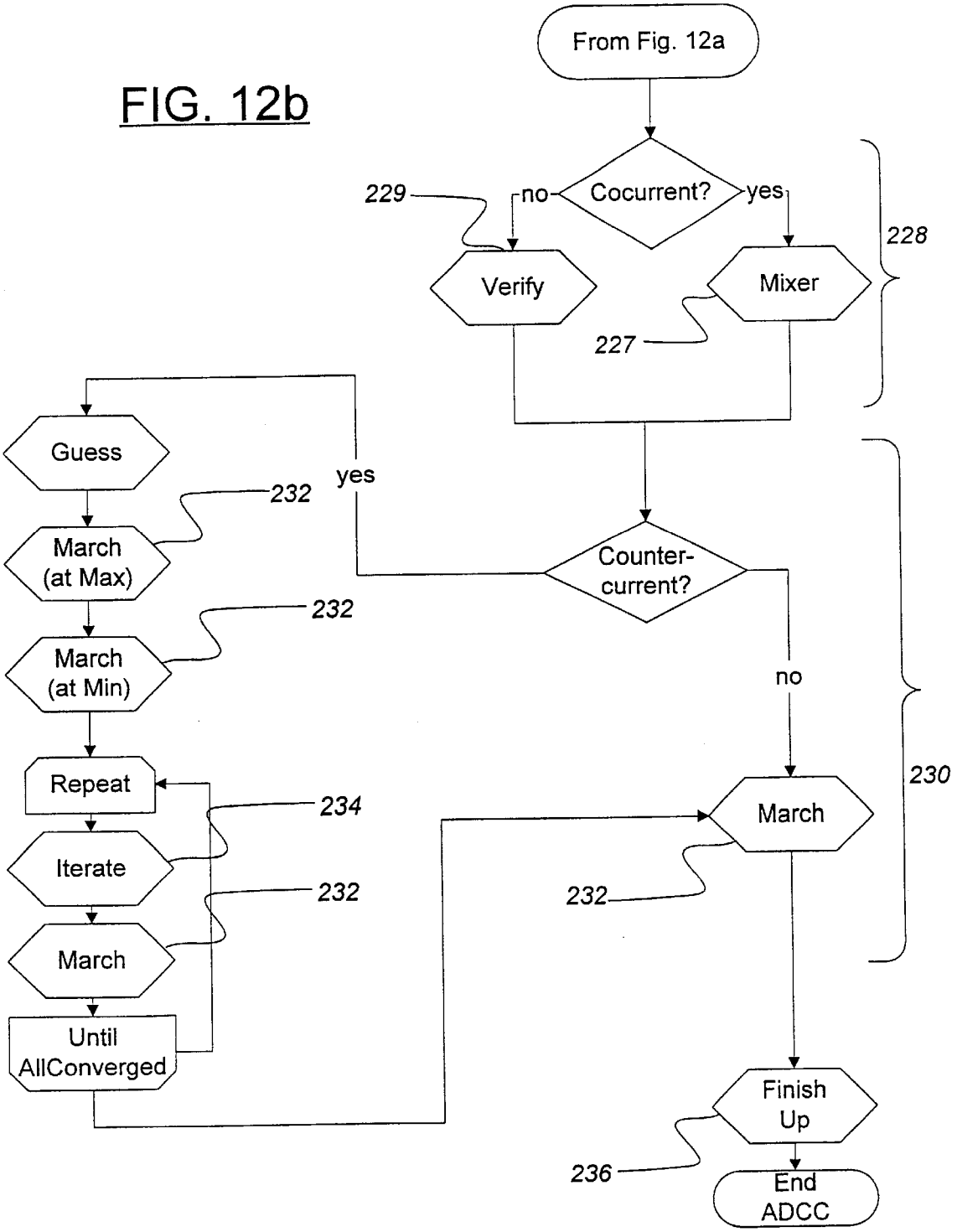
Figure 13:
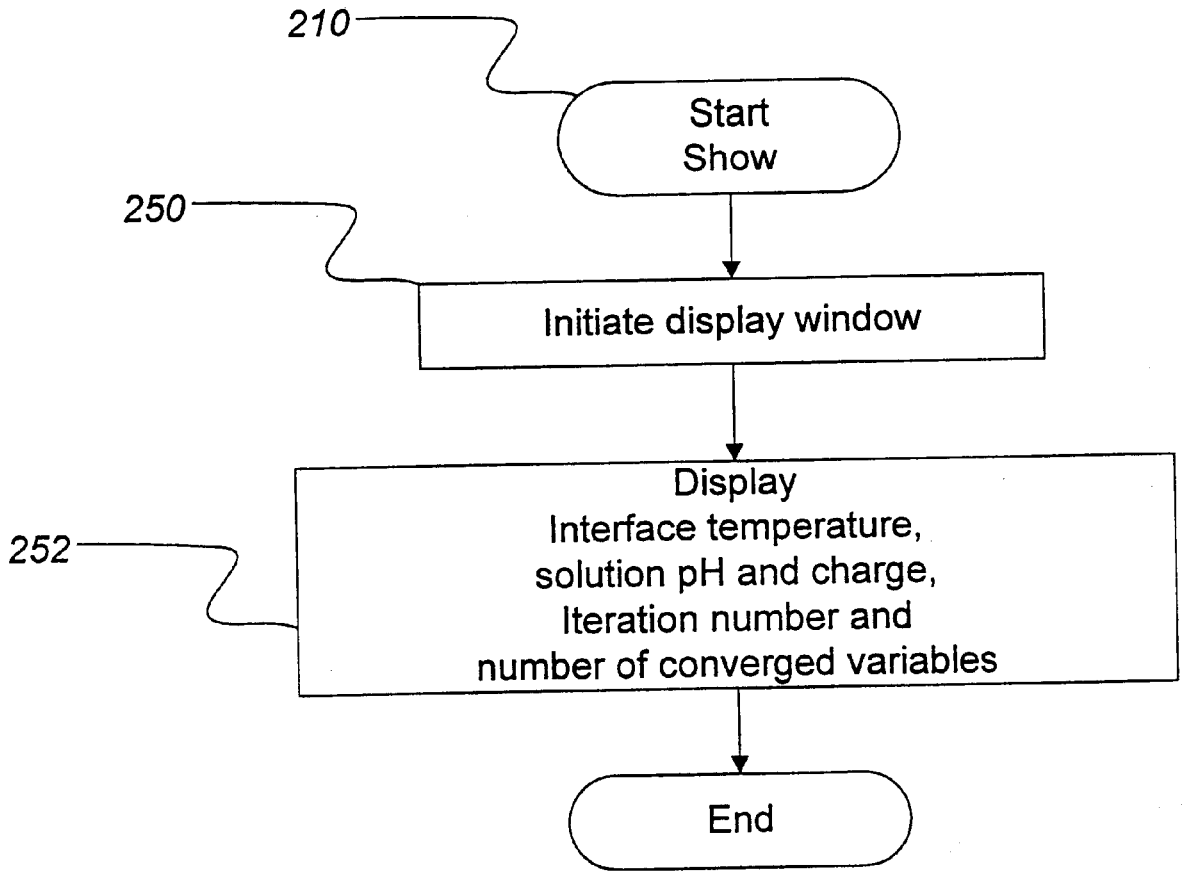
FIG. 13 is a flow chart showing the detailed steps of the Show procedure shown in FIGS. 12*a–b;*

FIGS. 12*a–b* present a master flow chart describing in the most general terms the flow of execution of the computational model. Successive flow charts presented in FIGS. 13–25 provide a high level description of the steps performed by specific procedures in the master flow chart. Further successive flow charts presented in FIGS. 26–28*a–c* provide additional high level description of the steps performed by the March procedure 232 in the master flow chart.

Referring now to FIGS. 12*a–b*, the specific steps performed by the simulator are as follows. Program execution begins with a Show procedure 210 (FIG. 13), which opens a window at step 250 for the purpose of creating a user interface with the computational model. Various physical parameters are displayed at step 252, including temperature at the liquid-gas interface, solution pH, and species concentrations at specific locations within the condenser. Other parameters related to the execution of the computational model itself are also displayed at step 252, such as iteration number and number of converged variables. Parameters related to the execution of this computational model, which requires an iterative approach to mathematically converge on the solution to many of the equations employed within the model, are well known to those skilled in the art of computational modeling.

Figure 14:
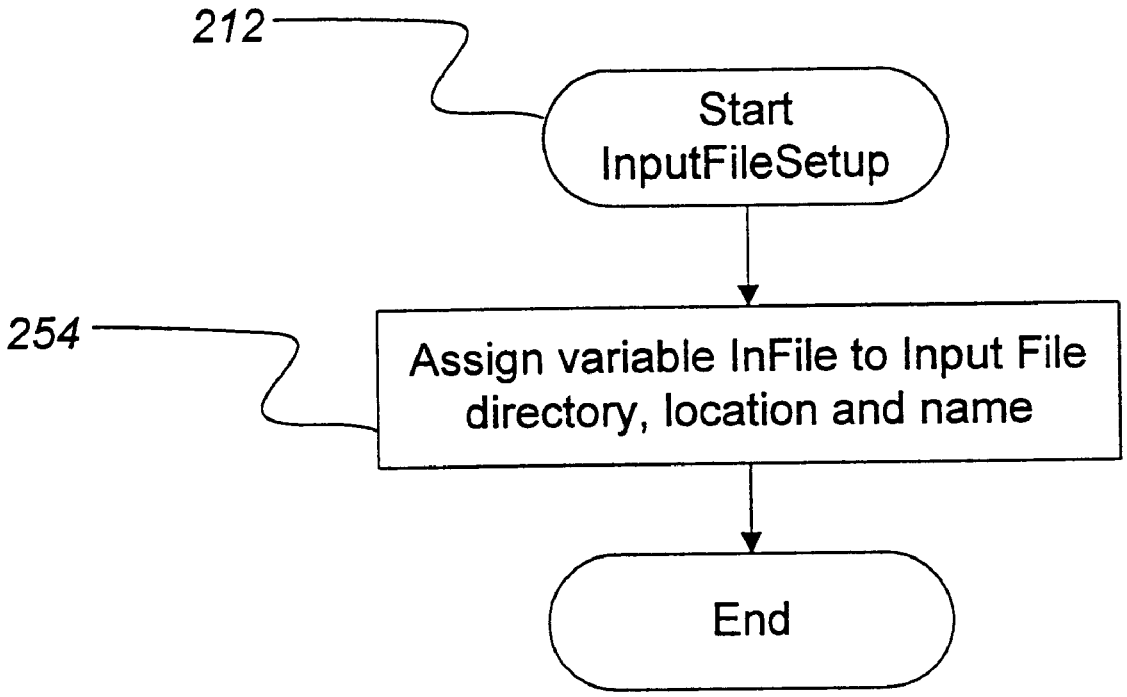
FIG. 14 is a flow chart showing the detailed steps of the InputFileSetup procedure shown in FIGS. 12*a–b;*
Figure 15:
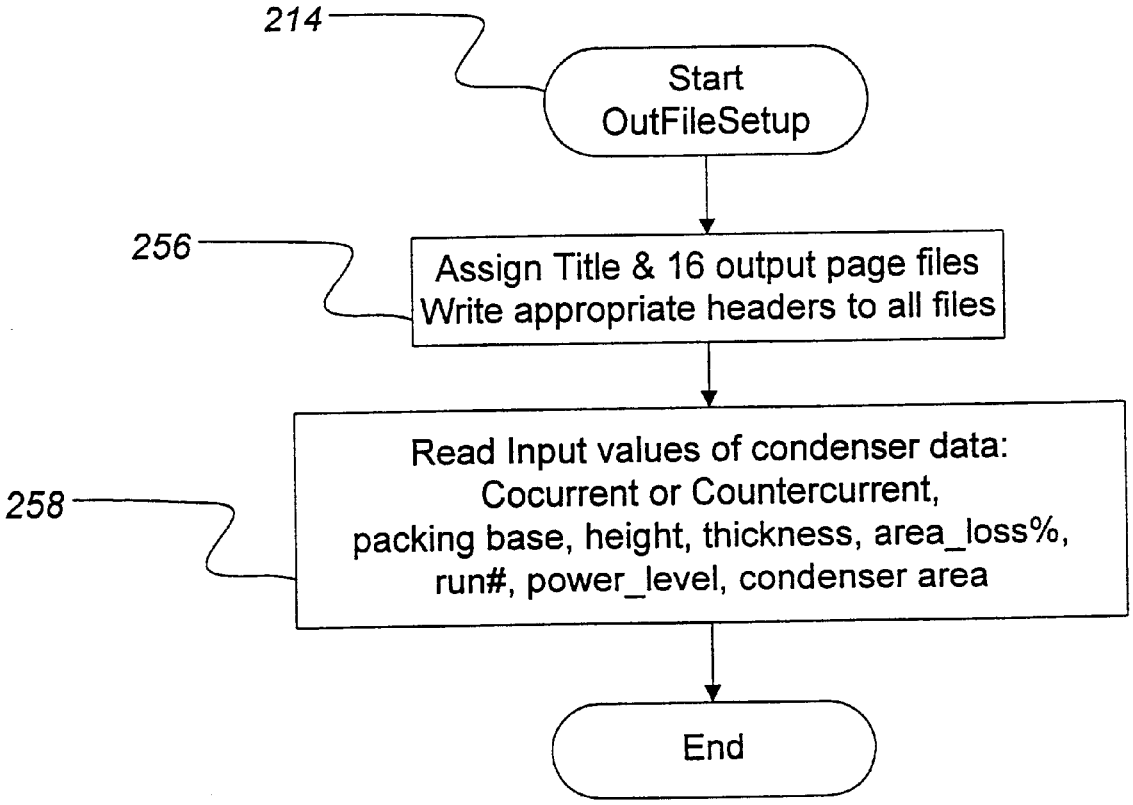
FIG. 15 is a flow chart showing the detailed steps of the OutFileSetup procedure shown in FIGS. 12*a–b;*
Figure 16:
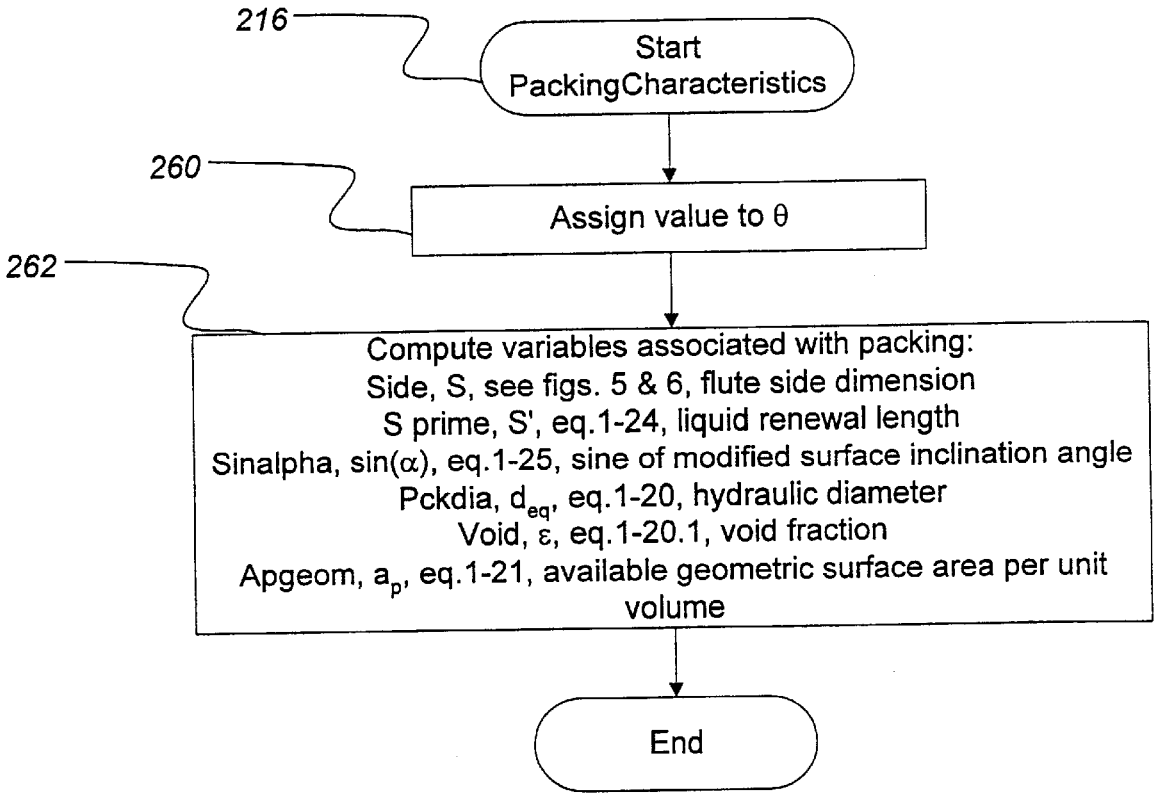
FIG. 16 is a flow chart showing the detailed steps of the PackingCharacteristics procedure shown in FIGS. 12*a–b;*
Figure 17:
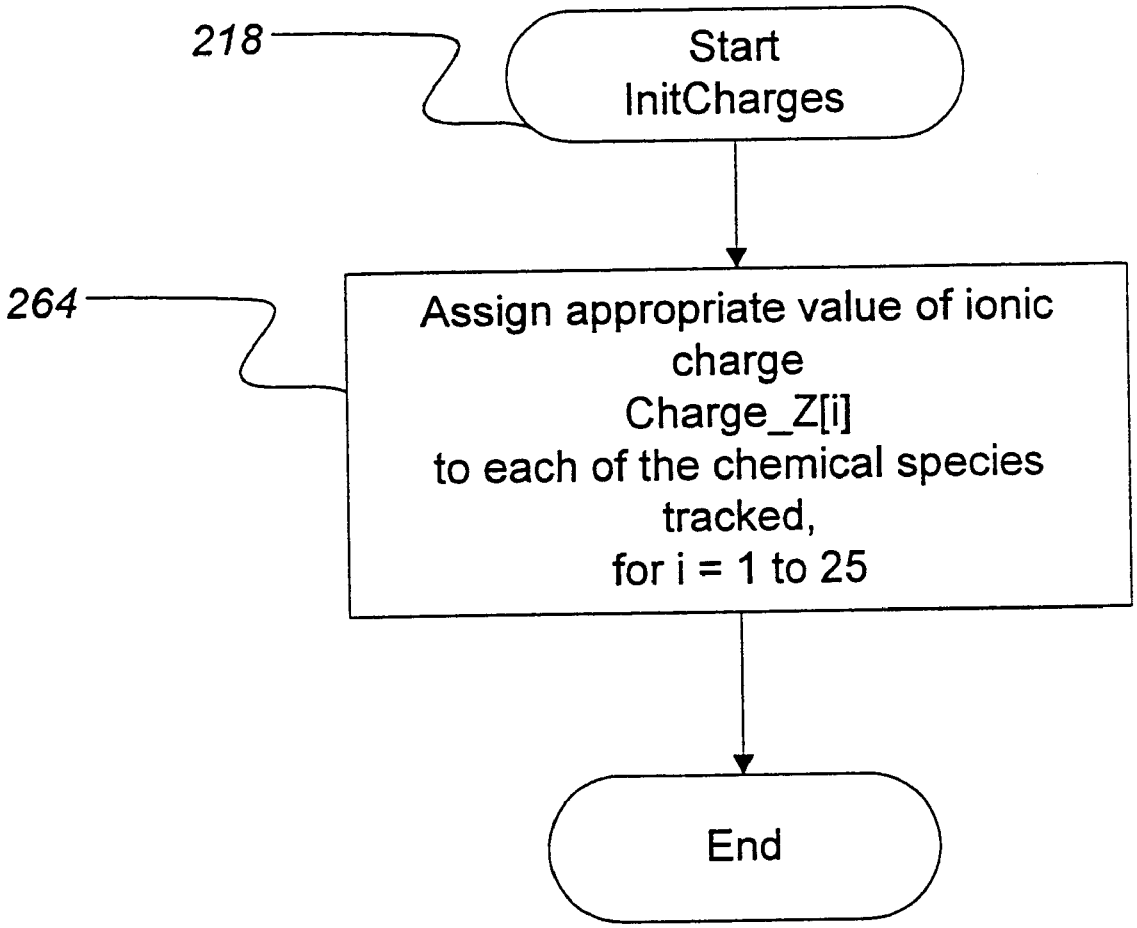
FIG. 17 is a flow chart showing the detailed steps of the InitCharges procedure shown in FIGS. 12*a–b;*
Figure 18:
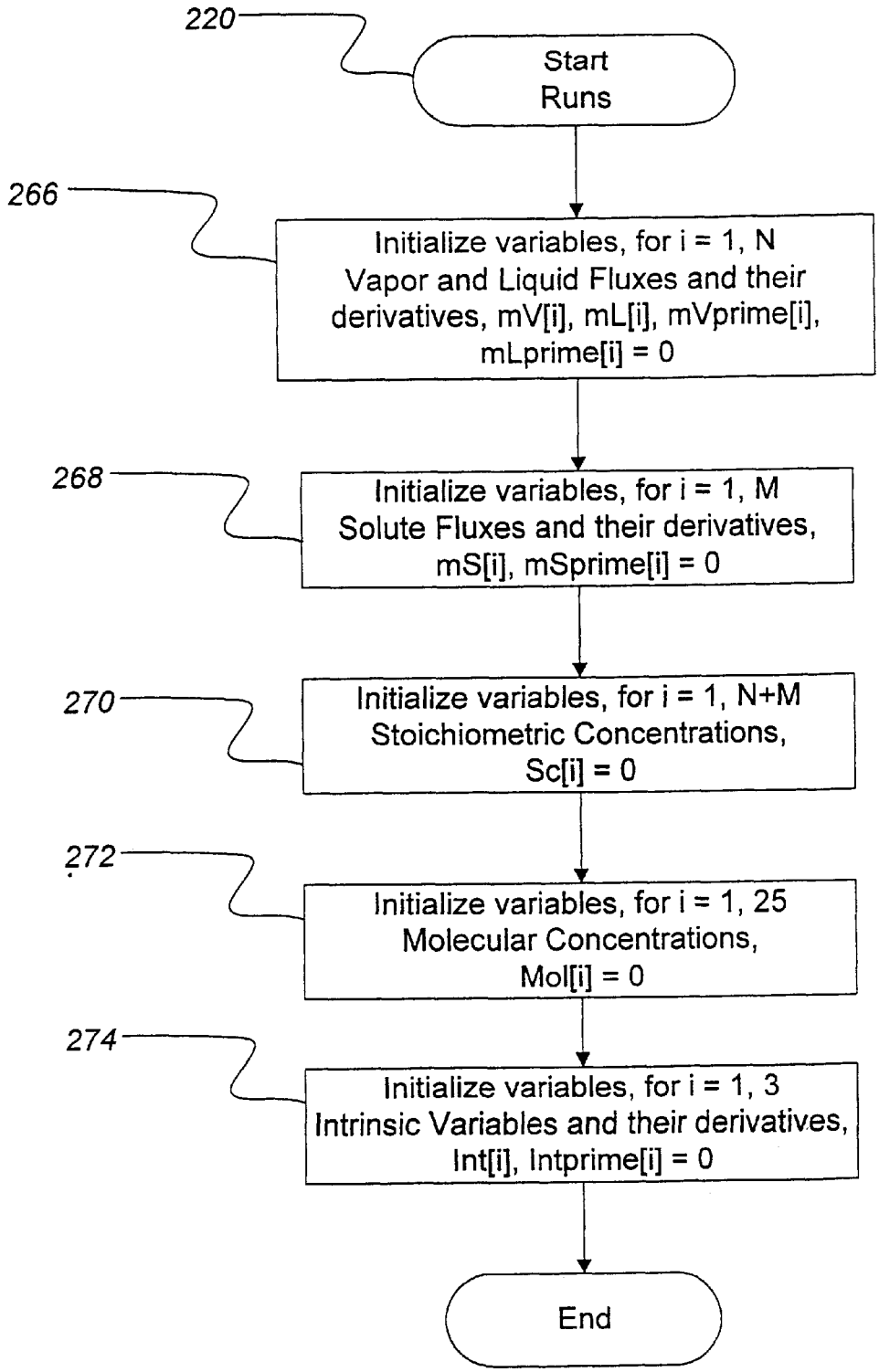
FIG. 18 is a flow chart showing the detailed steps of the Runs procedure shown in FIGS. 12*a–b;*
Figure 19:
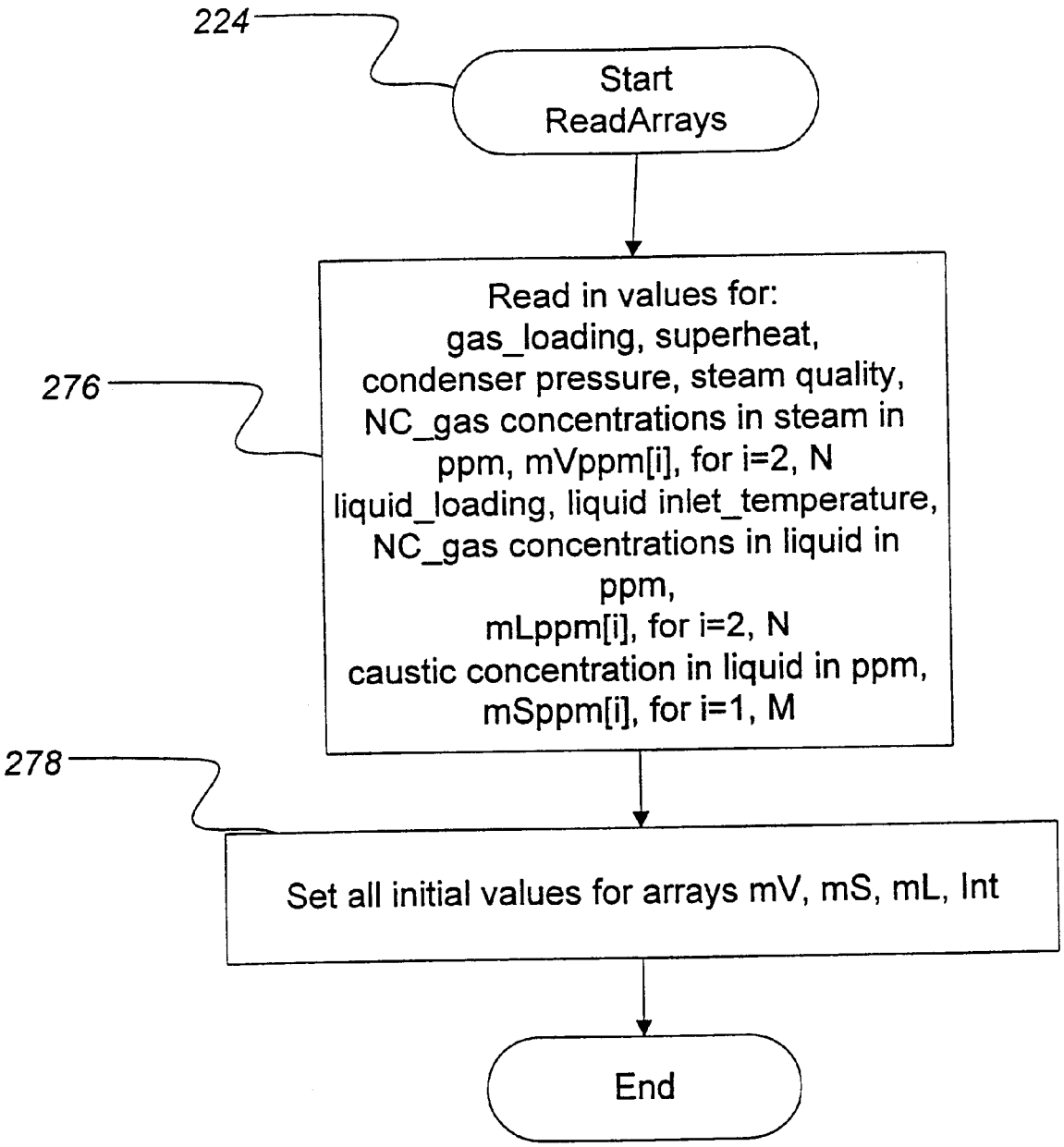
FIG. 19 is a flow chart showing the detailed steps of the ReadArrays procedure shown in FIGS. 12*a–b;*
Figure 20:
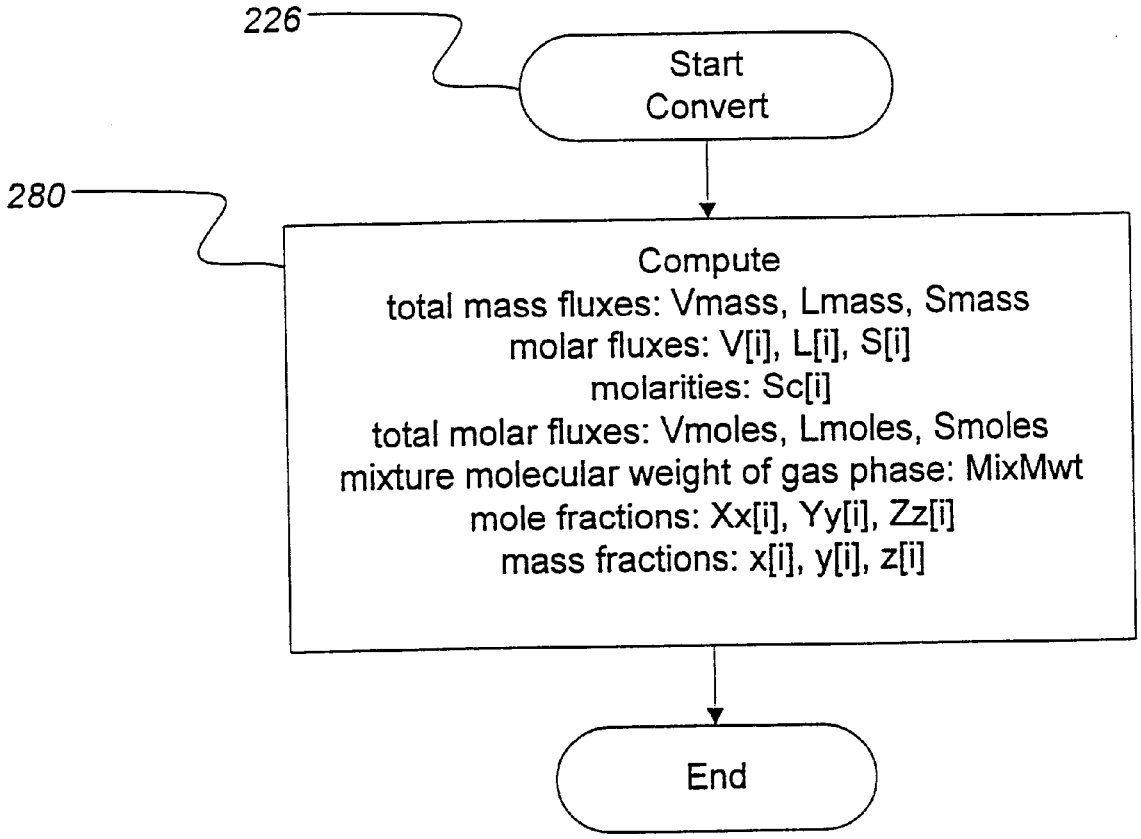
FIG. 20 is a flow chart showing the detailed steps of the Convert procedure shown in FIGS. 12*a–b;*

The Show procedure 210 has been initiated, execution continues with an InPutFileSetUp procedure 212 and an OutPutFileSetUp procedure 214 (FIGS. 14 and 15, respectively). In step 254 of procedure 212, the locations and names of various input files and input file directories containing various input data required by the computational model are specified. In step 256 of procedure 214, titles and headers are assigned to the various output files and output file directories which will contain the computed and calculated outputs. Since such setup and file management procedures are well-known to those skilled in the art of computer science and, in any event, are usually dependent on the particular hardware configuration being used, the precise details of these setup and management procedures 212, 214 will not be explained in further detail. The OutFileSetUp procedure 214 concludes at step 258 by reading various pieces of input data required by the computational model, such as contact medium height, width and depth, total condenser area, power level, contact medium area unavailable for condensation, sequential number identifying the specific upcoming model calculations, and whether the condenser is being operated in a downward or upward steam flow mode (referred to in the following discussion and accompanying figures as "cocurrent" and "countercurrent" operation, respectively).

Continuing with FIGS. 12*a–b*, the next step in the execution of the computational model is to input various parameters describing the precise geometry of the contact medium 28, 29. The PackingCharacteristics procedure 216 (FIG. 16) includes step 260, wherein the inclination angle θ is assigned, and step 262, wherein a variety of parameters are computed. Such parameters include the side dimensions, liquid renewal lengths, sine of the modified inclination angle, hydraulic diameter, void fraction, and available geometric surface area available per unit volume of contact medium.

Execution of the computational model continues by asking the user whether solution chemistry and the concentrations of soluble components in the liquid and gas phases are to be considered. If yes, then an InitCharges procedure 218 (FIG. 17) is used to specify the ionic charges associated with each of the chemical species to be tracked and considered within the computational model. In step 264 of procedure 218, each chemical species is given an identifying number from 1 to 25, and the ionic charge associated with that species is stored in that corresponding element of the array Charge_Z. Ionic charges of each chemical species can be found in the engineering and physics literature, for example, in the *Handbook of Chemistry and Physics* (Robert C. Weast, ed.), The Chemical Rubber Co., Cleveland, Ohio. If solution chemistry and the concentrations of soluble component in the liquid and gas phases are not to be considered, the elements of the array Charg_Z are left with their default values of zero.

Execution of the computational model continues with several procedures (Runs 220, InPutData 222, ReadArrays 224 and Convert 226, FIGS. 18–20), designed to complete the task of imputing data and specifying initial conditions required by the computational model. In addition, all vapor fluxes, liquid fluxes, solute fluxes and intrinsic variables and their respective derivatives with respect to position within the condenser are set to zero (steps 266, 268, and 274). Stoichiometric and molecular concentrations of all chemical species are also set equal to zero (steps 270 and 272). Thermodynamic properties of the incoming steam and cooling liquid as well as the concentrations of each noncondensable gas in the incoming steam and liquid steams are specified (step 276). As is well known to those skilled in the art of computational modeling, providing initial values to these variables is required before calculations can begin (step 278). Finally, the procedures convert the data from commonly used engineering units such as parts per million and grams per liter to more fundamental and nondimensional units such as mass and mole fractions (step 280).

Figure 21A:
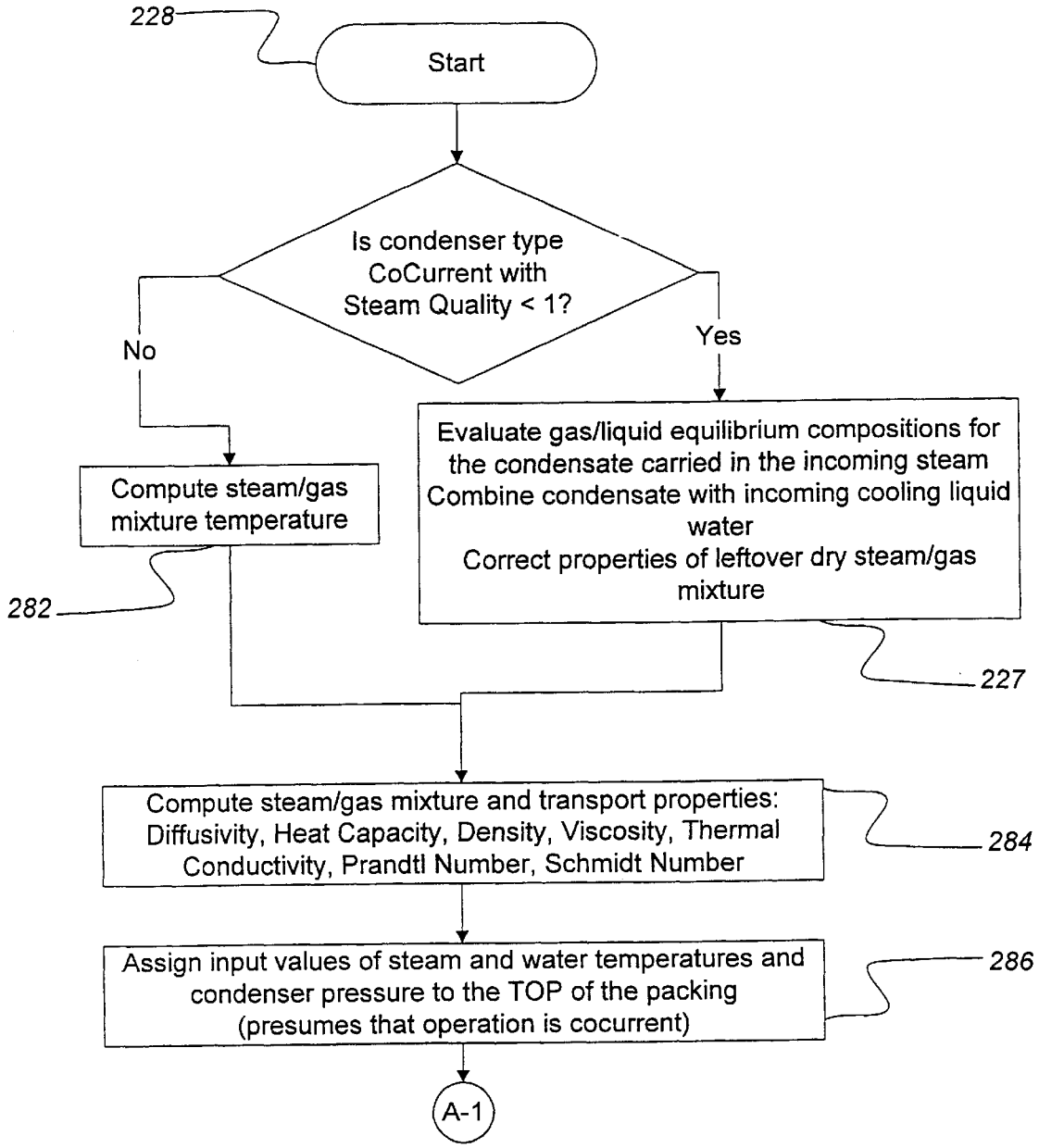
FIG. 21 (*a*) is a flow chart showing the detailed steps of the Mixer and Verify procedures shown in FIGS. 12*a–b;*
Figure 21B:
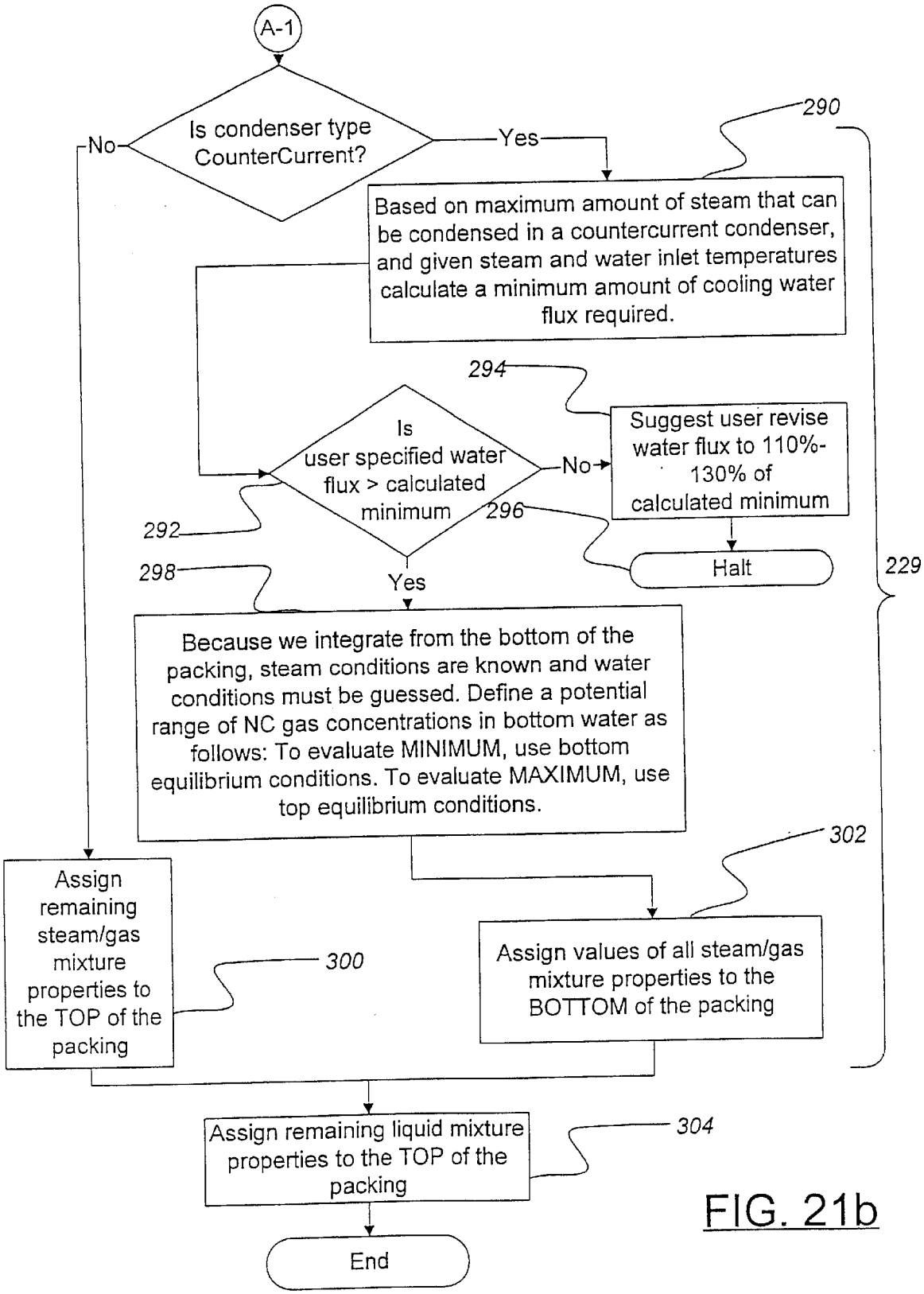
Figure 22A:
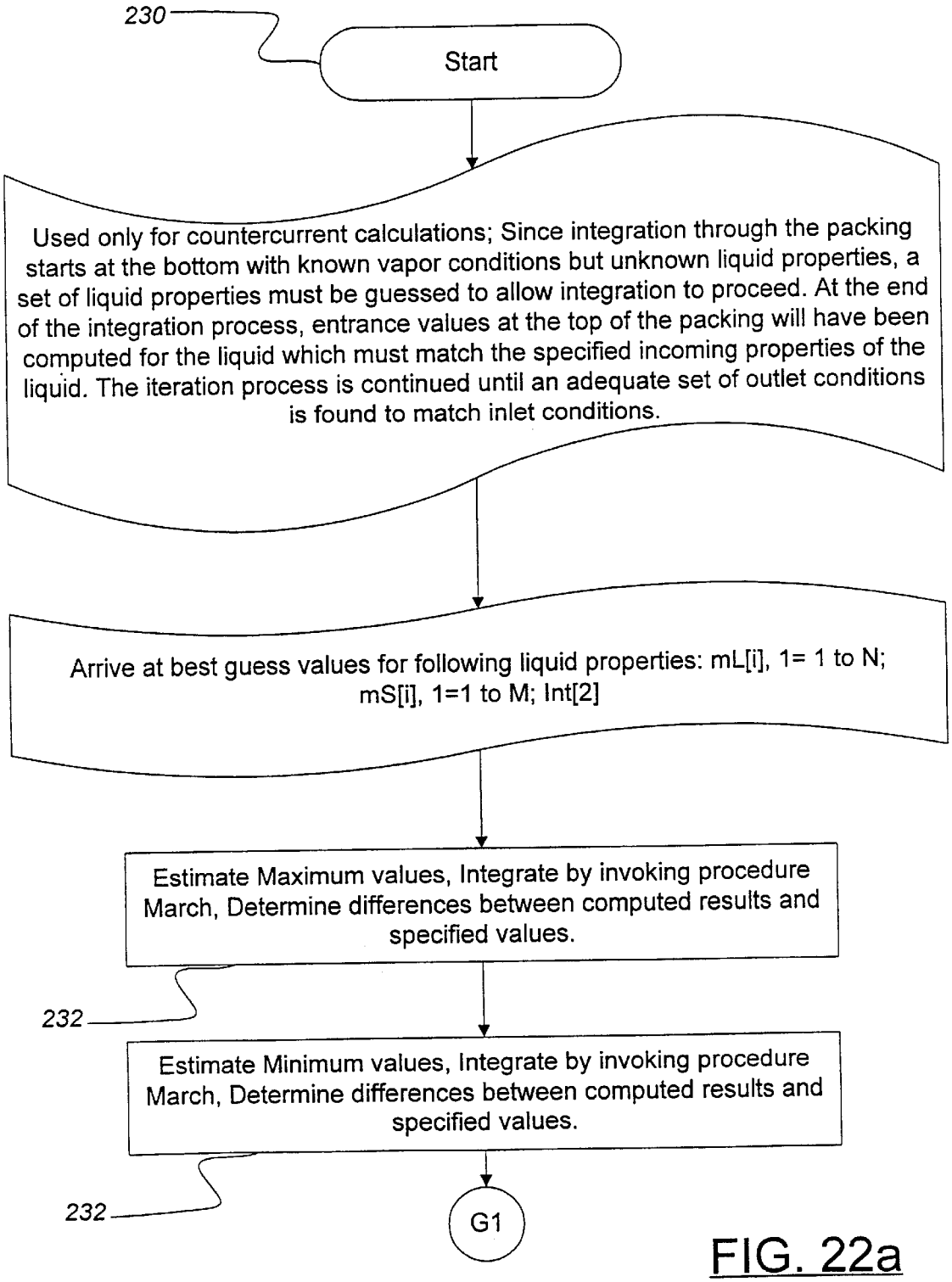
FIG. 22(*a*) is a flow chart showing the detailed steps of the Guess and March procedures shown in FIGS. 12*a–b;*
Figure 22B:
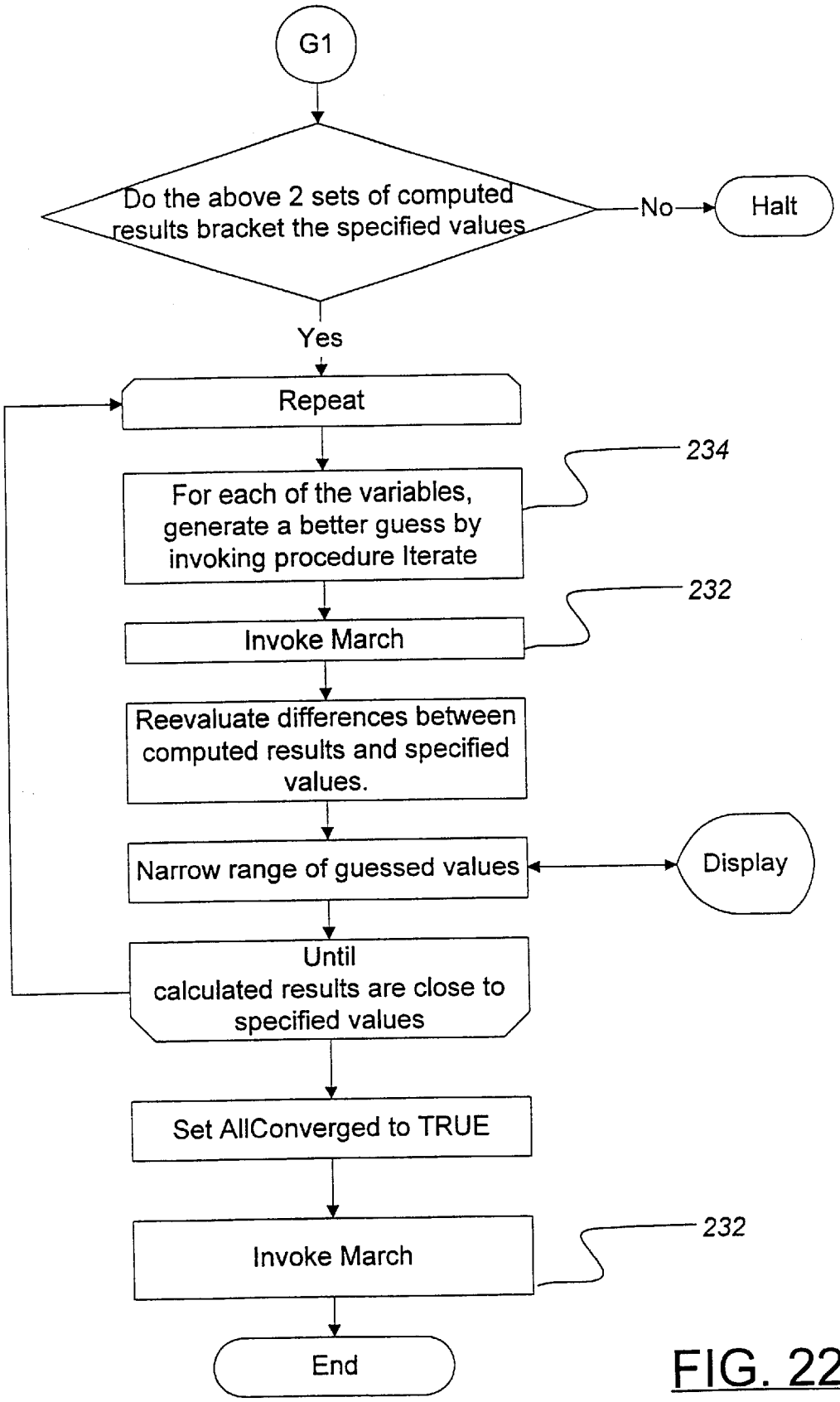
Figure 23A:
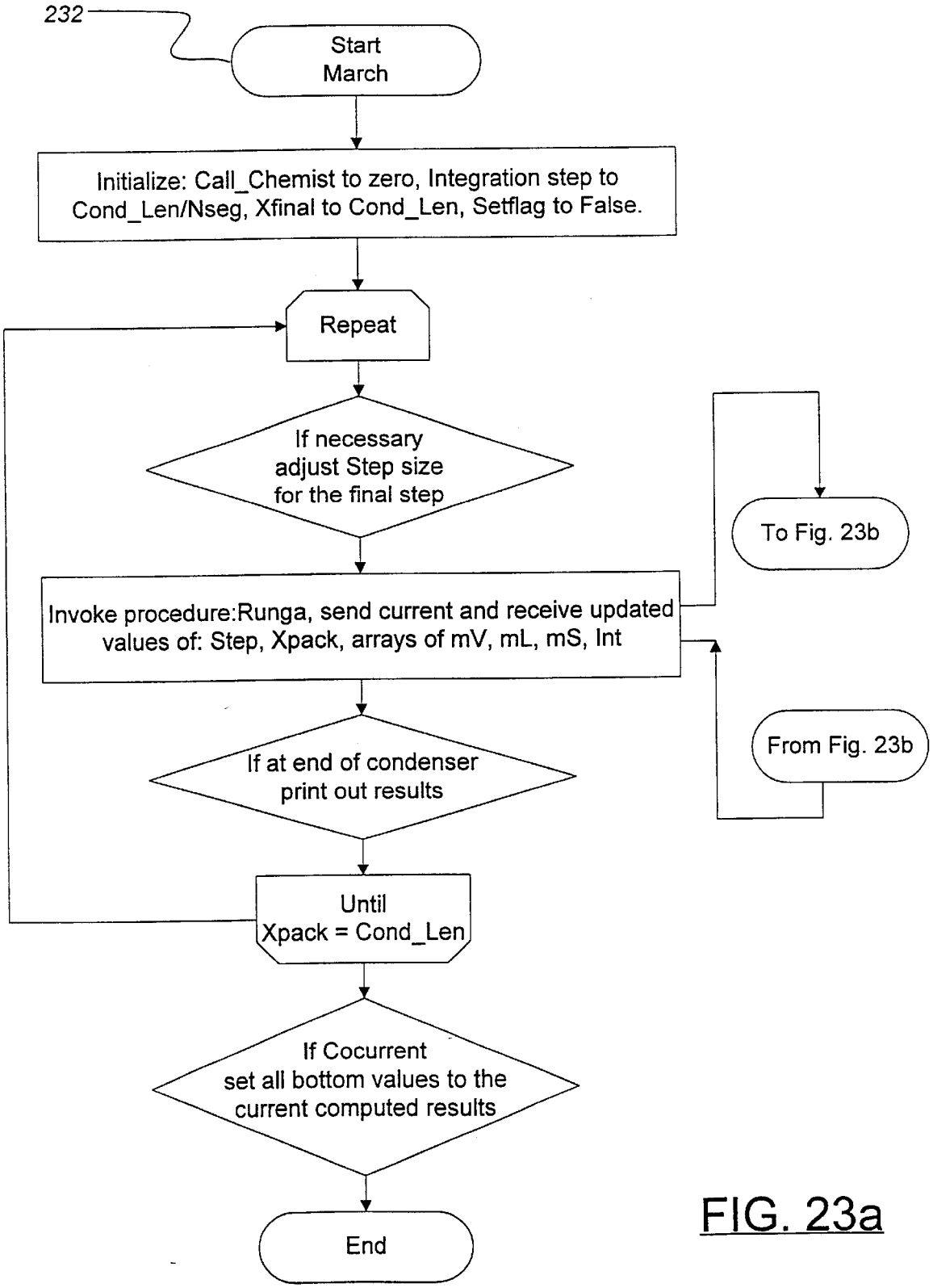
FIGS. 23*a–b* are flow charts showing the detailed steps of the March procedure shown in FIGS. 12*a–b;*
Figure 23B:
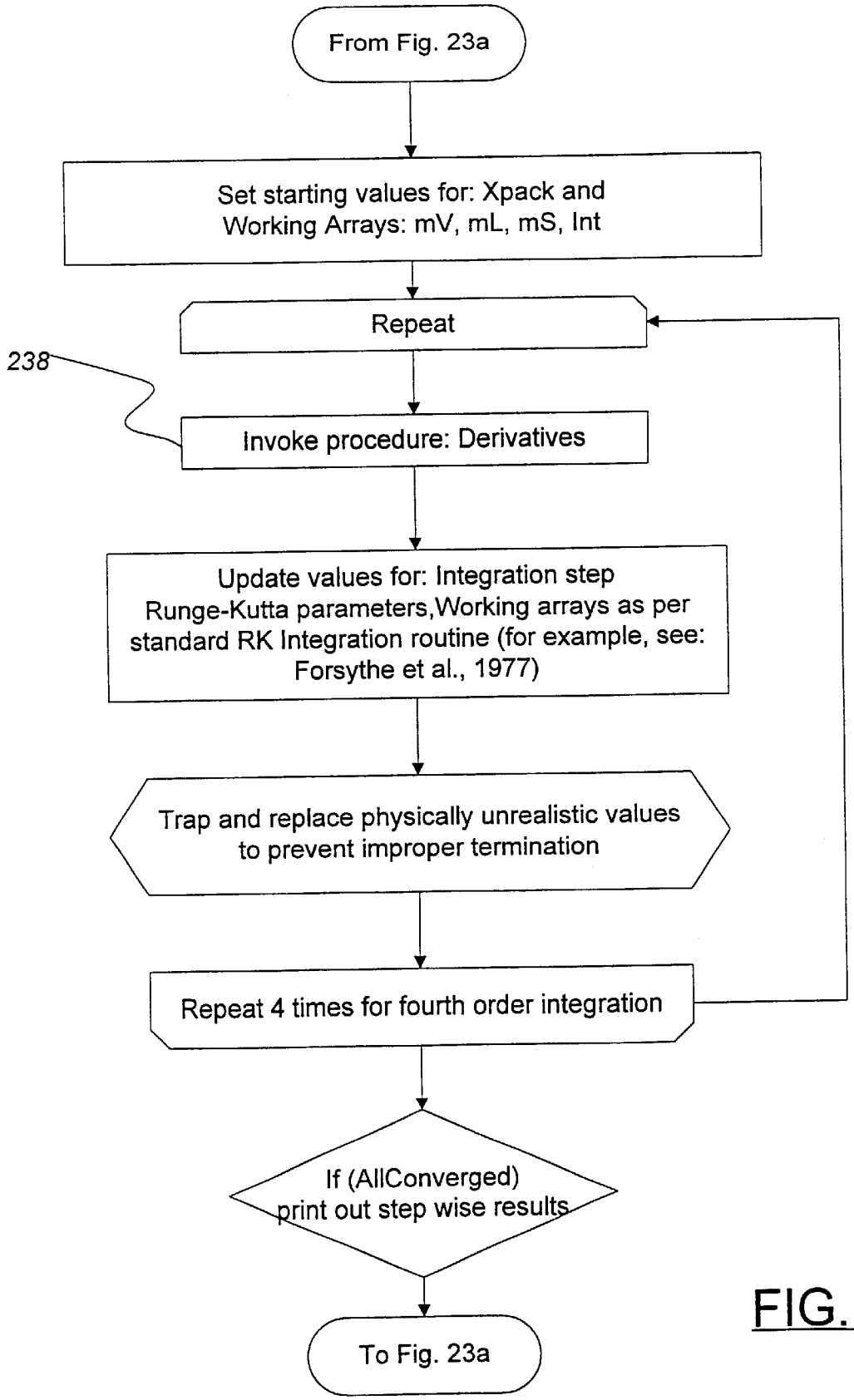
Figure 24:
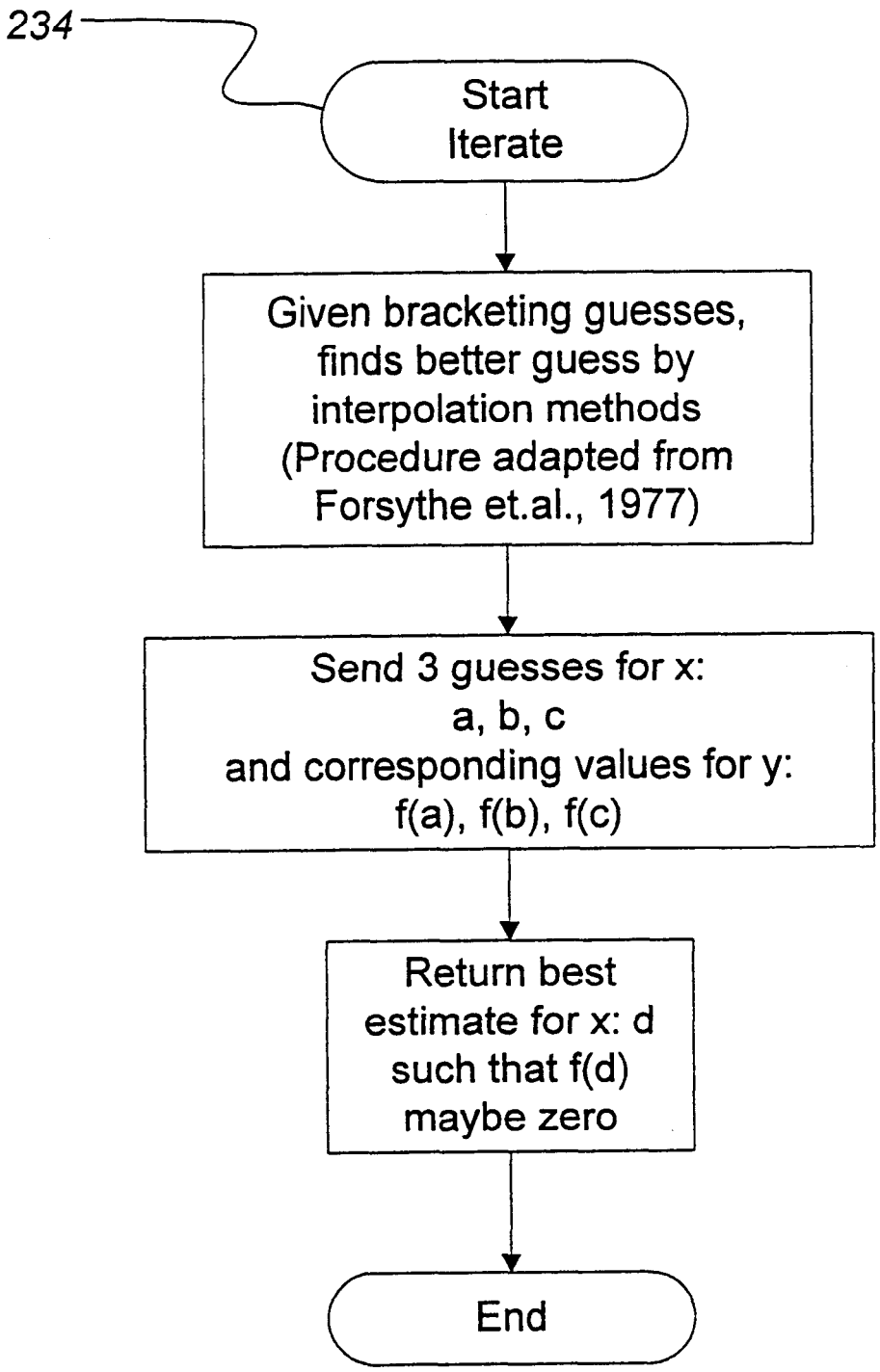
FIG. 24 is a flow chart showing the detailed steps of the Iterate procedure shown in FIGS. 12*a–b;*
Figure 25:
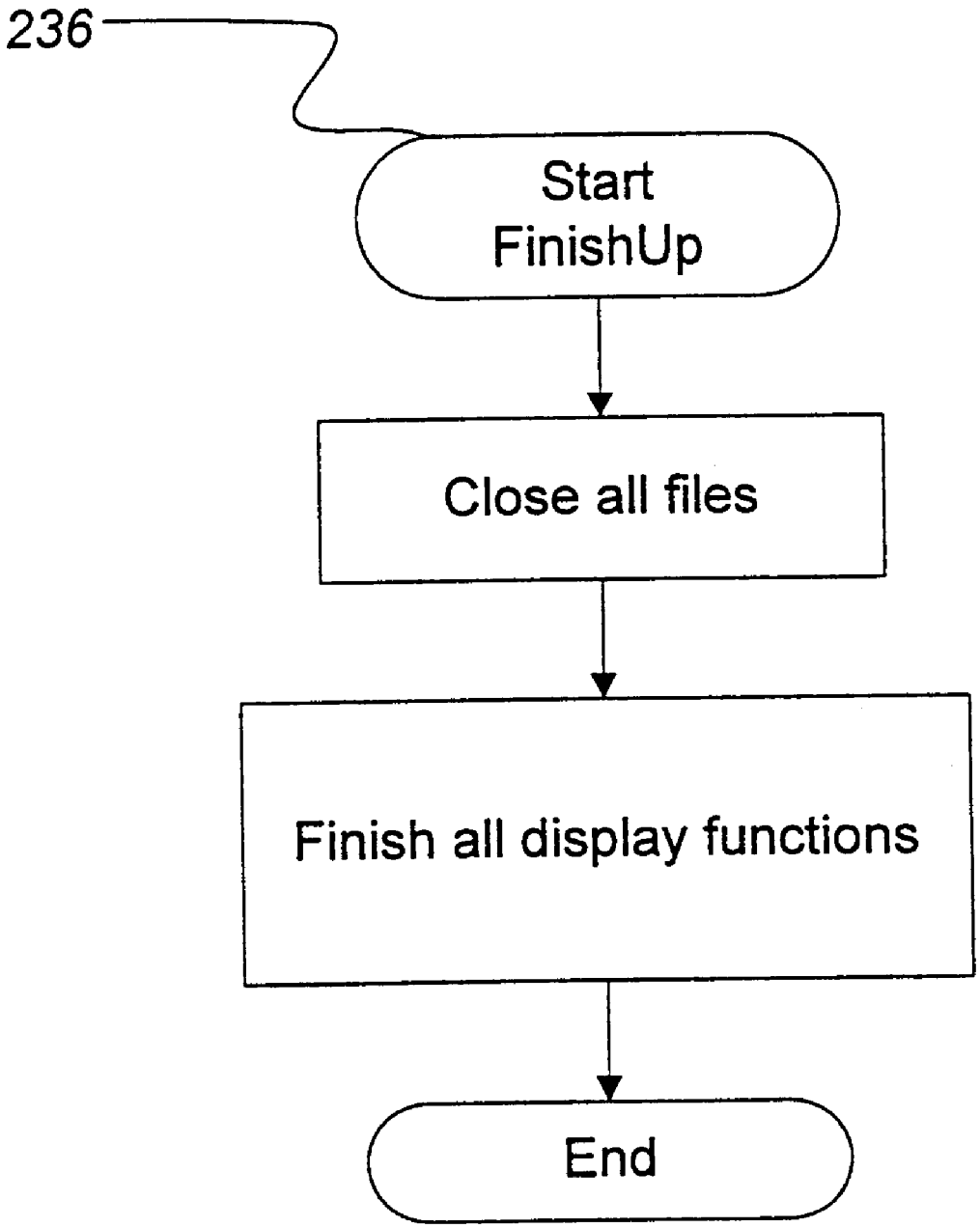
FIG. 25 is a flow chart showing the detailed steps of the FinishUp procedure shown in FIGS. 12*a–b;*
Figure 26A:
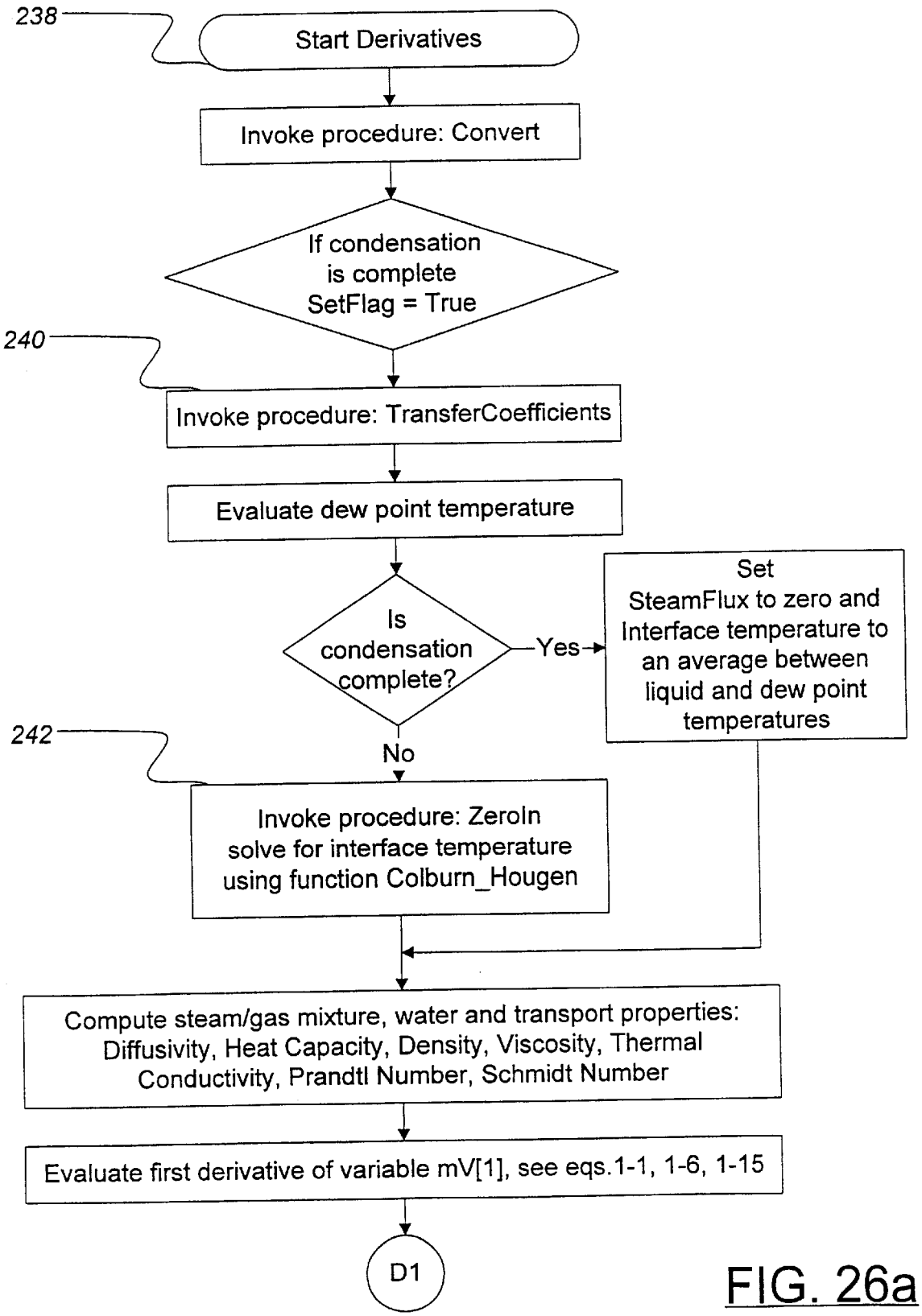
FIG. 26(*a*) is a flow chart showing the detailed steps of the Derivatives procedure shown in FIGS. 23*a–b;*
FIG. 26*b–c* are a continuation of FIG. 26(*a*)
Figure 26B:
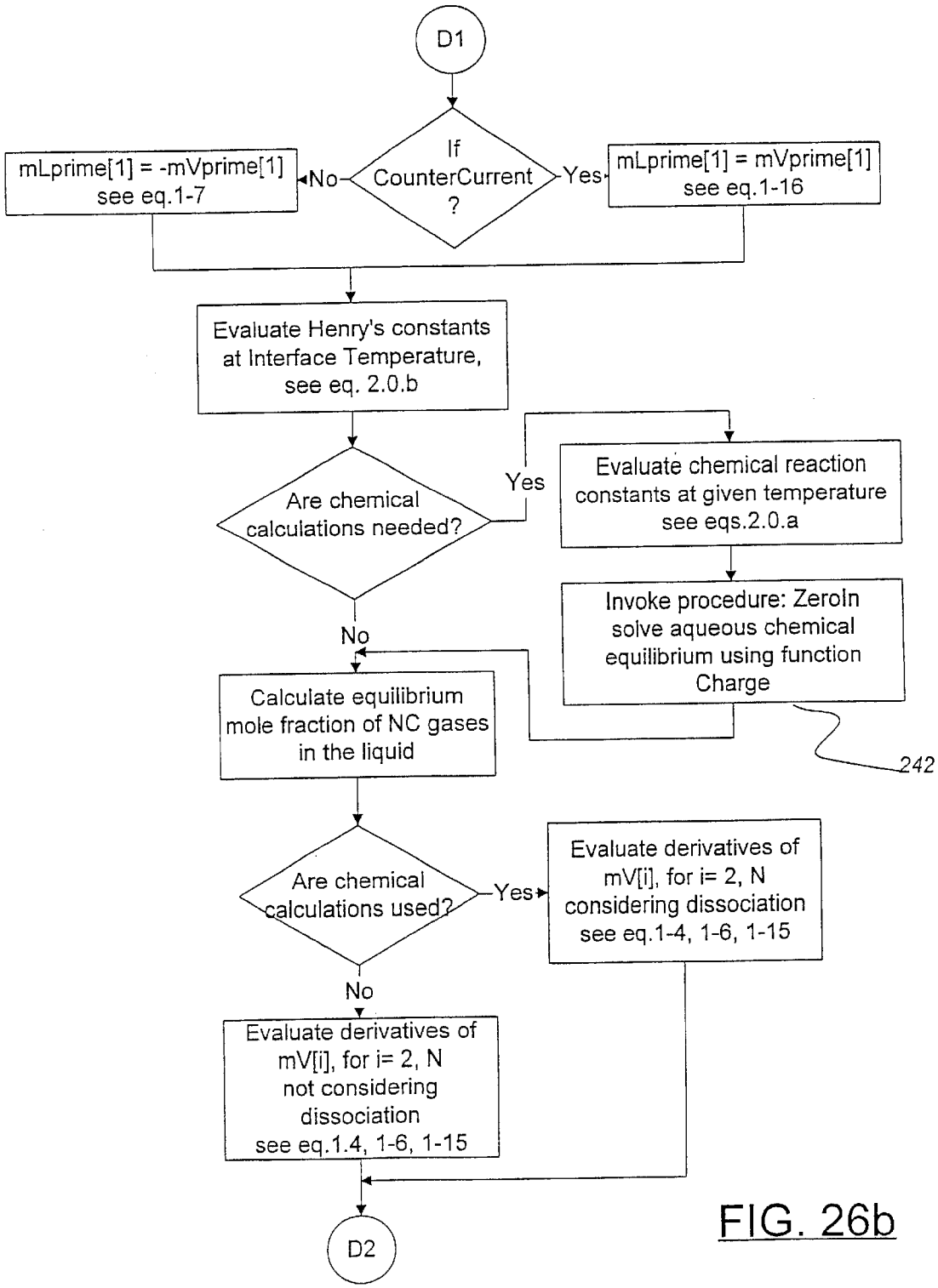
Figure 26C:
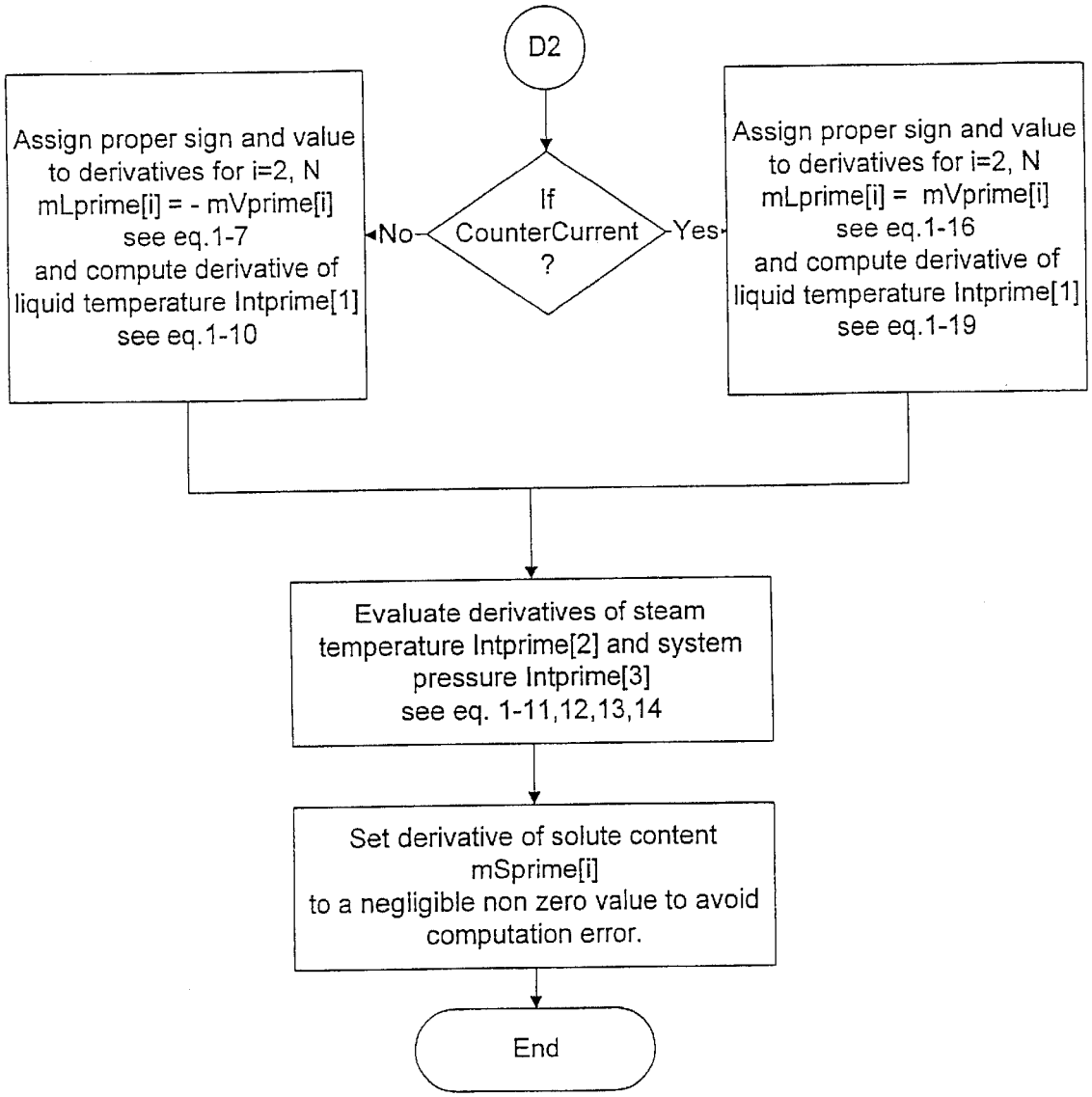
Figure 27:
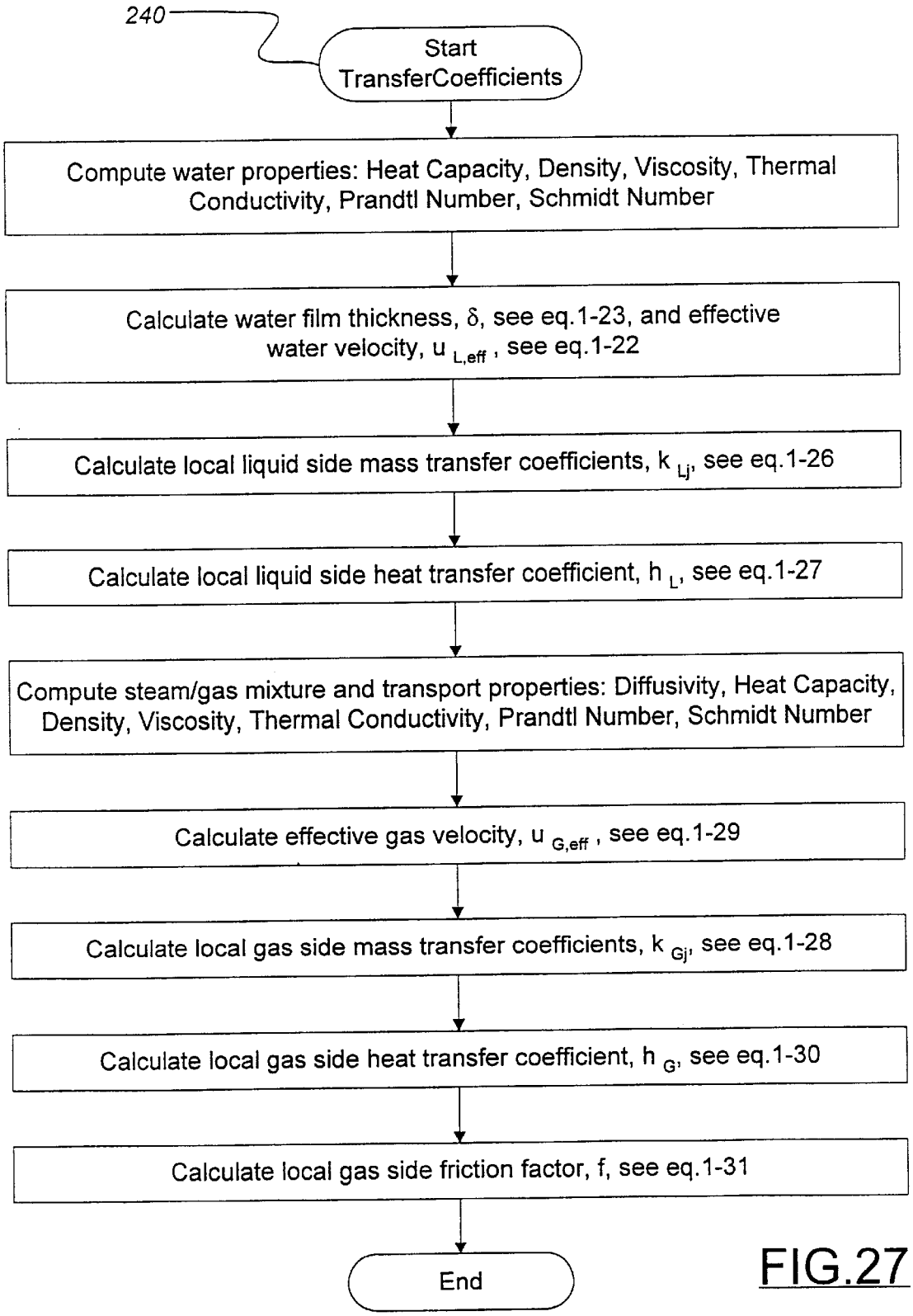
FIG. 27 is a flow chart showing the detailed steps of the TransferCoefficients procedure shown in FIG. 26*a*.
Figure 28A:
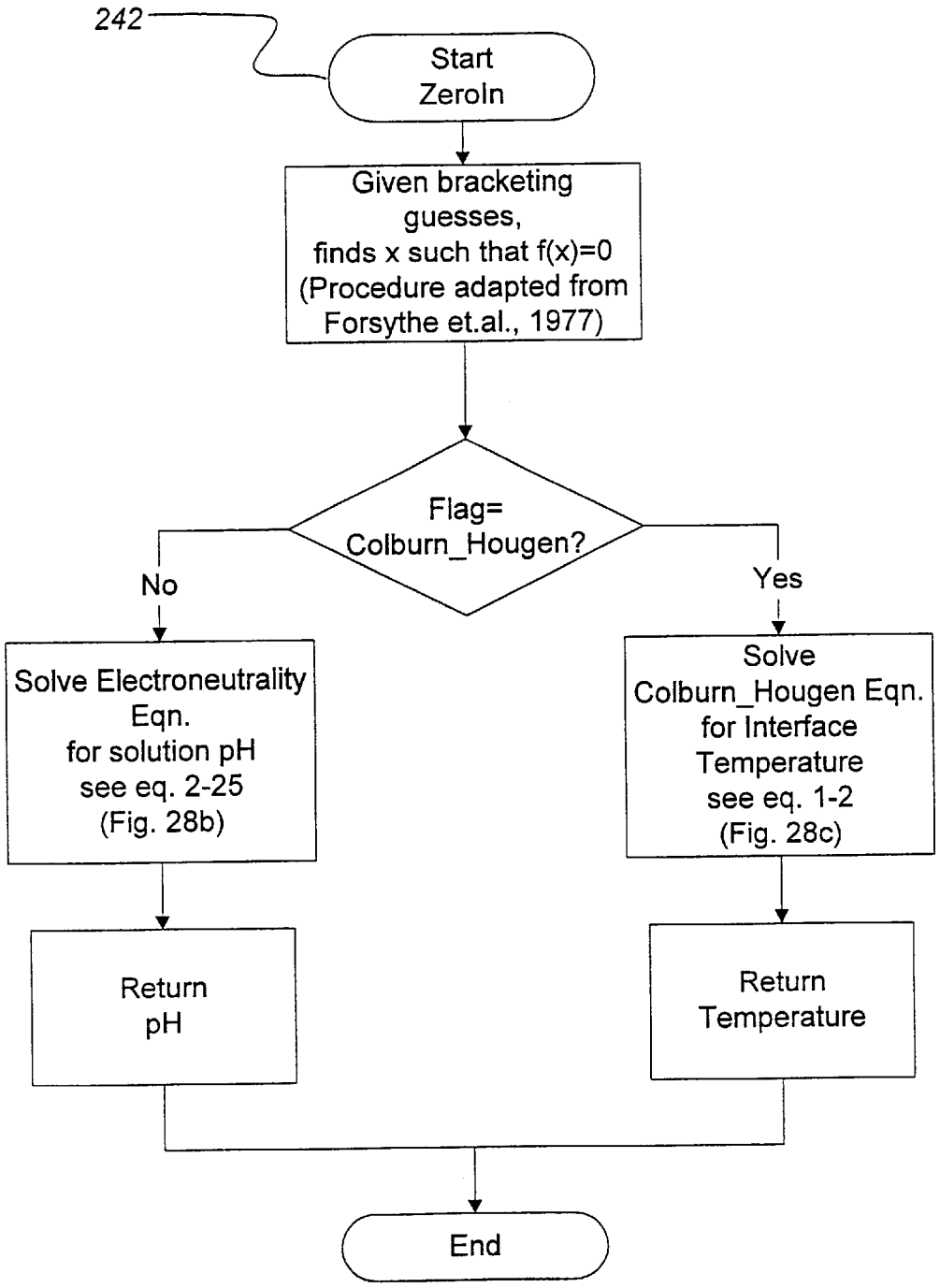
FIGS. 28*a–c* are flow charts showing the detailed steps of the Zeroin procedure shown in FIG. 26(*a*).
Figure 28B:
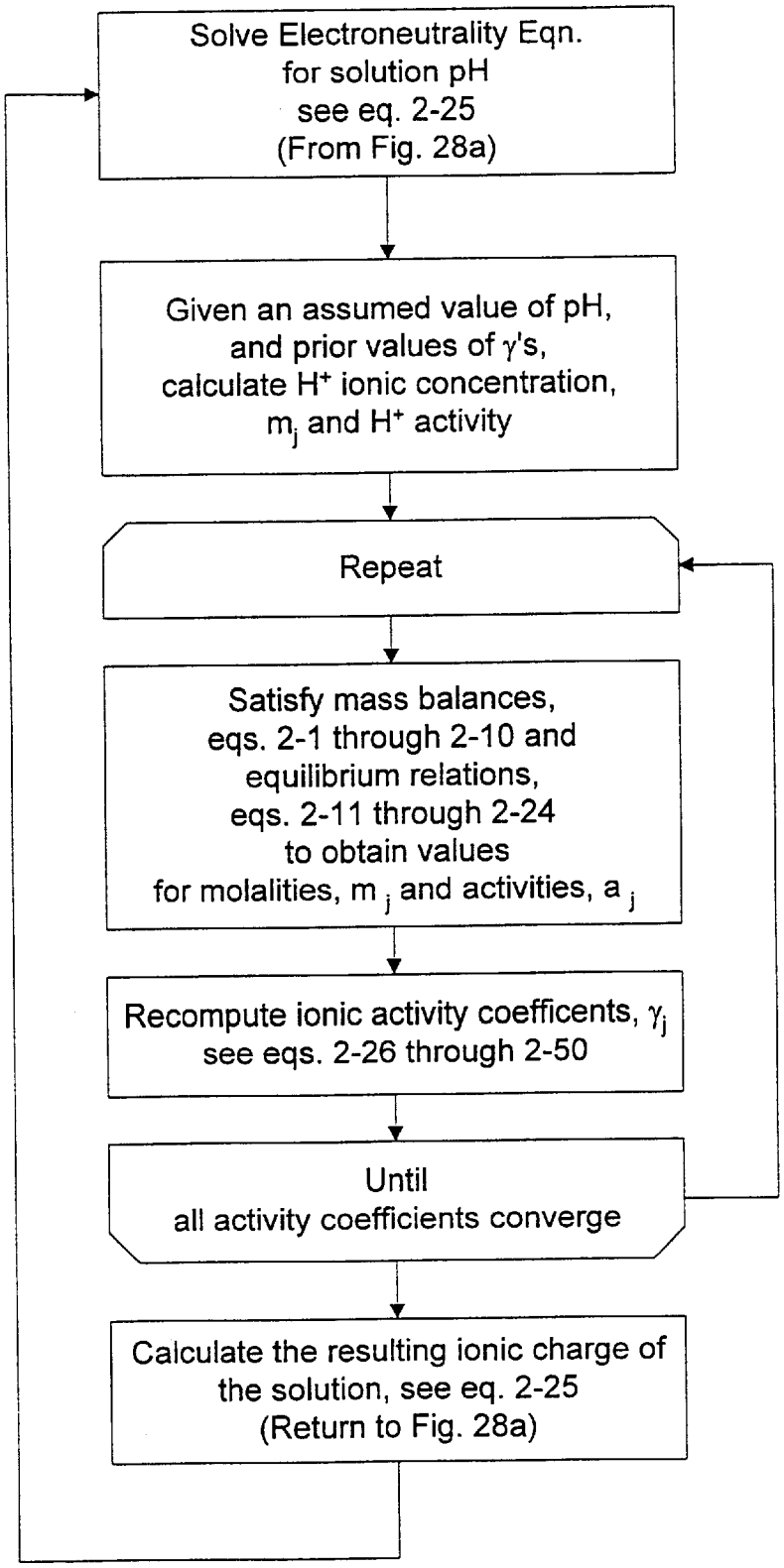
Figure 28C:
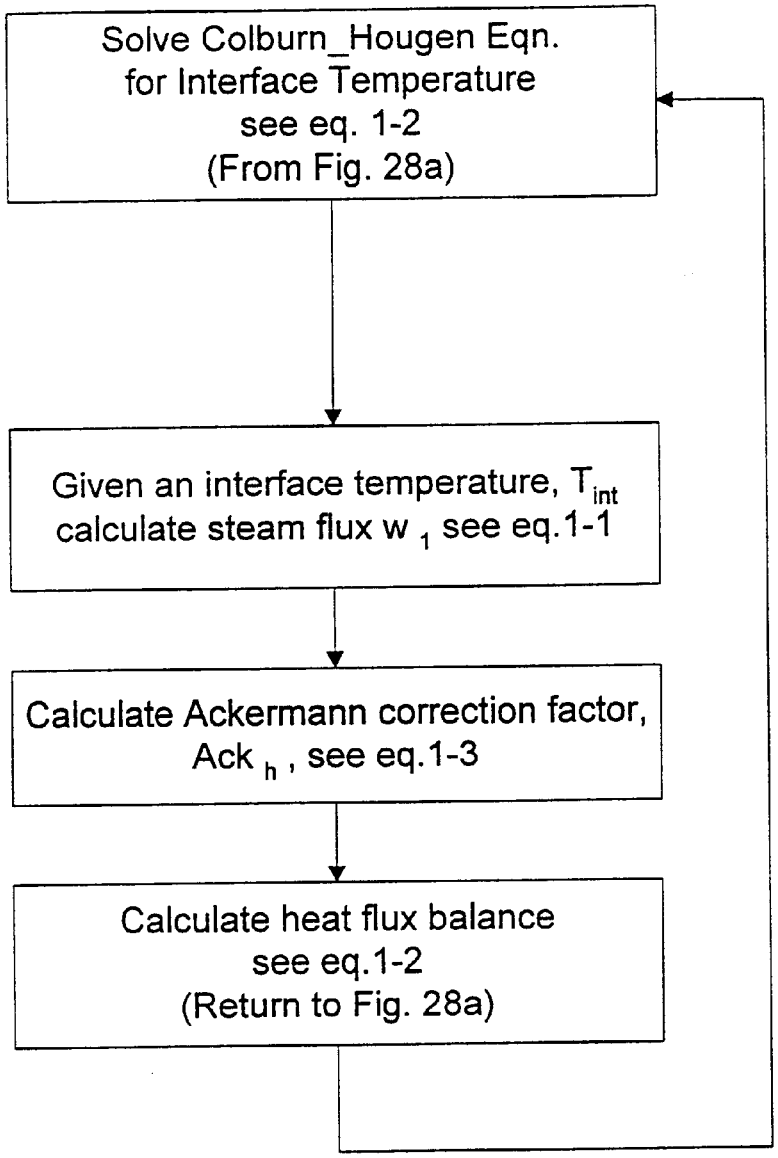

Execution of the computational model continues with two procedures, Mixer procedure 227 and Verify procedure 229 in FIG. 21, and a series of enabling calculations required later by the model (steps 282, 284 and 286). First, the Mixer procedure 227 is used in the case of cocurrent operation (steam enters the top of the condenser) when incoming steam has entrained water. Since this entrained water will physically mix with and become a part of the incoming cooling water on initial contact, and since the fundamental equations of heat, momentum and mass transfer assume pure phases (specifically, the steam/gas phase in the condenser contains no liquid), the flow and composition of the incoming cooling water is adjusted to account for this initial mixing of entrained liquid carried by the steam as if the mixing had occurred outside the condenser. This Mixer procedure 227 then allows the computational model to assume a completely dry incoming steam/gas mixture and adjusts the incoming flow and composition of the cooling water to include the small amount of liquid entrained in the incoming steam/gas mixture.

Next, the Verify procedure 229 is used in the case of countercurrent operation to ensure that the condenser can physically operate with user-specified inlet conditions of steam and cooling water (steps 290 through 304). Simply stated, the computational model ensures that the user has specified enough inlet cooling water to condense all the steam. If the user has not provided enough inlet cooling water the condenser is physically inoperable and the computational model will yield results that are mathematically correct but realistically nonsensible. Execution of this portion of the master flow sheet (FIGS. 12*a–b*) concludes when the known inlet conditions of the steam are assigned either to the top of the contact medium in the case of cocurrent operation or the bottom of the contact medium in the case of countercurrent operation. Known inlet conditions of the cooling water are always assigned to the top of the contact medium.

Referring again to FIGS. 12*a–b*, execution of the computational model bifurcates depending on whether the condenser is operated cocurrently or countercurrently. If the condenser is operated cocurrently then the March procedure 232 is used to solve the fundamental equations of physics and engineering for heat, momentum, and mass transfer and fundamental equations of equilibrium thermodynamics in stepwise fashion across thin horizontal slices of contact medium beginning with the uppermost slice at the top of the condenser. At each repetitive step within the March procedure 232, a complete set of parameters describing the two phases at the bottom of the current slice is calculated from the fundamental equations and a known or previously calculated set of parameters describing the two phases at the top of the slice (bottom of the previous slice). Calculations are only made over a thin slice because some of the fundamental equations are expressed in derivative form and because the integration is done numerically using, for example, discrete integration algorithms such as a fourth order Runge-Kutta integration routine. As is well known by those skilled in the art of computational mechanics, errors in the calculations become large as the slice thickness increases.

As some of the fundamental equations are expressed in derivative form a separate procedure, Derivative procedure 238 (FIG. 26), is required at each repetitive step in the March procedure 232 to calculate the specified derivatives. The Derivative procedure 238 in turn requires the Convert procedure to convert data from commonly used engineering units such as parts per million and grams per liter to more fundamental and nondimensional units such as mass and mole fractions. The Derivative procedure 238 in turn employs a TransferCoefficient procedure 240 to provide physical property data such as heat capacity, density, viscosity, thermal conductivity, water film thickness, liquid side and gas side mass and heat transfer coefficients and friction factors valid for the current slice of contact medium. The Derivative procedure 238 in turn employs a ZeroIn procedure 242 which is used to solve for gas-liquid interface temperature and liquid phase pH present within the current slice of contact medium. The calculation of gas-liquid interface temperature and liquid phase pH requires an iterative approach best performed by this separate ZeroIn procedure 242. In the process of calculating pH iteratively, the ZeroIn procedure 242 also calculates the ionic composition of the liquid phase within the current slice satisfying the laws of equilibrium and the component mass balance equations across the current slice.

The March procedure 232 continues in this stepwise repetitive fashion until the current slice of contact medium is the last slice of contact medium that can be defined within the condenser. At this point the calculations are complete, and the computational model has thereby provided complete steady state profiles of various parameters throughout the condenser. These parameter profiles may be further used by the computational model or the user to calculate overall heat, momentum, mass and chemical component material balances around the condenser and, ultimately, global measures of condenser performance such as thermodynamic efficiency and total effluent discharge.

Referring again to FIGS. 12*a–b*, execution of the computational model takes a different path if the contact medium is operated countercurrently. In the case of countercurrent operation, steam inlet parameters are mathematically known at the bottom of the contact medium and cooling water parameters are mathematically known at the top of the contact medium. Since, however, the March procedure 232 begins at the bottom end of the contact medium and moves slice by slice in one direction upwards, the computational model requires an assumed set of outlet parameters describing the cooling water stream exiting the bottom end of the condenser where computations begin. Without an assumed set of parameters, the March procedure 232 would have no basis for computing the heat, momentum and mass transferred between the two phases within the first and bottommost slice of contact medium and therefore no basis for computing the heat, momentum and mass transferred between the two phases within subsequent slices.

Therefore, referring again to FIGS. 12*a–b*, for countercurrent operation the computational model first generates two sets of data (each set comprised of liquid flux, solute flux and liquid temperature) that represent maximum and minimum conditions of the outlet cooling water and that can be used by the March procedure 232 to generate calculated and hypothetical inlet cooling water parameters at the top of the contact medium. If the two sets of hypothetical computed results do not bracket the values specified by the user then the computational model halts. If, however, the two sets of hypothetical computed results do bracket the values specified by the user then an Iterate procedure 234 (FIG. 24) is used to generate a best guess of outlet cooling water parameters. This best guess, when employed by the March procedure 232, would ideally result in a calculated and hypothetical set of inlet cooling water parameters at the top of the contact medium that exactly matched those specified by the user. In practice, a perfect match is never achieved the first time and the Iterate procedure 234 is used iteratively to generate further refined guesses of outlet cooling water parameters that, when employed in the March procedure 232, yield calculated and hypothetical inlet cooling water parameters closer to the user specified values. When the calculated and hypothetical inlet parameters are sufficiently close to those specified by the user, the guess of outlet cooling water parameters is considered optimal and a final execution of the March procedure 232 is used to provide final steady state profiles of various parameters throughout the condenser. These parameter profiles may be further used by the computational model or the user to calculate overall heat, momentum, mass and chemical component material balances around the condenser and, ultimately, global measures of condenser performance such as thermodynamic efficiency and total effluent discharge.

The invention is further described by the following examples which are illustrative of specific modes of practicing the invention and are not intended as limiting the scope of the invention as defined by the appended claims. For example, although the examples herein illustrate the methods of the present invention for a particular pollution abatement system, one of ordinary skill in the art will appreciate that the methods can be readily modified to accommodate a variety of abatement processes. Similarly, although the methods of the invention are exemplified using steam and cooling water as the vapor and liquid components, the methods can be applied to many vapor and liquid combinations. The present invention thus provides the art with a method for analyzing the physical and chemical aspects of direct contact condensation, regardless of the particular vapor and liquid compositions. Prior to this invention, no such analytical method existed.

In the exemplified geothermal power plant system, $mV_j$ represents the mass flow rate (kg/s) for components in the gaseous phase, wherein j=1 for steam, j=1 . . . 9 for noncondensable gases, and j>9 for dissolved ionic species. Moreover, in the exemplified system, $mL_j$ represents the mass flow rate (kg/s) for components in the liquid mixture, wherein j=1 for coolant (water) and j>1 for dissolved noncondensable gases; $mS_k$ represents the mass flow rates (kg/s) for solutes (no vapor pressure) in the liquid stream, wherein k denotes the component; and $V_j$, $L_j$, and $S_j$ represent the respective molar flow rates in grams mole/second. Finally, in the exemplified embodiments, k=1 wherein k is caustic soda.

EXAMPLES

Example 1

Method for Predicting the Performance of Direct Contact Condensers

The performance of an improved direct contact condenser apparatus of the present invention can be predicted and optimized based on various equipment and process parameters, including the geometric properties of the vapor-liquid contact media 28, 29. This analysis includes a modification of methods disclosed in D. Butterworth, and G. F. Hewitt, *Two-Phase Flow and Heat Transfer,* Oxford University Press, Harwell Services, Oxford (1989) and D. Bharathan, et al., *Direct-Contact Condensers for Open-Cycle OTEC Applications—Model Validation with Fresh Water Experiments for Structured Packings,* Solar Energy Research Institute, SERI/TP-252-3108 (1988), both incorporated by reference herein. The present analysis assumes the following:

1) The two-phase flow within the contact media 28, 29 remains in the separated flow regime, the gas and liquid being separated by a well-defined continuous interface.
2) The coolant and condensate are well mixed, thus possessing identical temperatures and dissolved noncondensable gas concentrations in the film.
3) The interfacial steam flux is governed by combined heat- and mass-transfer processes (in the liquid and vapor, respectively), as disclosed in A. P. Colburn and O. A. Hougen, "Design of Cooler Condensers for Mixtures of Vapors with Noncondensing Gases," *Industrial and Engineering Chemistry,* 26:1178–1182 (1934).

4) Correction factors provided in G. Ackermann, *Forschungsheft,* No. 382, Berlin: VDI-Verlag (1937) are used to adjust the vapor-side transfer rates and friction factor to reflect the high interfacial fluxes. Similar corrections for liquid-side transfer rates are negligible.

5) Steam diffusion through the noncondensable gas and steam mixture is calculated using the stagnant film theory, as disclosed in T. K. Sherwood, et al., *Mass Transfer,* McGraw-Hill, New York (1975).

6) Steam and noncondensable gases are well mixed, thus having an identical bulk temperature reading, nominally denoted by $T_G$.

7) The flux of noncondensable gases desorbed from and/or absorbed into the coolant water stream is small as compared to the condensing steam flux throughout the condenser, i.e., $w_{j(j>1)} << w_{j(j=1)}$.

8) Desorption and absorption of noncondensable gases from and into the coolant results from diffusion. Thus, neither of these processes affect the free interface geometry between the steam and the coolant.

9) The effective transfer area for heat and mass is expressed as $a_f a_p$, where $a_f$=the effective area fraction, $0<a_f<1$, and $a_p$=the total available surface area per unit volume for contact media 28, 29.

A. Downward Steam Flow Chamber 18

Interface Temperature

Referring to FIG. 10, the condensing steam flux $w_{j(j=1)}$ is calculated using the stagnant-film theory as follows:

$$w_{j(j-1)}=k_G \ln[(1-y_{s,int})/(1-y_s)] \quad (1\text{-}1)$$

where $k_G$=the vapor/gas mixture mass-transfer coefficient (kg/m$^2$ s), $y_s$=the steam mole fractions in the bulk mixture, and $y_{s,int}$=the steam mole fractions at the interface.

The heat flux to the coolant includes both sensible heat from the gas mixture and latent heat from condensation. The interfacial steam flux and overall heat flux are calculated using the Colburn-Hougen equation:

$$h_L(T_{int}-T_L)=h_G(Ack_h)(T_G-T_{int})+h_{fg}w_1 \quad (1\text{-}2)$$

where $h_L$=the liquid-side heat transfer coefficient (kW/m$^2$K), $h_G$=the vapor/gas mixture heat transfer coefficient (kW/m$^2$K), $h_{fg}$=the latent heat of condensation calculated from the interface temperature (kJ/kg), $T_L$=the liquid temperature, $T_{int}$=the interface temperature, and $T_G$=the vapor/gas mixture temperature.

$Ack_h$represents the Ackermann correction factor (G. Ackermann, *Forschungsheft,* No. 382, Berlin: VDI-Verlag (1937)) for heat transfer to correct for high interfacial flux. $Ack_h$ is calculated as follows:

$$Ack_h=C_o/[1-\exp(-C_o)] \quad (1\text{-}3)$$

where $C_{o=w1}C_{ps}/h_G$ and $C_{ps}$=the specific heat of the steam (kJ/kg K).

The interface temperature $T_{int}$ is determined by applying the transfer coefficients $h_L$, $h_G$, and $k_G$ to equations 1-1 through 1-3 above.

Transfer Fluxes

Noncondensable gas absorption and desorption into and from the coolant are thought to be primarily controlled by diffusion resistance in the liquid film. Noncondensable gas flux from the coolant $w_{j(j>1)}$ is calculated according to the following equation:

$$W_{j(j>1)}=k_{Lj}(X_j^*-X_j) \quad (1\text{-}4)$$

where $k_{Lj}$=the liquid-side mass transfer coefficient for the j-th component (kg/m$^2$s), $X_j$=the mass fraction of molecular form of noncondensable gas in the bulk coolant, and $X_j^*$=the equilibrium value at the partial pressure of-the component of the noncondensable gases adjacent the liquid film in the vapor/gas mixture.

The equilibrium value for the dissolved j-th component of the noncondensable gas in the coolant is governed by Henry's law, wherein $$y_j^*=pp_j/He_j \quad (1\text{-}5)$$

where $y_j^*$=the noncondensable gas mole fraction in equilibrium, $pp_j$=the equilibrium partial pressure of noncondensable gas adjacent the film, and $He_j$=Henry's law constant, which is generally a function of coolant temperature.

Process Equations

Process equations are derived from the mass, momentum, and energy balances over a cross-section of the downward flow chamber 18. These balances are calculated as disclosed in Bharathan, et al. (1988). In the following equations, n=9.

a. Mass balances

Steam and/or noncondensable gaseous component flow:

$$d(mV_j)/dz=-w_j a_f a_p A, (j=1 \ldots n) \quad (1\text{-}6)$$

Coolant flow and/or noncondensable gases in the coolant:

$$d(mL_j)/dz=-d(mV_j)/dz, \ (j=1 \ldots n) \quad (1\text{-}7)$$

The solute remains in the coolant, i.e., $$d(mS_k)/dz=0(k=1) \quad (1\text{-}8)$$

b. Momentum and energy balances

Condenser heat load:

$$dQ/dz=h_L(T_{int}-T_L)a_f a_p A \quad (1\text{-}9)$$

Water temperature:

$$d(T_L)/dz=(1/\Sigma mL_j C_{pj})dQ/dz \quad (1\text{-}10)$$

Temperature and pressure of the steam and noncondensable gas mixture:

$$\begin{bmatrix} (1+u^2/C_{pG}T) & -u^2/pC_{pG} \\ \rho u^2/T & 1-u^2/RT \end{bmatrix} \begin{Bmatrix} dT/dz \\ dp/dz \end{Bmatrix} = \begin{Bmatrix} b_1 \\ b_2 \end{Bmatrix} \quad (1\text{-}11, 12)$$

where $\rho$ is the vapor/gas mixture density, u is the vapor/gas mixture superficial velocity, R is the universal gas constant, and $C_{pG}$ is the vapor/gas mixture specific heat, and where $$b_1=[-h_G A c k_h (T_G-T_{int}) a_f a_p \exp(-C_O)+u_{bulk}\tau_{int}a_p-(\rho_G-\rho_{ref})gu-(\Sigma mV_j)'u]/(\Sigma mV_j C_{pj}) \quad (1\text{-}13)$$

$$b_2=-\tau_{int}a_p-(\rho_G-\rho_{ref})g-\rho_G uu' \quad (1\text{-}14)$$

where $(\Sigma mV_j)'$=the rate of change of gas loading dG/dz (kg/m$^3$s), $\tau_{int}a_p$=the frictional term expressed as $$\tfrac{1}{2}\rho_G(U_{G,eff}\pm U_{L,eff})^2 f\{(Ack_f)a_f a_p+(1-a_f)a_p\}(N/m^3),$$

where $U_{G,eff}$=effective vapor/gas mixture velocity through the packing (m/s), $U_{G,eff}\pm U_{L,eff}$=the relative gas velocity (m/s)

f=friction factor $Ack_f$=Ackermann friction correction factor for high mass fluxes, expressed as $(2w_1/Gf)/[1-\exp(-2w_1/Gf)]$, and G=superficial vapor/gas mixture loading (kg/m$^2$s).

Note that for the frictional term, the ineffective fraction of the available surface area also contributes to pressure loss. The Ackermann correction is applied only where mass transfer occurs, i.e., over the fractional area $a_f a_p$, assuming all contribution to pressure loss occurs via interfacial shear. The above equations assume negligible contributions to friction as a result of form drag. Equations 1-11 and 1-12 reflect the relationship between temperature and pressure in the steam and noncondensable gas mixture.

Equations 1-6 through 1-12 are integrated along the vertical axis of the condenser to calculate variations in steam, noncondensable, and coolant flow rates, and temperatures and pressures under steady-state conditions. These equations enable independent evaluations of the partial pressures and temperature in the steam and noncondensable gas mixture. At the end of each step, chemical species distributions, $mL_j$ (=10.25), are calculated using the procedures described in Example 2.

B. Upward Steam Flow Chamber 20

Initial conditions in an upward steam flow chamber generally provide the liquid flow at the top of the condenser and gas flow at the bottom. However, to evaluate the performance of chamber 20, integration begins from the bottom, which requires an estimate of the coolant temperature, flow rate, and dissolved noncondensable gas content. Estimates are iteratively updated to match the calculated coolant inlet conditions at the top of the condenser with the specified values (within an acceptable tolerance). Approximately 17 iterations are necessary to match all variables at the coolant inlet, for the application shown in this example.

Process Equations

The upward steam flow analysis is similar to that of the downward flow, except that the liquid flows in the negative "z" direction. As discussed above, integration begins from the bottom of the condenser. Mass, momentum and energy balances are calculated according to equations 1-15 through 1-19.

Mass Balances

Steam and/or noncondensable gaseous component flow:

$$d(mV_j)/dz=-w_j a_f a_p A,\ (j-1\ldots n) \quad (1\text{-}15)$$

Coolant flow and/or noncondensable gases in the coolant:

$$d(mL_j)/dz=d(mV_j)/dz,\ (j=1\ldots n) \quad (1\text{-}16)$$

The solute remains in the coolant, i.e., $$d(mS_k)/dz=0(k=1) \quad (1\text{-}17)$$

Momentum and Energy Balances

Condenser heat load:

$$dQ/dz=h_L(T_{int}-T_L)a_f a_p A \quad (1\text{-}18)$$

Water temperature (decreases with z):

$$d(T_L)/dz=-(1/\Sigma mL_j C_{pj})dQ/dz \quad (1\text{-}19)$$

The above equations enable integration along the height of the condenser by estimating water temperature, flow rate, and dissolved noncondensable gas content at the cooling water outlet. At the end of each step, chemical species distributions, $mL_j$ (j=10 . . . 25), are calculated using the procedures described in Example 2. Iterations are required to match the exact water flow conditions at the top of the condenser.

C. Contact Medium

The hydraulic diameter for the vapor flow $d_{eq}$ is four times the flow area per unit perimeter. The vapor flow $d_{eq}$ is calculated according to Bravo et al. (1985) as follows:

$$d_{eq}=Bh/[1/(B+2S)+1/2S] \quad (1\text{-}20)$$

The vapor flow $d_{eq}$ is thus the arithmetic mean of hydraulic diameters of triangular and diamond-shaped passages, as shown in FIGS. 4 and 5. Based on estimates of Bravo et al. (1985), the available surface area per unit volume of the contact medium is approximately $4/d_{eq}$ (l/m).

For contact medium formed of solid sheets, the contact area between adjacent sheets (i.e., the glued or welded area) represents a loss in available area. The thickness of the sheet causes a small but finite reduction in the available volume and void fraction. This void fraction is estimated by the following equation:

$$\epsilon=1-4t/d_{eq}, \quad (1\text{-}20.1)$$

where t is the sheet thickness (m).

When the contact loss is expressed as a percentage of total available area, $C_{Loss}$ the available surface area per unit volume is calculated as follows:

$$a_p=(1-C_{Loss}/100)4\epsilon/d_{eq}(l/m) \quad (1\text{-}21)$$

Transfer Correlations

Transfer correlations are adopted from Bravo et al. (1985), with modifications to accommodate high liquid loadings (L). In an embodiment of the present invention, L is approximately 30 kg/m$^2$s, as compared to Bravo et al., where L is about 2.8 kg/m$^2$s.

a. Liquid-side correlations (1) Mass Transfer

Referring to FIGS. 7 and 8, the cooling liquid flows by gravity as a film along the flow surface 150. For contact medium formed of solid sheets, only a fraction $a_f(0<a_f<1)$ of the available surface area is involved in the transfer process. Because the liquid flow on the inclined surface is equivalent to an "open-channel" flow, Manning's formula is used to estimate the effective liquid-film thickness and velocity for water flow (J. E. A. John and W. L. Haberman, *Introduction to Fluid Mechanics,* Prentice-Hall, Englewood Cliffs, N.J. (1980)). For an inclined smooth surface, the water velocity is calculated by the following equation (given in SI units):

$$U_{L,eff}=0.820\delta^{2/3}(\sin\alpha)^{1/2}/n(\text{m/s}), \quad (1\text{-}22)$$

where $\alpha$=modified inclination of the surface from horizontal, as shown in FIG. 6, n=Manning roughness coefficient (=0.010 for smooth surfaces), $\delta$=film thickness (m).

The following equation applies when n is 0.010 (smooth surfaces):

$$\delta=[\Gamma/(82\rho_L(\sin\alpha)^{1/2})]^{3/5} \quad (1\text{-}23)$$

where $\Gamma$=the water flow per unit surface area in unit length of packing, and equals $$\rho_L U_{L,eff}\delta=L/a_f a_p \text{ (kg/m s)},$$

where L is the superficial liquid loading (kg/m$^2$ s). Note that equations 1-22 and 1-23 (in metric units) applies for turbulent water flow.

The typical distance over which liquid renewal occurs is the slanted side S, modified by the inclination $\theta$ of the corrugation (S') where $$S'=[(B/2\cos\theta)^2+h^2]^{1/2}, \quad (1\text{-}24)$$

and $$\sin\alpha=B/(2S'\cos\theta). \quad (1\text{-}25)$$

The local liquid-side mass-transfer coefficient is calculated as follows:

$$k_{Lj}=2\rho_L(D_{Lj}U_{L,eff}/\pi S')^{1/2} \quad (1\text{-}26)$$

where $D_{Lj}$=diffusivity of the j-th noncondensable gas in water (m$^2$/s), $U_{L,eff}$=effective liquid film velocity (m/s), S'=distance over which liquid renewal occurs (m), and $k_{Lj}$=liquid-side mass-transfer coefficient for the j-th component (kg/m$^2$ s).

Equation 1-26 is based on the penetration theory of R. Higbie, *AIChE Trans.* (1935), as applied by J. L. Bravo, et al., *Hydrocarbon Processing,* pp. 45–59 (1985), except that $U_{L,eff}$ in equation 1-26 reflects a turbulent water flow on an inclined plane, rather than laminar flow on a vertical surface as applied in Bravo et al. Also, the renewal distance S' in equation 1-26 depends on $\theta$, in contrast to Bravo's shorter distance S, which is independent of $\theta$.

(2) Heat Transfer

The liquid-side heat-transfer coefficient is evaluated using the Chilton-Colbum analogy (Chilton, T. H. and A. P. Colbum, *Industrial and Engineering Chemistry,* 26:1183–1187 (1934), defined as follows:

$$h_L/k_{Lj}C_{pL}=(Sc_{Lj}/Pr_L)^{1/2} \quad (1\text{-}27)$$

where $h_L$=liquid-side heat-transfer coefficient (kW/m$^2$ K), $k_{Lj}$=liquid-side mass-transfer coefficient for the j-th noncondensable component, (kg/m$^2$ s), $C_{pL}$=specific heat of liquid (kJ/kg K), $Sc_{Lj}$=liquid Schmidt number for the j-th noncondensable component, and $Pr_L$=liquid Prandtl number.

b. Gas-side correlations (1) Mass Transfer

The local vapor/gas mixture mass-transfer coefficient is based on a wet-wall columns configuration. According to Bravo et al. (1985), the vapor/gas mixture Sherwood number is expressed as $$Sh_G=0.0338(Re_G)^{4/5}(Sc_G)^{1/3} \quad (1\text{-}28)$$

where $Sh_G=kGd_{eq}/\rho_G D_G$, $Re_G=d_{eq}\rho_G(U_{G,eff}\pm U_{L,eff})/\mu_G$, is based on a relative velocity, $Sc_G=\mu_G/\rho_G D_G$, $k_G$=vapor/gas mixture mass-transfer coefficient (kg/m$^2$ s), $D_G$=vapor diffusivity (m$^2$/s) in the mixture, and $\mu_G$=vapor/gas mixture dynamic viscosity (kg/m s).

The effective gas velocity $U_{G,eff}$ is a function of the superficial vapor/gas mixture loading G (kg/m$^2$ s), the void fraction of the packing $\epsilon$, and the flow channel inclination $\theta$:

$$U_{G,eff}=G/\rho_G\epsilon\sin\theta \quad (1\text{-}29)$$

(2) Heat Transfer

The local vapor/gas mixture heat-transfer coefficient is evaluated using the Chilton-Colburn (1934) analogy as follows:

$$h_G/k_G C_{pG}=(Sc_G/Pr_G)^{2/3} \quad (1\text{-}30)$$

where $h_G$=vapor/gas mixture heat-transfer coefficient (kW/m$^2$ K), $C_{pG}$=specific heat of vapor/gas mixture (kJ/kg K), $Sc_G$=vapor Schmidt number in the mixture, and $Pr_G$=vapor/gas mixture Prandtl number.

(3) Gas Friction

The local gas friction is calculated according to Bravo et al. (1986), supra, where the structured packing comprised six to ten stacked sheets, each rotated 90° from the horizontal. Bravo et al. express the pressure loss in such a stack under dry conditions as follows:

$$f=(0.171+92.7/Re_S) \quad (1\text{-}31)$$

where $Re_S$=a vapor/gas mixture Reynolds number based on length S.

For the model predictions, the "local friction" coefficient is expressed as follows:

$$f=0.171+(92.7/Re_G) \quad (1\text{-}32)$$

And, in the Darcy-Weisbach equation, as $$\Delta P = fLq/d_{eq} \quad (1\text{-}33)$$

where q=the vapor/gas mixture dynamic pressure.

D. Integration Scheme

The process equations described above are integrated using a fourth-order Runge-Kutta integration scheme. For downward steam flow, integration proceeds along the superficial direction of steam and water flow. The integration steps are summarized as follows:

1. Evaluate the fundamental properties (mixture density, viscosity, mutual diffusivity, and thermal conductivity) of the steam and noncondensable gas mixture and the liquid-noncondensable solution.
2. Based on the initial local flow rates, evaluate the effective liquid and gas mixture velocities.
3. Predict the local Nusselt and Sherwood values based on selected correlations using the local liquid and gas mixture Reynolds, Prandtl, and Schmidt values.
4. Calculate interfacial temperature, based on the local heat- and mass-transfer coefficients, using the Colburn-Hougen equation. This step applies the ZEROIN subroutine disclosed in G. E. Forsythe, et al., *Computer Methods for Mathematical Computations,* Prentice-Hall, Englewood Cliffs, N.J. (1977).
5. Calculate a series of derivatives of the local state variables using the interface temperature.
6. Calculate the state conditions at the end of the step, using the local derivatives.

For downward steam flow, integrate either to a specified condenser height or to a height at which the local steam saturation temperature is 0.02° C. above the water temperature.

For upward steam flow, the inlet conditions for water and steam correspond to the top and bottom of the condenser, respectively. Iterate the process to match conditions at opposing ends 5 of the condenser. The process equations are integrated from the bottom of the condenser, by estimating a set of state values for the water. Integration proceeds from the bottom to top, similar to that of the downward steam flow. The calculated water conditions at the top are then compared to the specified water inlet conditions (temperature, flow rate, and concentration of dissolved noncondensable gas). If necessary, additional sets of bottom water conditions are estimated, and the integration step is repeated. This procedure is repeated using a modified ZEROIN subroutine, as disclosed in Forsythe et al. (1977), supra. Iterations are performed until the calculated and specified water temperatures at the top of the condenser vary by ±0.01° C. For upward steam flow condenser operating conditions, seventeen iterations are typically required for convergence, for the application shown in this example. An integration step size of 2.5 cm is usually sufficient.

Example 2

Chemical Aspects of Geothermal Steam Condensation

Geothermal well-head steam usually contains a variety of noncondensable gases. Table I illustrates the concentration ranges (ppm mass) of the noncondensable gases in the steam from The Geysers, condensed from *Monograph on the Geysers Geothermal Field,* C. Stone (Ed.), Geothermal Resources Council, Davis, Calif. (1992).

TABLE I

| | Maximum | Minimum |
|---|---|---|
| Carbon dioxide | 55500 | 140 |
| Hydrogen sulfide | 1710 | 36 |
| Ammonia | 576 | 0.03 |
| Methane | 2580 | 4 |
| Hydrogen | 347 | 2.4 |
| Nitrogen | 560 | 3 |

Of these gases, the chemistry of hydrogen sulfide ($H_2S$) is particularly important because of the regulations governing its emissions from a power plant. The current regulations limit emissions of $H_2S$ to 200 grams per gross MWh of power production from the geothermal steam.

In addition to these gases, other noncondensable gases that appear in the condenser include oxygen and nitrogen, typically resulting from leaks in the low-pressure sections of the power plant. Because the cooling water in a direct-contact condenser is exposed to these noncondensable gases, which may be absorbed by the water, the gases may in turn be liberated into the atmosphere from a wet cooling tower. Therefore, particular attention must be paid to the kinetics of the gas absorption and desorption in the condenser design.

This example provides a method for tracking these gases through the condenser, as well as other chemicals in the cooling liquid, such as caustic soda (NaOH) and sulfuric acid, which are commonly included to mitigate emissions of $H_2S$ from the plant.

Table 2 lists eight noncondensable gases typically present in geothermal steam, including their respective subscripts for use in the present method.

TABLE 2

| Noncondensable Gas | Symbol | Subscript |
|---|---|---|
| Carbon dioxide | $CO_2$ | 2 |
| Hydrogen Sulfide | $H_2S$ | 3 |
| Ammonia | $NH_3$ | 4 |
| Methane | $CH_4$ | 5 |
| Hydrogen | $H_2$ | 6 |
| Nitrogen | $N_2$ | 7 |
| Oxygen | $O_2$ | 8 |
| Sulfur dioxide | $SO_2$ | 9 |

In addition to the above noncondensable gases, NaOH is assumed to be present in the cooling water. In this example, iron chelate (FeHEEDTA) is also added to the water stream to promote precipitation of solid sulfur (S°) and its conversion to a soluble thiosulfate, $S_2O_3^{--}$. Because iron chelate acts as a catalyst, its action is not directly accounted for in the details of the following chemical analysis.

Of the noncondensable gases, three ($CH_4$, $H_2$, and $N_2$) are considered inert in their aqueous solution. The other gases go into solution and react to form other solutes and reaction products. The principal reactions are as follows:

R-1. $NH_3+H_2O=NH_4^++OH^-$
R-2. $NH_3+HCO_3^-=NH_2COO^-+H_2O$
R-3. $H_2S=H^++HS^-$
R-4. $HS^-=H^++S^{--}$
R-5. $SO_2+H_2O=H^++HSO_3^-$
R-6. $HSO_3^-=H^++SO_3^{--}$
R-7. $S^{--}+2H^++0.5O_2=S+H_2O$
R-8. $S+SO_3^{--}=S_2O_3^{--}$
R-9. $HSO_3^-+0.5O_2=HSO_4^-$
R-10. $SO_3^{--}+0.5O_2=SO_4^{--}$
R-11. $CO_2+H_2O=H^++HCO_3^-$
R-12. $HCO_3^-=H^++CO_3^{--}$

R-13. $NaOH=Na^{+}+OH^{-}$

R-14. $H_2O=H^{+}+OH^{-}$

The above reactions convert incoming $H_2S$ to soluble $S_2O_3^{--}$, which is rejected in the blowdown and reinjected streams. The NaOH is added to the water stream entering the after-condenser condenser to control the amount of vented $H_2S$ converted to $SO_2$ in the burner. This control may be necessary to achieve an appropriate ratio of $SO_2$ to $H_2S$ for $S_2O_3^{--}$ rejection.

1. Gas-Liquid Equilibrium

Gas-liquid equilibrium calculations are adopted from K. Kawazuishi and J. M. Prausnitz, *Ind. Eng. Chem. Res.,* 26(7):1482–1485 (1987), incorporated by reference in its entirety herein.

The method described herein assumes the following:

1. The condenser operating pressures are low enough that molecular interactions in the gas phase can be ignored. The fugacity coefficient for all gas phase species, which represents deviations due to interactions between the gas phases, is set to unity for all species, implying no interactions (R. Nakamura, et al., *Ind. Eng. Chem. Processes Des. Dev.,* 15(4):557–564 (1976)).
2. The solutes in the gas-liquid mixture are in equilibrium; i.e., the rate at which these components reach chemical equilibrium is significantly faster than the mass transfer rate between gas and liquid for the noncondensable gases. For long-term behavior, each of reactions R-1 through R-14 reach equilibrium level; for short-term behavior, reactions R-7 and R-8 are suppressed.

Earlier reports on gas-liquid equilibrium for weak electrolytes include T. J. Edwards, et al.,

*AIChE Journal,* 21(2):248–259 (1975), T. J. Edwards, et al., *AIChE Journal,* 24(6):966–976 (1978), D. Beutler and H. Renon, *Ind. Eng. Chem. Processes Des. Dev.,* 17(3):220–230 (1978), and E. M. Pawlikowski, et al., *Ind. Eng. Chem. Processes Des. Dev.,* 21(4):764–770 (1982), all incorporated by reference in their entireties herein.

Based on the above references, the dissociation equilibrium constants for the various reactions are expressed as a function of temperature:

$$\ln K=A_1/T+A_2 \ln T+A_3T+A_4 \quad (2\text{-}0.1)$$

where A is the equilibrium constant for the particular species, as reported in K. Kawazuishi and J. M. Prausnitz (1987), supra. Activities of all species (except water) are expressed by molality (moles/kg of water); the activity of water is expressed by mole fraction. Equilibrium constants for reactions R-2 and R-8 are in units of kg/mole, for R-9 and R-10 they are in units of $kg^{0.5}/mole^{0.5}$, for R-7 it is in unit of $kg^{2.5}/mole^{2.5}$, for R-14 it is in unit of $mole^2/kg^2$. For all other reactions, the units for the equilibrium constants are mole/kg. All equilibrium constants apply in the temperature range of 0° C. to at least 100° C.

The solubility of the molecular noncondensable species is expressed using Henry's constants, including the effect of temperature:

$$\ln H=B_1/T+B_2 \ln T+B_3T+B_4 \quad (2\text{-}0.2)$$

where B is Henry's constants for the various noncondensable species (in bar mole/kg), and T is temperature in degrees Kelvin.

To predict the chemical performance of the direct contact condenser, $mV_j$ represents the total amount of noncondensable gases in the vapor stream, where j is 2 through 9 (Table 2) in units of mass flow per unit condenser platform area ($kg/m^2s$); j=1 for steam.

Similarly, $mL_j$ represents the total amount of dissolved noncondensable gases in the liquid stream, where j is 2 through 9 (Table 2) in units of mass flow per unit condenser platform area ($kg/m^2s$). Subscript j=1 for the cooling water plus the condensate; noncondensable gases are denoted by subscripts as shown in Table 2 above.

Solute species in the aqueous solution, such as NaOH, are categorized as solutes and denoted $mS_k$, expressed in units of mass flow per unit platform area of the condenser ($kg/m^2s$). In this example, only one solute species is assumed to be present.

Other ionic and molecular species in the liquid are denoted by $mL_j$, where j is 10 through 25. Table 3 provides the subscripts for these molecular and ionic species.

TABLE 3

| Species | Subscript |
|---|---|
| $HCO_3^-$ | 10 |
| $CO_3^{2-}$ | 11 |
| $H^-$ | 12 |
| $HS^-$ | 13 |
| $S^{2-}$ | 14 |
| S | 15 |
| $HSO_3^-$ | 16 |
| $SO_3^{2-}$ | 17 |
| $S2O_3^{2-}$ | 18 |
| $HSO_4^-$ | 19 |
| $SO_4^{2-}$ | 20 |
| $NH_4^+$ | 21 |
| $OH^-$ | 22 |
| $NH_2COO^-$ | 23 |
| $Na^+$ | 24 |
| NaOH | 25 |

2. Mass Balance Equations

The mass balance equations for ionic species, added chemicals, and precipitates are as follows:

$$\text{Total } m_{CO2}=m_{CO2}+m_{HCO3-}+m_{CO3--}+m_{NH2COO-} \quad (2\text{-}1)$$

$$\text{Total } m_{H2S}=m_{H2S}+m_{HS-}+m_{S--}+m_S+m_{S2O3--} \quad (2\text{-}2)$$

$$\text{Total } m_{NH3}+m_{NH3}+m_{NH4+}+m_{NH2COO-} \quad (2\text{-}3)$$

$$\text{Total } m_{CH4}=m_{CH4} \quad (2\text{-}4)$$

$$\text{Total } m_{H2}=m_{H2} \quad (2\text{-}5)$$

$$\text{Total } m_{N2}=m_{N2} \quad (2\text{-}6)$$

$$\text{Total } m_{O2}=m_{O2}+0.5m_S+0.5m_{HSO4-}+0.5m_{SO4--}+0.5m_{S2O3--} \quad (2\text{-}7)$$

$$\text{Total } m_{SO2}=m_{SO2}+m_{HSO3-}+m_{SO3--}+m_{HSO4-}+m_{SO4--}+m_{S2O3--} \quad (2\text{-}8)$$

In equations 2-1 through 2-8, the molecular concentration of the inert gas in the liquid is related to its partial pressure adjacent to the liquid interface as follows:

$$m_i\gamma_iH_i=y_i\psi_iP$$

where γ and ψ are the liquid activity and gas fugacity coefficients, respectively. As mentioned earlier, for the present analyses, the gas phase fugacity coefficients are all set to unity.

The mass balance equation for NaOH is as follows:

$$\text{Total } m_{NaOH}=m_{NaOH}+m_{Na+} \quad (2\text{-}9)$$

The mass balance equation for the water is as follows:

$$\text{Total } m_{H2O}=m_{H2O}-\{m_{OH-}-m_{Na+}\}-\{m_{CO3--}+m_{HCO3-}+m_{SO3--}+m_{HSO3-}+m_{SO4--}+m_{HSO4-}+m_{S2O3--}+m_{NH4+}-m_{NH2COO-}\} \quad (2\text{-}10)$$

The following equations represent the various equilibrium reaction constants:

$$\ln K_1=\ln(a_{NH4+})+\ln(a_{OH-})-\ln(a_{NH3}) \quad (2\text{-}11)$$

$$\ln K_2=\ln(a_{NH2COO-})-\ln(a_{HCO3-})-\ln(a_{NH3}) \quad (2\text{-}12)$$

$$\ln K_3=\ln(a_{H+})+\ln(a_{HS-})-\ln(a_{H2S}) \quad (2\text{-}13)$$

$$\ln K_4=\ln(a_{H+})+\ln(a_{S--})-\ln(a_{HS-}) \quad (2\text{-}14)$$

$$\ln K_5=\ln(a_{H+})+\ln(a_{HSO3-})-\ln(a_{SO2}) \quad (2\text{-}15)$$

$$\ln K_6=\ln(a_{H+})+\ln(a_{SO3--})-\ln(a_{HSO3-}) \quad (2\text{-}16)$$

$$\ln K_7=\ln(a_S)-\ln(a_{S--})-2\ln(a_{H+})-0.5\ln(a_{O2}) \quad (2\text{-}17)$$

$$\ln K_8=\ln(a_{S2O3--})-\ln(a_{SO3--})-\ln(a_S) \quad (2\text{-}18)$$

$$\ln K_9=\ln(a_{HSO4--})-\ln(a_{HSO3-})-0.5\ln(a_{O2}) \quad (2\text{-}19)$$

$$\ln K_{10}=\ln(a_{SO4-})-\ln(a_{SO3--})-0.5\ln(a_{O2}) \quad (2\text{-}20)$$

$$\ln K_{11}=\ln(a_{H+})+\ln(a_{HCO3-})-\ln(a_{CO2}) \quad (2\text{-}21)$$

$$\ln K_{12}=\ln(a_{H+})+\ln(a_{CO3--})-\ln(a_{HCO3-}) \quad (2\text{-}22)$$

$$\ln K_{13}=\ln(a_{Na+})+\ln(a_{OH})-\ln(a_{NaOH}) \quad (2\text{-}23)$$

$$\ln K_{14}=\ln(a_{H+})+\ln(a_{OH-})-\ln(a_{HO2}) \quad (2\text{-}24)$$

Electroneutrality for the solution yields:

$$m_{NH4+}+m_{H+}+m_{Na+}=m_{OH-}+m_{NH2COO-}+m_{HS-}+m_{HCO3-}+m_{HSO3-}+m_{HSO4-}+2m_{CO3--}+2m_{SO3--}+2m_{SO4--}+2m_{S2O3--} \quad (2\text{-}25)$$

The activity for any species j is written as:

$$a_j=\gamma_j m_j$$

where the activity coefficients, $\gamma$, for each of the 25 species are written as $$\ln \gamma_j=-\alpha z_j\sqrt{I}/(1+\sqrt{I})+2\Sigma\beta_{jk}m_k \ (j=1\ldots 25) \quad (2\text{-}26)\text{–}(2\text{-}50)$$

where $Z_j$=charge number for the species,

I=ionic strength of the solution=$\Sigma m_j z_j^2/2$, $\beta_{jk}$=a dual interaction parameter between species j and k, set equal to zero for all but four species (Kawazuishi and Prausnitz, 1987).

The activity coefficients for species with no charge is unity.

To calculate the equilibrium concentrations at the vapor-liquid interface, $m_j$ and $\gamma_j$ for the 25 species is determined by iterating this set of 50 nonlinear equations.

3. Concentrations of Dissolved Species

The methods for determining the concentrations of dissolved species are adopted from Buetler and Renon (1978), supra, and in particular Appendixes A and B thereof, incorporated by reference herein.

At any stage of integration of the transfer equations described in Example 1, estimate the total amount of non-condensable gas species in the aqueous solution. The species distribution is determined iteratively as follows: Set all $\gamma_j$ equal to unity; assume a value of $m_{H+}$ or equivalent pH of solution; deduce all other 24 molalities of the components using the chemical equilibrium constant definitions and the corresponding mass balances, using equations 2-1 through 2-24. Calculate the activity coefficients $\gamma_j$ for each species and evaluate the electroneutrality, equation 2-25. Determine the appropriate pH for neutrality.

The above procedure determines the distribution of molecular and ionic species in solution. The molecular amounts are used to calculate an equilibrium partial pressure for that component, which is then used to estimate the driving force for mass transfer of that component into or out of solution. These values are used to predict the chemical performance of the condenser, as described in Example 1.

EXAMPLE 3

Long-Term Equilibrium Calculations

An oxidation-simulation test was conducted for a geothermal power plant operating at The Geysers (Sonoma and Lake County, Calif.). Over a ten-day test period, known amounts of $H_2S$ and $SO_2$ were injected into the cooling water stream of a direct contact condenser and the blowdown at the cooling tower was analyzed for thiosulfate, sulfate, sulfite, and sulfur content. Based on the known amounts of injected reactive gases, and assuming all species are in equilibrium, calculations were performed in accordance with the method of the present invention to predict the concentrations and chemical profile of the blowdown effluent. The analysis reflects the large time constant associated with mixing in the large inventory of the cooling water.

FIGS. 11*a–d* provide a comparison of the actual chemical data generated during the oxidation experiment and the predicted chemical profile. As can be seen in FIGS. 11*a–d,* the method of the present invention provides an accurate assessment of the chemical performance of the direct contact condenser. Using this method, artisans can now conveniently and accurately predict the distribution and concentrations of chemical species in the condenser effluent.

EXAMPLE 4

Short-Term Equilibrium Calculations

Although the long-term equilibrium calculations provide an accurate assessment of the overall system performance (Example 3), the higher-pressure after-condenser simulations did not reflect the sensitivity of $H_2S$ absorption with varied amounts of caustic addition as observed in the plant. This discrepancy results from the assumed equilibrium conditions for reactions R-7 and R-8 within the condenser, versus the delayed productions of sulfur and thiosulfate in the cooling water return pipe in the plant. To reflect this delay, the calculations are adjusted to halt the production of sulfur and thiosulfate within the condenser. This short-term analysis captures the behavior of the aqueous solution within the brief period of time (approximately one second) the solution spends in the contact medium. During this period, the $H_2S$ remains in solution without being consumed, so a fraction remains as molecules. Adding caustic soda to increase the pH of the solution facilitates absorption of the $H_2S$ into solution. This short-term analysis may be incorporated into the method of the present invention to reflect the short-term behavior associated with certain chemical reactions and composition of the solution.

The foregoing description is considered as illustrative only of the principles of the invention. Furthermore, because numerous modifications and changes will readily occur to those skilled in the art, it is not desired to limit the invention to the exact construction and process shown as described above. Accordingly, resort may be made to all suitable modifications and equivalents that fall within the scope of the invention as defined by the claims which follow.

The embodiments of the invention in which an exclusive property or privilege is claimed are defined as follows:

1. A method of using a computer processor to analyze the chemical composition of a liquid effluent from a direct contact condenser, comprising the steps of:

providing a set of input values representative of the condenser and of inlet fluid streams to the condenser, wherein said input values include a chemical property of an inlet cooling liquid to the condenser, a chemical property of an inlet vapor stream to the condenser, and physical properties of a contact medium in the condenser;

performing a calculation to determine a concentration of a chemical component in the liquid effluent from the condenser; and using the computer processor to compare said calculated concentration to a predetermined concentration.

2. A method according to claim 1, wherein said chemical property of the inlet cooling liquid is selected from the group consisting of a concentration of a soluble chemical species in the inlet cooling liquid, an ionic charge associated with said soluble chemical species, and the pH of the inlet cooling liquid.

3. A method according to claim 1, wherein said chemical property of the inlet vapor stream is a concentration of a chemical species in the inlet vapor stream or an ionic charge associated with said chemical species.

4. A method according to claim 1, wherein said physical properties of the contact medium include dimensions of a channel in the contact medium and an orientation of the channel in the contact medium.

5. A method according to claim 4, wherein said dimensions of a channel in the contact medium include a flute height, a flute base, and a flute side.

6. A method according to claim 4, wherein said orientation of the channel in the contact medium includes an inclination angle for channel forming sheets in the contact medium.

7. A method according to claim 1, wherein said physical properties of the contact medium include a thickness of a sheet in the contact medium.

8. A method according to claim 1, wherein said input values further include an inlet vapor temperature, an inlet cooling liquid temperature, and an inlet vapor pressure.

9. A method for enhancing and predicting chemical and physical performance of a direct contact condenser having a vapor inlet for receiving a vapor stream, a cooling liquid inlet for providing a cooling liquid into the condenser, a contact medium comprising a plurality of sheets for facilitating contact and direct heat exchange between the received vapor stream and the cooling liquid, a condensate well with a liquid outlet for collecting and discharging condensate and any contaminants dissolved in the condensate, and a noncondensable gas outlet for discharging noncondensed gases, the method implemented on a computer having a memory and comprising the steps of:

inputting condenser data including flow direction of vapor stream through the contact medium, power level of the condenser, contact medium height measured along a vertical axis, contact medium cross-sectional area in a plane perpendicular to the vertical axis, total condenser area, and percentage of unavailable contact medium area;

inputting an inclination angle for the contact medium measured between a surface of the sheet and a horizontal axis;

determining geometric parameters of the contact medium based on the condenser data and the inclination height;

inputting thermodynamic properties of the vapor stream and of the cooling liquid and concentrations of each of a plurality noncondensable gases in the vapor stream;

beginning at one end of the condenser, computing a steady state parameter profile, including physical property data for the cooling liquid, the vapor stream, the condensate, and the contact medium, for a cross-sectional volume of the contact medium having a selectable thickness; and repeating the computing step for each slice of the contact medium extending along a vertical axis of the condenser away from the one end until the combined thicknesses of the slices are about the height of the contact medium.

10. The method of claim 9, further comprising the step of using the steady state parameter profiles to determine condenser performance values including thermodynamic efficiency, total effluent discharge from the liquid outlet of the condensate well, heat transfer between the vapor stream and the cooling liquid, momentum and energy balances, mass transfer balances, chemical component material balances, flow rate through the noncondensable gas outlet.

11. The method of claim 9, wherein the physical property data in each steady state parameter profile is selected from the group consisting of heat capacity, density, viscosity, thermal conductivity, water film thickness, liquid side and gas side mass and heat transfer coefficients, friction factors, diffusivity, liquid phase pH, gas-liquid interface temperature, ionic composition of the liquid phase, the Prandtl number, and the Schmidt number.

12. The method of claim 9, wherein the beginning one end is the top of the condenser for downward flow direction through the contact medium and is the bottom of the condenser for upward flow direction through the contact medium.

13. The method of claim 9, wherein the geometric parameters include side dimensions, a liquid renewal length, the sine of a modified inclination angle, hydraulic diameters of channels formed by the sheets, a void fraction, and available geometric surface area per unit volume of the contact medium.

14. The method of claim 9, further including the step of assigning an ionic charge to chemical species to be tracked by the method.

15. The method of claim 14, wherein the number of chemical species is between one and twenty-five.

16. The method of claim 15, further comprising the step of determining a concentration of each of the chemical species dissolved in the condensate, wherein the concentration determining step is performed for each of the slices of the contact medium to identify distribution of molecular species and ionic species of the chemical species in the condensate.

17. The method of claim 16, further comprising the steps of using the identified molecular distribution of each of the chemical species to calculate an equilibrium partial pressure and using the calculated equilibrium partial pressures to estimate a driving force for mass transfer of each of the chemical species which is used to predict chemical performance of the condenser.

18. The method of claim 9, wherein the computing step is repeated at least about 17 times.

19. The method of claim 9, wherein the thickness of each slice is less than about 2.5 centimeters.

20. The method of claim 9, further comprising the step of repeating condenser data inputting, inclination angle input, determining geometric parameters, thermodynamic properties input, computing, and repeating steps to allow a user to input differing values to select an enhanced contact medium configuration for an anticipated vapor stream and cooling liquid.

21. The method of claim 9, wherein the condenser includes a first and a second chamber through which the vapor stream is directed, each of the chambers containing a portion of the contact medium that received cooling liquid from the cooling liquid inlet, and wherein the flow direction of the vapor stream differs in each of the chambers.

22. The method of claim 9, wherein the thermodynamic properties include gas loading, superheat, condenser pressure, steam quality, noncondensable gas concentrations, mass flow rates for vapor, cooling liquid, and condensate, liquid loading, liquid inlet temperature, and caustic concentration.

* * * * *